US011511326B2

(12) United States Patent
Daimon et al.

(10) Patent No.: US 11,511,326 B2
(45) Date of Patent: Nov. 29, 2022

(54) PIERCING MACHINE, AND METHOD FOR PRODUCING SEAMLESS METAL PIPE USING THE SAME

(71) Applicant: NIPPON STEEL CORPORATION, Tokyo (JP)

(72) Inventors: Yasuhiko Daimon, Tokyo (JP); Akihiro Sakamoto, Tokyo (JP); Haruka Obe, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 108 days.

(21) Appl. No.: 16/761,567

(22) PCT Filed: Nov. 28, 2018

(86) PCT No.: PCT/JP2018/043801
§ 371 (c)(1),
(2) Date: May 5, 2020

(87) PCT Pub. No.: WO2019/107418
PCT Pub. Date: Jun. 6, 2019

(65) Prior Publication Data

US 2020/0276625 A1 Sep. 3, 2020

(30) Foreign Application Priority Data

Nov. 29, 2017 (JP) ..... JP2017-228500

(51) Int. Cl.
*B21B 19/04* (2006.01)
*B21B 45/02* (2006.01)
(Continued)

(52) U.S. Cl.
CPC ..... *B21B 19/04* (2013.01); *B21B 23/00* (2013.01); *B21B 45/0209* (2013.01);
(Continued)

(58) Field of Classification Search
CPC . B21B 19/02; B21B 19/04; B21B 2045/0227; B21B 2045/0212;
(Continued)

(56) References Cited

U.S. PATENT DOCUMENTS 2,830,921 A * 4/1958 Creutz ..... B21B 19/04 148/560
3,675,908 A * 7/1972 Amend ..... C21D 9/085 134/64 R
(Continued)

FOREIGN PATENT DOCUMENTS

CN 1370640 A 9/2002
CN 101850364 A 10/2010
(Continued)

OTHER PUBLICATIONS

Serizawa, Translation of JP-6015878 (Year: 2016).*
Int'l. Search Report of PCT/JP2018/043801, dated Jan. 29, 2019.

*Primary Examiner* — Jessica Cahill
*Assistant Examiner* — Bobby Yeonjin Kim
(74) *Attorney, Agent, or Firm* — Greer, Burns & Crain, Ltd.

(57) ABSTRACT

A piercing machine includes a plurality of skewed rolls, a plug, a mandrel bar and an outer surface cooling mechanism. The outer surface cooling mechanism is disposed around the mandrel bar at a position that is rearward of the plug, and with respect to an outer surface of a hollow shell advancing through a cooling zone which has a specific length in an axial direction of the mandrel bar and which is located rearward of the plug, as seen from an advancing direction of the hollow shell, the outer surface cooling mechanism ejects a cooling fluid toward an upper part of the outer surface, a lower part of the outer surface
(Continued)

and a right part of the outer surface of the hollow shell to cool the hollow shell inside the cooling zone.

13 Claims, 25 Drawing Sheets

(51) Int. Cl.

| | |
|---|---|
| ***C21D 9/08*** | (2006.01) |
| ***C21D 1/667*** | (2006.01) |
| ***B21B 23/00*** | (2006.01) |
| *B21B 17/02* | (2006.01) |
| *B21B 25/00* | (2006.01) |
| *B21B 37/74* | (2006.01) |

(52) U.S. Cl.
CPC ..... *B21B 45/0215* (2013.01); *B21B 45/0233* (2013.01); *C21D 1/667* (2013.01); *C21D 9/085* (2013.01); *B21B 17/02* (2013.01); *B21B 25/00* (2013.01); *B21B 37/74* (2013.01); *B21B 45/0218* (2013.01); *B21B 2045/0212* (2013.01); *B21B 2045/0227* (2013.01)

(58) Field of Classification Search
CPC . B21B 45/0215; B21B 45/0233; B21B 37/74; C21D 1/667; C21D 9/085; C21D 9/08; C21D 9/00
See application file for complete search history.

(56) References Cited

U.S. PATENT DOCUMENTS

| | | | | |
|---|---|---|---|---|
| 3,782,160 | A * | 1/1974 | Kheifets | B21B 25/04 72/201 |
| 2002/0116971 | A1 | 8/2002 | Roller | |
| 2012/0017662 | A1 * | 1/2012 | Sendai | B21B 23/00 72/69 |

FOREIGN PATENT DOCUMENTS

| | | | | |
|---|---|---|---|---|
| CN | 102405114 | A | 4/2012 | |
| JP | 52086911 | A | 7/1977 | |
| JP | 56030001 | A | 3/1981 | |
| JP | 03099708 | A | 4/1991 | |
| JP | 2010247218 | A | 11/2010 | |
| JP | 6015878 | B2 * | 10/2016 | B21D 7/165 |
| JP | 2017013102 | A | 1/2017 | |

* cited by examiner

PIERCING MACHINE, AND METHOD FOR PRODUCING SEAMLESS METAL PIPE USING THE SAME

This is a National Phase Application filed under 35 U.S.C. § 371, of International Application No. PCT/JP2018/043801, filed Nov. 28, 2018, the contents of which are incorporated by reference.

TECHNICAL FIELD

The present disclosure relates to a piercing machine, and a method for producing; a seamless metal pipe using the piercing machine.

BACKGROUND ART

The Mannesmann process is available as a method for producing a seamless metal pipe that is typified by a steel pipe. According to the Mannesmann process, a solid round billet is subjected to piercing-rolling using a piercing null to produce a hollow shell. The hollow shell produced by piercing-rolling is then subjected to elongation rolling to provide the hollow shell with a prescribed wall thickness and external diameter. For example, an elongator, a plug mill or a mandrel mill is used for the elongation rolling. The hollow shell that underwent elongation rolling is subjected to diameter adjusting rolling using a sizing mill such as a sizer or a stretch reducer to thereby produce a seamless metal pipe having a desired external diameter.

Among the aforementioned apparatuses for producing a seamless metal pipe, the configurations of the piercing mill and the elongator are similar to each other. The piercing mill and the elongator each include a plurality of skewed rolls, a plug and a mandrel bar. The plurality of skewed rolls are arranged at regular intervals around a pass line along which the material (a round billet in the case of a piercing mill, and a hollow shell in the case of an elongator) passes. The plug is disposed on the pass line, between the plurality of skewed rolls. The plug has a bullet shape, and the external diameter of a fore end portion of the plug is smaller than the external diameter of a rear end portion of the plug. The fore end portion of the plug is disposed facing the material before piercing-rolling or before elongation rolling. The fore end of the mandrel bar is connected to a central part of the rear end face of the plug. The mandrel bar is disposed on the pass line, and extends along the pass line.

The piercing mill presses a round billet as the material against the ping while rotating the round billet in the circumferential direction by means of the plurality of skewed rolls, to thereby subject the round billet to piercing-rolling to form a hollow shell. Similarly, the elongator inserts the plug into a hollow shell as the material while rotating the hollow shell in the circumferential direction of the hollow shell by means of the plurality of skewed rolls, and rolls down the hollow shell between the skewed rolls and the plug to perform elongation rolling of the hollow shell.

Hereinafter, in the present description, a rolling apparatus that is equipped with a plurality of skewed rolls, a plug and a mandrel bar, such as a piercing mill or an elongator, is defined as a "piercing machine". Further, in the respective configurations of the piercing machine, the entrance side of the skewed rolls of the piercing machine is defined as "frontward", and the delivery side of the skewed rolls of the piercing machine is defined as "rearward".

Recently, there are demands to increase the strength of seamless metal pipes. For example, in the case of seamless pipes for use in oil wells or gas wells, accompanying the deepening of oil wells and gas wells, there is a demand for such pipes to have high strength. In order to produce such seamless metal pipes that have high strength, for example, a hollow shell is subjected to quenching and tempering after undergoing piercing-rolling and elongation rolling.

If the temperature distribution in the axial direction (longitudinal direction) of the hollow shell before quenching, is nonuniform, the micro-structure in the hollow shell after quenching may be nonuniform in the axial direction. If the micro-structure is nonuniform in the axial direction of the hollow shell, variations may arise in the mechanical properties in the axial direction of a produced seamless metal pipe. Accordingly, it is preferable that the occurrence of variations in the temperature distribution in the axial direction of a hollow shell after undergoing piercing-rolling or elongation rolling using a piercing machine can be suppressed. Specifically, it is preferable that the occurrence of a temperature difference between the fore end portion and the rear end portion of a hollow shell after piercing-rolling or after elongation rolling is suppressed.

Techniques for reducing nonuniformity in the temperature distribution of a hollow shell produced using a piercing machine are proposed in Japanese Patent Application Publication No. 3-99708 (Patent Literature 1) and Japanese Patent Application Publication No. 2017-13102 (Patent Literature 2).

In Patent Literature 1, the following matters are described. An objective of Patent Literature 1 is to reduce a temperature difference between the inner surface and outer surface of a high-alloy seamless pipe having high deformation resistance, which is caused by processing-incurred heat that arises during piercing-rolling or elongation rolling. According to Patent Literature 1, a nozzle hole capable of ejecting cooling water in a diagonally rearward direction is formed in a rear portion of a plug. During piercing-rolling, cooling water is ejected from the nozzle hole in the rear portion of the plug toward the inner surface of a hollow shell that is being subjected to piercing-rolling. By this means, the inner surface at which the temperature increased more than the outer surface due to processing-incurred heat is cooled, thereby reducing the temperature difference between the inner and outer surfaces of the hollow shell.

In Patent Literature 2, the following matters are described. In a elongation rolling mill such as an elongator, when a plug is inserted into a hollow shell to perform elongation rolling, the temperature of the plug at the initial stage of elongation rolling is lower than the temperature of the hollow shell. Subsequently, during the elongation rolling, the temperature of the plug increases due to beat of the hollow shell being transferred to the plug. On the other hand, although the temperature of the hollow shell at the initial stage of elongation rolling is high, the temperature of the hollow shell gradually decreases due to beat release during the elongation rolling. In other words, the temperature of the plug and the temperature of the hollow shell each change dining the period from the start to the end of elongation rolling. Therefore, there is a problem that the temperature distribution in the axial direction of the hollow shell after elongation rolling is nonuniform (see paragraph [0010] of Patent Literature 2). Therefore, according to Patent Literature 2, a plurality of ejection holes are provided in the rear end face of the plug or in the fore end portion of the mandrel bar. Cooling fluid is sprayed onto the inner surface of the hollow shell that is being subjected to elongation rolling from the ejection holes in the rear end face of the plug or the ejection holes in the fore end portion of the mandrel bar. More specifically, first, the temperature distribution in the axial direction of the hollow shell is acquired in advance with respect to a time when an intermediate hollow shell was subjected to elongation rolling without ejecting cooling fluid from the rear end face of the plug or the fore end portion of the mandrel bar. Then, elongation rolling is performed while adjusting the amount of cooling fluid ejected from the ejection holes of the rear end face of the plug or the ejection holes of the fore end portion of the mandrel bar based on the obtained temperature distribution. Thus, the temperature distribution in the axial direction of the hollow shell after elongation rolling can be made uniform (paragraphs [0020], [0021] and the like).

CITATION LIST

Patent Literature

Patent Literature 1: Japanese Patent Application Publication No. 3-99708

Patent Literature 2: Japanese Patent Application Publication No. 2017-13102

SUMMARY OF INVENTION

Technical Problem

According to the techniques proposed in Patent Literature 1 and Patent Literature 2, a hollow shell is cooled by ejecting a cooling fluid toward the inner surface of the hollow shell from a plug or a mandrel to thereby cool the inner surface of the hollow shell. However, when these techniques are applied, in some cases a temperature difference arises between the fore end portion of the hollow shell that passes through the skewed rolls in an initial stage of and the rear end portion of the hollow shell that passes through the skewed rolls at the end of rolling, and it is difficult for the temperature distribution in the axial direction of the hollow shell after piercing-rolling by a piercing mill or after elongation rolling by an elongator to become uniform.

An objective of the present disclosure is to provide a piercing machine that can reduce temperature variations in the longitudinal direction (axial direction) of a hollow shell after piercing-rolling or after elongation rolling, and a method for producing a seamless metal pipe using the piercing machine.

Solution to Problem

A piercing machine according to the present disclosure is a piercing machine that performs piercing-rolling or elongation rolling of a material to produce a hollow shell, comprising:

a plurality of skewed rolls disposed around a pass line along which the material passes;

a plug disposed on the pass line between a plurality of the skewed rolls;

a mandrel bar extending rearward of the plug along the pass line from a rear end of the plug; and an outer surface cooling mechanism disposed around the mandrel bar, at a position that is rearward of the plug, wherein:

with respect to an outer surface of the hollow shell advancing through a cooling zone which has a specific length in an axial direction of the mandrel bar and is located rearward of the plug, as seen from an advancing direction of the hollow shell, the outer surface cooling mechanism ejects a cooling fluid toward an upper part of the outer surface, a lower part of the outer surface, a left part of the outer surface and a right part of the outer surface to cool the hollow shell inside the cooling zone.

A method for producing a seamless metal pipe according to the present disclosure is a method for producing a seamless metal pipe using the aforementioned piercing machine, comprising:

a rolling process of subjecting the material to piercing-rolling or elongation rolling using the piercing machine to form a hollow shell; and a cooling process of, during the piercing-rolling or the elongation rolling, in a cooling zone of a predetermined range extending in an axial direction of the mandrel bar which is located rearward of a rear end of the plug, cooling the hollow shell subjected to piercing-rolling or elongation rolling and passing the plug, by ejecting a cooling fluid toward an outer surface of the hollow shell.

Advantageous Effect of Invention

The piercing machine according to the present disclosure can reduce temperature variations in the axial direction of a hollow shell after piercing-rolling or after elongation rolling. The method for producing a seamless metal pipe according to the present disclosure can reduce temperature variations in the axial direction of a hollow shell after piercing-rolling or after elongation rolling.

DESCRIPTION OF EMBODIMENTS

[Spirit and Scope of Present Disclosure]

Figure 1:
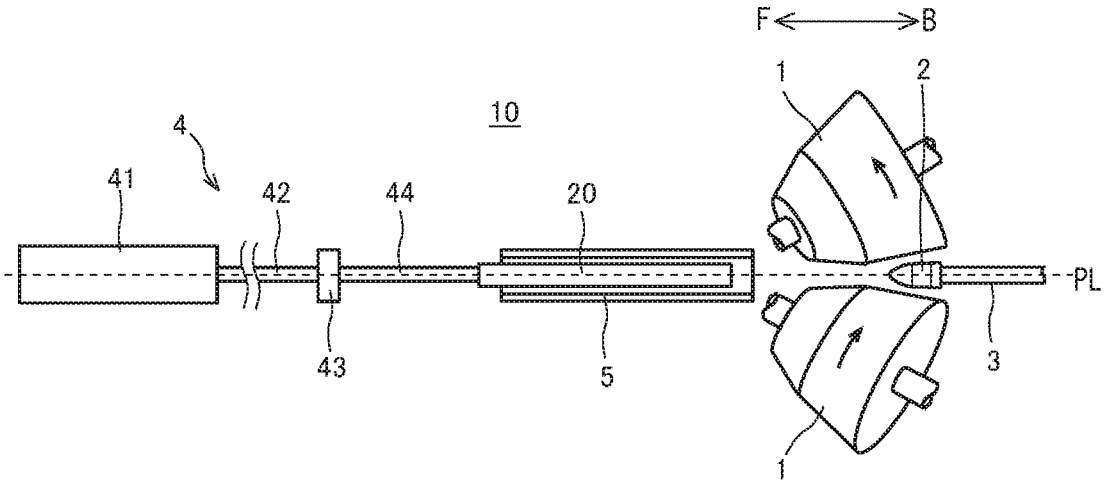
FIG. 1 is a side view of a piercing machine according to a first embodiment.

The present inventors conducted studies and investigations with a view to clarifying the reason why a temperature difference between the fore end portion and the rear end portion in the axial direction (longitudinal direction) of a hollow shell after piercing-rolling or elongation rolling is not reduced sufficiently when the techniques disclosed in Patent Literature 1 and Patent Literature 2 are applied. Here, the term "fore end portion of a hollow shell" means, of the two end portions in the axial direction of the hollow shell, the end portion that first passes the plug during piercing-rolling or elongation rolling. The term "rear end portion of a hollow shell" means the end portion that passes the plug last during piercing-rolling or elongation rolling. Further, in the present description, with regard to the directions of the respective configurations of the piercing machine, the entrance side of the piercing machine is defined as "frontward", and the delivery side of the piercing machine is defined as "rearward".

As the result of the studies and investigations conducted by the present inventors, it has been found that there is a possibility of the following problems occurring when the techniques disclosed in Patent Literatures 1 and 2 are applied. According to Patent Literature 1 and Patent Literature 2, during piercing-rolling or during elongation rolling, cooling water or a cooling fluid is continuously ejected toward the inner surface of a hollow shell from the rear end portion of a plug or the fore end portion of a mandrel bar. In this case, immediately after the inner surface portion of the hollow shell passes the plug, the inner surface portion of the hollow shell is cooled. However, the coolant ejected toward the inner surface of the hollow shell from the plug or the mandrel bar strikes against the inner surface and falls downward. The coolant that has fallen downward is liable to accumulate at an inner surface portion that, with respect to the entire inner surface of the hollow shell that is being subjected to piercing-rolling and elongation rolling, is a portion which is located further downward than the mandrel bar.

In the initial stage of rolling when performing piercing-rolling or elongation rolling, the fore end portion of the rolled hollow shell passes the plug. At such time, the fore end portion of the hollow shell is an open space, while on the other hand, of the entire hollow shell, a portion in the vicinity of the plug 2 is a closed space. As rolling proceeds, the distance from the rear end of the plug that is a closed space to the fore end (open space) of the hollow shell lengthens. As the distance to the open space lengthens, the aforementioned accumulation of coolant accumulates over a longer distance (more widely) in the longitudinal direction of the hollow shell. Although the inner surface portion at which the coolant is accumulating is cooled, the area in which the coolant accumulates changes as the rolling proceeds. Therefore, differences with regard to the length of the cooling time period arise at each position in the axial direction of the hollow shell.

Specifically, the fore end portion of the hollow shell is liable to be cooled for a long time period by accumulated coolant, and consequently the temperature thereof decreases. On the other hand, obviously the inner surface of the hollow shell does not exist to the rear of the rear end portion of the hollow shell. Therefore, when the rear end portion of the hollow shell passes the plug, coolant does not accumulate. Accordingly, the cooling time period of the inner surface of the rear end portion of the hollow shell is shorter than the cooling time period of the inner surface of the fore end portion of the hollow shell. Consequently, a temperature difference arises between the fore end portion and the rear end portion of the hollow shell.

Based on the novel findings described above, the present inventors conducted studies regarding methods for suppressing the occurrence of a temperature difference between the fore end portion and the rear end portion of a hollow shell.

In a case where a hollow shell subjected to piercing-rolling or elongation rolling is cooled from the inner surface, as described above, there is a possibility that accumulation of coolant may occur and a temperature difference may arise between the fore end portion and the rear end portion of the hollow shell. On the other hand, in a case where a hollow shell subjected to piercing-rolling or elongation rolling is cooled from the outer surface by ejecting a cooling fluid toward, as seen from the advancing direction of the hollow shell, an upper part of the outer surface, a lower part of the outer surface, a left part of the outer surface and a right part of the outer surface of the hollow shell, the problem of accumulation of coolant does not arise. This is because when a hollow shell is cooled from the outer surface, unlike a case of cooling a hollow shell from the inner surface, the coolant drops down to below the hollow shell from the outer surface of the hollow shell. Therefore, the present inventors have concluded that if, on the delivery side of the skewed rolls, a hollow shell is cooled from the outer surface by ejecting cooling fluid toward the upper part of the outer surface, the lower part of the outer surface, the left part of the outer surface and the right part of the outer surface of the hollow shell, the occurrence of a temperature difference between the fore end portion and the rear end portion of the hollow shell can be suppressed.

A configuration of a piercing machine according to the present embodiment that has been completed based on the above findings is as described in the following.

A piercing machine according to a configuration of (1) is a piercing machine that performs piercing-rolling or elongation rolling of a material to produce a hollow shell, comprising:

a plurality of skewed rolls disposed around a pass line along which the material passes;

a plug disposed on the pass line between a plurality of the skewed rolls;

a mandrel bar extending rearward of the plug along the pass line from a rear end of the plug, and an outer surface cooling mechanism disposed around the mandrel bar, at a position that is rearward of the plug, wherein:

with respect to an outer surface of the hollow shell advancing through a cooling zone which has a specific length in an axial direction of the mandrel bar and is located rearward of the plug, as seen from an advancing direction of the hollow shell, the outer surface cooling mechanism ejects a cooling fluid toward an upper part of the outer surface, a lower part of the outer surface, a left part of the outer surface and a right part of the outer surface to cool the hollow shell inside the cooling zone.

In the piercing machine according to the configuration of (1), at the position that is rearward of the plug, the upper part of the outer surface, the lower part of the outer surface, the left part of the outer surface, and the right part of the outer surface of the hollow shell subjected to piercing-rolling or elongation rolling are cooled within the cooling zone of a specific length. In this case, after a cooling fluid that is used for cooling, is ejected toward the upper part of the outer surface, the lower part of the outer surface, the left part of the outer surface and the right part of the outer surface of the hollow shell inside the cooling zone to cool the hollow shell, the cooling fluid flows down to below the hollow shell and does not stay on the hollow shell. Therefore, the hollow shell is cooled by the cooling fluid inside the cooling zone, and it is difficult for the hollow shell to be subjected to cooling by the cooling fluid in a zone other than the cooling, zone. Consequently, the time periods of cooling by the cooling fluid at respective locations in the axial direction of the hollow shell are uniform to a certain extent. Thus, the occurrence of a situation in which a temperature difference between the fore end portion and the rear end portion of a hollow shell is large due to cooling fluid accumulating at the inner surface of the hollow shell, which occurs when using the conventional technology, can be suppressed, and a temperature variation in the axial direction of the hollow shell can be reduced.

A piercing machine according to a configuration of (2) is in accordance with the piercing machine according to (1), wherein:

the outer surface cooling, mechanism includes:

an outer surface cooling upper member disposed above the mandrel bar as seen from an advancing direction of the hollow shell, the outer surface cooling upper member including a plurality of cooling fluid upper-part ejection holes which eject the cooling fluid toward the upper part of the outer surface of the hollow shell in the cooling zone;

an outer surface cooling lower member disposed below the mandrel bar as seen from the advancing direction of the hollow shell, the outer surface cooling lower member including a plurality of cooling fluid lower-part ejection holes which eject the cooling fluid toward the lower part of the outer surface of the hollow shell in the cooling zone;

an outer surface cooling upper member disposed leftward of the mandrel bar as seen from the advancing direction of the hollow shell, the outer surface cooling left member including a plurality of cooling fluid left-part ejection holes which eject the cooling fluid toward the left part of the outer surface of the hollow shell in the cooling zone; and an outer suffice cooling right member disposed rightward of the mandrel bar as seen from the advancing direction of the hollow shell the outer surface cooling right member, including a plurality of cooling fluid right-part ejection holes which eject the cooling fluid toward the right part of the outer surface of the hollow shell in the cooling zone.

In the piercing machine according to the configuration of (2), the outer surface cooling mechanism ejects the cooling fluid toward the upper part of the outer surface of the hollow shell from an outer surface cooling upper member, ejects the cooling fluid toward the lower part of the outer surface of the hollow shell from an outer surface cooling lower member, ejects the cooling fluid toward the left part of the outer surface of the hollow shell from an outer surface cooling left member, and ejects the cooling fluid toward the right part of the hollow shell from an outer surface cooling right member, with the outer surface cooling upper member, the outer surface cooling lower member, the outer surface cooling left member and the outer surface cooling right member being disposed around the mandrel bar. By this means, with respect to the outer surface of the hollow shell that is inside the cooling zone, the upper part of the outer surface, the lower part of the outer surface, the left part of the outer surface and the right part of the outer surface of the hollow shell that are inside a specific area (cooling zone) in the axial direction of the hollow shell can be cooled. Further, it is easy for the cooling fluid ejected toward the upper part of the outer surface, the lower part of the outer surface, the left part of the outer surface and the right part of the outer surface of the hollow shell in the cooling zone to drop down naturally under the force of gravity, and it is difficult for the cooling fluid to flow out to the outside of the cooling zone. Therefore, the occurrence of a situation in which the upper part of the outer surface, the lower part of the outer surface, the left part of the outer surface or the right part of the outer surface of the hollow shell that is in a zone other than the cooling zone is cooled by cooling fluid ejected inside the cooling zone can be suppressed. As a result, temperature variations in the axial direction of the hollow shell can be reduced.

Note that, the outer surface cooling upper member, the outer surface cooling lower member, the outer surface cooling left member, and the outer surface cooling right member may each be a separate and independent member or may be integrally connected to each other. For example, as seen from the advancing direction of the hollow shell, a left edge of the outer surface cooling upper member and an upper edge of the outer surface cooling left member may be connected, and a right edge of the outer surface cooling upper member and an upper edge of the outer surface cooling right member may be connected. Further, as seen from the advancing direction of the hollow shell, a left edge of the outer surface cooling lower member and a lower edge of the outer surface cooling left member may be connected, and a right edge of the outer surface cooling lower member and a lower edge of the outer surface cooling right member may be connected. Furthermore, the outer surface cooling upper member may include a plurality of members that are separate and independent, the outer surface cooling lower member may include a plurality of members that are separate and independent, the outer surface cooling left member may include a plurality of members that are separate and independent, and the outer surface cooling right member may include a plurality of members that are separate and independent.

A piercing machine according to a configuration of (3) is in accordance with the piercing machine according to the configuration of (2), wherein:

the cooling fluid is a gas and/or a liquid.

In the piercing machine according to the configuration of (3), as the cooling fluid, the outer surface cooling mechanism may use a gas, may use a liquid, or may use both a gas and a liquid. Here, the gas is, for example, air or an inert gas. The inert gas is, for example, argon gas or nitrogen gas. In the case of utilizing a gas as the cooling fluid, only air may be utilized, or only an inert gas may be utilized, or both air and an inert gas may be utilized. Further, as the inert gas, only one kind of inert gas (for example, argon gas only, or nitrogen gas only) may be utilized, or a plurality of inert gases may be mixed and utilized. In the case of utilizing a liquid as the cooling fluid, the liquid is, for example, water or oil, and preferably is water.

A piercing machine according to a configuration of (4) is in accordance with the piercing machine according to the configuration of any one of (1) to (3), further comprising:

a frontward damming mechanism that is disposed around the mandrel bar, at a position that is rearward of the plug and is frontward of the outer surface cooling mechanism, wherein:

the frontward damming mechanism comprises a mechanism that, when the outer surface cooling mechanism is cooling the hollow shell in the cooling zone by ejecting the cooling fluid toward the upper part of the outer surface, the lower part of the outer surface, the left part of the outer surface and the right part of the outer surface of the hollow shell, dams the cooling fluid from flowing to the upper part of the enter surface, the lower part of the outer surface, the left part of the outer surface and the right part of the outer surface of the hollow shell before the hollow shell enters the cooling zone.

In the piercing machine according to the configuration of (4), after the cooling fluid ejected toward the upper part of the outer surface, the lower part of the outer surface, the left part of the outer surface and the right part of the outer surface of the hollow shell in the cooling zone comes in contact with the upper part of the outer surface, the lower part of the outer surface, the left part of the outer surface and the right part of the outer surface of the hollow shell, the frontward damming mechanism dams the cooling fluid from flowing to an outer surface portion of the hollow shell that is frontward of the cooling zone. Therefore, it is difficult for the cooling fluid ejected toward the outer surface of the hollow shell inside the cooling zone from the outer surface cooling mechanism to flow out in the frontward direction from inside the cooling zone, and the cooling fluid drops downward under the force of gravity inside the cooling zone. Thus, the occurrence of a temperature difference between the fore end portion and the rear end portion of the hollow shell can be further suppressed. As a result, a temperature variation in the axial direction of the hollow shell can be further reduced.

A piercing machine according to a configuration of (5) is in accordance with the piercing machine described in (4), wherein:

the frontward damming mechanism includes:

a frontward damming upper member including a plurality of frontward damming fluid upper-part ejection holes that is disposed above the mandrel bar as seen from an advancing direction of the hollow shell, and that ejects a frontward damming fluid toward the upper part of the outer surface of the hollow shell that is positioned in a vicinity of an entrance side of the cooling zone and dams the cooling fluid from flowing to the upper part of the outer surface of the hollow shell before the hollow shell enters the cooling zone;

a frontward damming left member including a plurality of frontward damming fluid lower-part ejection holes that is disposed leftward of the mandrel bar as seen from the advancing direction of the hollow shell, and that ejects the frontward damming fluid toward the left part of the outer surface of the hollow shell that is positioned in a vicinity of the entrance side of the cooling zone and dams the cooling fluid from flowing to the left part of the outer surface of the hollow shell before the hollow shell enters the cooling zone; and a frontward damming right member including a plurality of frontward damming fluid right-part ejection holes that is disposed rightward of the mandrel liar as seen from the advancing direction of the hollow shell, and that ejects the frontward damming fluid toward the right part of the outer surface of the hollow shell that is positioned in a vicinity of the entrance side of the cooling zone and dams the cooling fluid from flowing to the right part of the outer surface of the hollow shell before the hollow shell enters the cooling zone.

In the piercing machine according to the configuration of (5), the frontward damming upper member dams the cooling fluid that contacts the upper part of the outer surface of the hollow shell within the cooling zone and rebounds therefrom and attempts to fly out to a zone that is frontward of the cooling zone, by means of the frontward damming fluid that the frontward damming upper member ejects in the vicinity of the entrance side of the cooling zone. The frontward damming left member dams the cooling fluid that contacts the left part of the outer surface of the hollow shell within the cooling zone and rebounds therefrom and attempts to fly out to the zone that is frontward of the cooling zone, by means of the frontward damming fluid that the frontward damming left member ejects in the vicinity of the entrance side of the cooling zone. The frontward damming right member dams the cooling fluid that contacts the right part of the outer surface of the hollow shell within the cooling zone and rebounds therefrom and attempts to fly out to the zone that is frontward of the cooling zone, by means of the frontward damming fluid that the frontward damming right member ejects in the vicinity of the entrance side of the cooling zone. Therefore, the frontward damming fluid ejected from the frontward damming upper member, the frontward damming fluid ejected from the frontward damming left member, and the frontward damming fluid ejected from the frontward damming right member act as dams (protective walls). Thus, contact of the cooling fluid with the outer surface portion of the hollow shell that is frontward of the cooling zone can be suppressed, and a temperature variation in the axial direction of the hollow shell can be reduced. Note that, the cooling fluid ejected toward the lower part of the outer surface of the hollow shell inside the cooling zone from the outer surface cooling mechanism easily drops down naturally to below the hollow shell under the force of gravity after contacting the lower part of the outer surface of the hollow shell. Therefore, the piercing machine according to the configuration of (19) need not include a frontward damming lower member.

Note that the phrase "vicinity of the entrance side of the cooling zone" means the vicinity of the fore end of the cooling zone. Although the range of the vicinity of the entrance side of the cooling zone is not particularly limited, for example, the phrase means a range within 1000 nm before and after the entrance side (fore end) of the cooling zone, and preferably means a range within 500 mm before and after the entrance side (fore end) of the cooling zone, and more preferably means a range within 200 mm before and after the entrance side (fore end) of the cooling zone.

A piercing machine according to a configuration of (6) is in accordance with the piercing machine described in (5), wherein:

the frontward damming upper member ejects the frontward damming fluid diagonally rearward toward the upper part of the outer surface of the hollow shell that is positioned in a vicinity of the entrance side of the cooling zone from a plurality of the frontward damming fluid upper-part ejection holes;

the frontward damming left member ejects the frontward damming fluid diagonally rearward toward the left part of the outer surface of the hollow shell that is positioned in a vicinity of the entrance side of the cooling zone from a plurality of the frontward damming fluid left-part ejection holes; and the frontward damming right member ejects the frontward damming fluid diagonally rearward toward the right part, of the outer surface of the hollow shell that is positioned in a vicinity of the entrance side of the cooling zone from a plurality of the frontward damming fluid right-part ejection holes.

In the piercing machine according to the configuration of (6), the frontward damming upper member ejects the frontward damming fluid diagonally rearward toward the upper part of the outer surface of the hollow shell in the vicinity of the entrance side of the cooling zone from the frontward damming fluid upper-part ejection holes. Therefore, the frontward damming upper member forms a dam (protective wall) of frontward damming fluid that extends diagonally rearward toward the upper part of the outer surface of the hollow shell from above. Similarly, the frontward damming left member ejects the frontward damming fluid diagonally rearward toward the left part of the outer surface of the hollow shell in the vicinity of the entrance side of the cooling zone from the frontward damming fluid left-part ejection holes. Therefore, the frontward damming left member forms a dam (protective wall) of frontward damming fluid that extends diagonally rearward toward the left part of the outer surface of the hollow shell from the left direction. Similarly, the frontward damming right member ejects the frontward damming fluid diagonally rearward toward the right part of the outer surface of the hollow shell in the vicinity of the entrance side of the cooling zone from the frontward damming fluid right-part ejection holes. Therefore, the frontward damming right member forms a dam (protective wall) of frontward damming fluid that extends diagonally rearward toward the right part of the outer surface of the hollow shell from the right direction. These dams dam the cooling fluid that contacts the outer surface portion of the hollow shell within the cooling zone and rebounds therefrom and attempts to fly out to the zone that is frontward of the cooling zone. In addition, after the frontward damming fluid constituting the dams contacts the outer surface portion of the hollow shell in the vicinity of the entrance side of the cooling zone, the frontward damming fluid easily flows into the cooling zone. Therefore, the occurrence of a situation in which the frontward damming fluid constituting the dams cools the outer surface portion of the hollow shell that is frontward of the cooling zone can be suppressed.

A piercing machine according to a configuration of (7) is in accordance with the piercing machine described in (5) or (6), wherein:

the frontward damming mechanism further includes:

a frontward damming lower member including a plurality of frontward damming fluid lower-part ejection holes that is disposed below the mandrel bar as seen from the advancing direction of the hollow shell, and that ejects the frontward damming fluid toward the lower part of the outer surface of the hollow shell that is positioned in a vicinity of the entrance side of the cooling zone and dams the cooling fluid from flowing to the lower part of the outer surface of the hollow shell before the hollow shell enters the cooling zone.

In the piercing machine according to the configuration of (7) together with the frontward damming upper member, the frontward damming left member and the frontward damming right member, the frontward damming lower member ejects the frontward damming fluid in the vicinity of the entrance side of the cooling zone and dams the cooling fluid that contacts the lower part of the outer surface of the hollow shell within the cooling zone and rebounds therefrom and attempts to fly out to the zone that is frontward of the cooling zone. Therefore, contact of the cooling fluid with the outer surface portion of the hollow shell that is frontward of the cooling zone can be further suppressed and a temperature variation in the axial direction of the hollow shell can be further reduced.

Note that, the frontward damming upper member, the frontward damming lower member, the frontward damming left member, and the frontward damming right member may each be a separate and independent member or may be integrally connected to each other. For example, as seen from the advancing direction of the hollow shell, a left edge of the frontward damming upper member and an upper edge of the frontward damming left member may be connected, and a right edge of the frontward damming upper member and an upper edge of the frontward damming right member may be connected. Further, as seen from the advancing direction of the hollow shell, a left edge of the frontward damming lower member and a lower edge of the frontward damming left member may be connected, and a right edge of the frontward damming lower member and a lower edge of the frontward damming right member may be connected. Furthermore, the frontward damming upper member may include a plurality of members that are separate and independent, the frontward damming lower member may include a plurality of members that are separate and independent, the frontward damming left member may include a plurality of members that are separate and independent, and the frontward damming right member may include a plurality of members that are separate and independent.

A piercing machine according to a configuration of (8) is in accordance with the piercing machine according to the configuration of (7), wherein:

the frontward damming lower member ejects the frontward damming fluid diagonally rearward toward the lower part of the outer surface of the hollow shell that is positioned in a vicinity of the entrance side of the cooling zone from a plurality of the frontward damming fluid lower-part ejection holes.

In the piercing machine according to the configuration of (8), together with the frontward damming upper member, the frontward damming left member and the frontward damming right member, the frontward damming lower member ejects the frontward damming fluid diagonally rearward toward the lower part of the outer surface of the hollow shell in the vicinity of the entrance side of the cooling zone from the frontward damming fluid lower-part ejection holes. Therefore, the frontward damming lower member forms a dam (protective wall) of frontward damming fluid that extends diagonally rearward toward the lower part of the outer surface of the hollow shell from below. These dams dam cooling fluid that contacts the outer surface portion of the hollow shell within the cooling zone and rebounds therefrom and attempts to fly out to the zone that is frontward of the cooling zone. In addition, after the frontward damming fluid constituting the dams contacts the outer surface portion of the hollow shell in the vicinity of the entrance side of the cooling zone, the frontward damming fluid easily flows into the cooling zone. Therefore, the occurrence of a situation in which the frontward damming fluid constituting the dams cools the outer surface portion of the hollow Shell that is frontward of the cooling zone can be suppressed.

A piercing machine according to a configuration of (9) is in accordance with the piercing machine according to the configuration of any one of (5) to (8), wherein:

the frontward dunning fluid is a gas and/or a liquid.

In this case, as the frontward damning fluid, a gas may be used, a liquid may be used, or both a gas and a liquid may be used. Here, the gas is, for example, air or an inert gas. The inert gas is, for example, argon gas or nitrogen gas. In the case of utilizing a gas as the frontward damming fluid, only air may be utilized, or only an inert gas may be utilized, or both air and an inert gas may be utilized. Further, as the inert gas, only one kind of inert gas for example, argon gas only, or nitrogen gas only) may be utilized, or a plurality of inert gases may be mixed and utilized. In the case of utilizing a liquid as the frontward damming fluid, the liquid is, for example, water or oil, and preferably is water.

A piercing machine according to a configuration of (10) is in accordance with the piercing machine according to the configuration of any one of (1) to (9), further comprising:

a rearward damming mechanism that is disposed around the mandrel bar, at a position that is rearward of the outer surface cooling mechanism, wherein:

the rearward damming mechanism comprises a mechanism that, when the outer surface cooling mechanism is cooling the hollow shell by ejecting the cooling fluid toward the upper part of the outer surface, the lower part of the outer surface, the left part of the outer surface and the right part of the outer surface of the hollow shell, dams the cooling fluid from flowing to the upper part of the outer surface, the lower part of the outer surface, the left part of the outer surface and the right part of the outer surface of the hollow shell after the hollow shell leaves from the cooling zone.

In the piercing machine according to the configuration of (10), after the cooling fluid ejected toward the upper part of the outer surface, lower part of the outer surface, left part of the outer surface and right part of the outer surface of the hollow shell in the cooling zone comes in contact with the upper part of the outer surface, the lower part of the outer surface, the left part of the outer surface and the right part of the outer surface of the hollow shell, the rearward damming mechanism dams the cooling fluid from flowing to the outer surface portion of the hollow shell after the hollow shell leaves from the cooling zone. Thus, the occurrence of a temperature difference between the fore end portion and the rear end portion of the hollow shell can be further suppressed. As a result, a temperature variation in the axial direction of the hollow shell can be further reduced.

A piercing machine according to a configuration of (11) is in accordance will the piercing machine described in (10), wherein:

the rearward damming mechanism includes:

a rearward damming upper member including a plurality of rearward damming fluid upper-part ejection holes that is disposed above the mandrel bar as seen from the advancing direction of the hollow shell, and that ejects a rearward damming fluid toward the upper part of the outer surface of the hollow shell that is positioned in a vicinity of a delivery side of the cooling zone and dams the cooling fluid from flowing to the upper part of the outer surface of the hollow shell after the hollow shell leaves from the cooling zone;

a rearward damming left member including a plurality of rearward damming fluid left-part ejection holes that is disposed leftward of the mandrel bar as seen from the advancing direction of the hollow shell, and that ejects the rearward damming fluid toward the left part of the outer surface of the hollow shell that is positioned in a vicinity of the delivery side of the cooling zone and dams the cooling fluid from flowing to the left part of the outer surface of the hollow shell after the hollow shell leaves from the cooling zone: and a rearward damming right member including a plurality of rearward damming fluid right-part ejection holes that is disposed rightward of the mandrel bar as seen from the advancing direction of the hollow shell, and that ejects the rearward damming fluid toward the right part of the outer surface of the hollow shell that is positioned in a vicinity of the delivery side of the cooling zone and dams the cooling fluid from flowing to the right part of the outer surface of the hollow shell after the hollow shell leaves from the cooling zone.

In the piercing machine according to the configuration of (11), the rearward damming upper member dams cooling fluid that contacts the upper part of the outer surface of the hollow shell within the cooling zone and rebounds therefrom and attempts to fly out to a zone that is rearward of the cooling zone, by means of the rearward damming fluid that the rearward damming upper member ejects in the vicinity of the delivery side of the cooling zone. The rearward damming left member dams cooling fluid that contacts the left part of the outer surface of the hollow shell within the cooling zone and rebounds therefrom and attempts to fly out to the zone that is rearward of the cooling zone, by means of the rearward damming fluid that the rearward damming left member ejects in the vicinity of the delivery side of the cooling zone. The rearward damming right member dams cooling fluid that contacts the right part of the outer surface of the hollow shell within the cooling zone and rebounds therefrom and attempts to fly out the zone that is rearward of the cooling zone, by means of the rearward damming fluid that the rearward damming right member ejects in the vicinity of the delivery side of the cooling zone. Therefore, the rearward damming fluid ejected from the rearward damming upper member, the rearward damming fluid ejected from the rearward damming left member, and the rearward damming fluid ejected from the rearward damming right member act as dams (protective walls). Thus, contact of the cooling fluid with the outer surface portion of the hollow shell in the zone that is rearward of the cooling zone can be suppressed, and temperature variations in the axial direction of the hollow shell can be reduced. Note that, the cooling fluid ejected toward the lower part of the outer surface of the hollow shell inside the cooling zone from the outer surface cooling mechanism easily drops down naturally to below the hollow shell under the force of gravity after contacting the lower part of the outer surface of the hollow shell. Therefore, the piercing machine according to the configuration of (24) need not include a rearward damming lower member.

Note that the phrase "vicinity of the delivery side of the cooling zone" means the vicinity of the rear end of the cooling zone. Although the range of the vicinity of the delivery side of the cooling zone is not particularly limited, for example, the phrase means a range within 1000 mm before and after the delivery side (rear end) of the cooling zone, and preferably means a range within 500 mm before and after the delivery side (rear end) of the cooling zone, and more preferably means a range within 200 mm before and after the delivery side (rear end) of the cooling zone.

A piercing machine according to a configuration of (12) is in accordance with the piercing machine described in (11), wherein:

the rearward damming upper member ejects the rearward damming fluid diagonally frontward toward the upper part of the outer surface of the hollow shell that is positioned in a vicinity of the delivery side of the cooling zone from the plurality of the rearward damming fluid upper-part ejection holes;

the rearward damming left member ejects the rearward damming fluid diagonally frontward toward the left part of the outer surface of the hollow shell that is positioned in a vicinity of the delivery side of the cooling zone from the plurality of the rearward damming fluid left-part ejection holes; and the rearward damming right member ejects the rearward damming fluid diagonally frontward toward the right part of the outer surface of the hollow shell that is positioned in a vicinity of the delivery side of the cooling zone from the plurality of the rearward damming fluid right-part ejection holes.

In the piercing machine according to the configuration of (12), the rearward damming upper member ejects the rearward damming fluid diagonally frontward toward the upper part of the outer surface of the hollow shell in the vicinity of the delivery side of the cooling zone from the rearward damming fluid upper-part ejection holes. Therefore, the rearward damming upper member forms a dam (protective wall) of rearward damming fluid that extends diagonally frontward toward the upper part of the outer surface of the hollow shell from above. Similarly, the rearward damming left member ejects the rearward damming fluid diagonally frontward toward the left part of the outer surface of the hollow shell in the vicinity of the delivery side of the cooling zone from the rearward damming fluid left-part ejection holes. Therefore, the rearward damming left member forms a dam (protective wall) of rearward damming fluid that extends diagonally frontward toward the left part of the outer surface of the hollow shell from the left direction. Similarly, the rearward damming right member ejects the rearward &naming fluid diagonally frontward toward the right part of the outer surface of the hollow shell in the vicinity of the delivery side of the cooling zone from the rearward damming fluid right-part ejection holes. Therefore, the rearward damming right member forms a dam (Protective wall) of rearward damming fluid that extends diagonally frontward toward the right part of the outer surface of the hollow shell from the right direction. These dams of rearward damming fluid dam the cooling fluid that contacts an outer surface portion of the hollow shell within the cooling zone and rebounds therefrom and attempts to fly out to the zone that is rearward of the cooling zone. In addition, after the rearward damming fluid constituting the dams contacts the outer surface portion of the hollow shell in the vicinity of the delivery side of the cooling zone, the rearward damming fluid easily flows into the cooling zone. Therefore, the occurrence of a situation in which the rearward damming fluid constituting the dams cools the outer surface portion of the hollow shell at a position that is rearward of the cooling zone can be suppressed.

A piercing machine according to a configuration of (13) is in accordance with the piercing machine described in (11) or (12), wherein:

the rearward damming mechanism further includes:

a rearward damming lower member including a plurality of rearward damming fluid lower-part ejection holes that is disposed below the mandrel bar as seen from the advancing direction of the hollow shell, and that ejects the rearward damming fluid toward the lower part of the outer surface of the hollow shell that is positioned in a vicinity of the delivery side of the cooling zone and dams the cooling fluid from flowing to the lower part of the outer surface of the hollow shell after the hollow shell leaves from the cooling zone.

In the piercing machine according to the configuration of (13), together with the rearward damming upper member, the rearward damming left member and the rearward damming right member, the rearward damming lower member ejects the rearward damming fluid in the vicinity of the delivery side of the cooling zone and dams the cooling fluid that contacts the lower part of the outer surface of the hollow shell within the cooling zone and rebounds therefrom and attempts to fly out to the zone that is rearward of the cooling zone. Therefore, contact of the cooling fluid with the outer surface portion of the hollow shell at a position that is rearward of the cooling zone can be suppressed, and temperature variations in the axial direction of the hollow shell can be further reduced.

Note that, the rearward damming upper member, the rearward damming lower member, the rearward damming left member and the rearward damming right member may each be a separate and independent member or may be integrally connected to each other. For example, as seen from the advancing direction of the hollow shell, a left edge of the rearward damming upper member and an upper edge of the rearward damming left member may be connected, and a right edge of the rearward damming upper member and an upper edge of the rearward damming right member may be connected. Further, as seen from the advancing direction of the hollow shell, a left edge of the rearward damming lower member and a lower edge of the rearward damming left member may be connected, and a right edge of the rearward damming lower member and the lower edge of the rearward damming right member may be connected. Furthermore, the rearward damming upper member may include a plurality of members that are separate and independent, the rearward damming lower member may include a plurality of members that are separate and independent, the rearward damming left member may include a plurality of members that are separate and independent, and the rearward damming right member may include a plurality of members that are separate and independent.

A piercing machine according to a configuration of (14) is in accordance with the piercing machine according to the configuration of (13), wherein:

the rearward damming lower member ejects the rearward damming fluid diagonally frontward toward the lower part of the outer surface of the hollow shell that is positioned in a vicinity of the delivery side of the cooling zone from the plurality of the rearward damming fluid lower-part ejection holes.

In the piercing machine according to the configuration of (14), together with the rearward damming upper member, the rearward damming left member and the rearward damming right member, the rearward damming lower member ejects the rearward damming fluid diagonally frontward toward the lower part of the outer surface of the hollow shell in the vicinity of the delivery side of the cooling zone from the rearward damming fluid lower-part ejection holes. Therefore, the rearward damming lower member forms a dam (protective wall) of rearward damming fluid that extends diagonally frontward toward the lower part of the outer surface of the hollow shell from below. These dams dam the cooling fluid that contacts the outer surface portion of the hollow shell within the cooling zone and rebounds therefrom and attempts to fly out to the zone that is rearward of the cooling zone. In addition, after the rearward damming fluid constituting the dams contacts the outer surface portion of the hollow shell in the vicinity of the delivery side of the cooling zone, the rearward damming fluid easily flows into the cooling zone. Therefore, the occurrence of a situation in which the rearward damming fluid constituting the dams cools the outer surface portion of the hollow Shell at a position that is rearward of the cooling zone can be suppressed.

A piercing machine according to a configuration of (15) is in accordance with the piercing machine according to the configuration of any one of (11) to (14), wherein:

the rearward damming fluid is a gas and/or a liquid.

In the piercing machine according to the configuration of (15), as the rearward damming fluid, a gas may be used, a liquid may be used, or both a gas and a liquid may be used. Here, the gas is, for example, air or an inert gas. The inert gas is, for example, argon gas or nitrogen gas. In the case of utilizing a gas as the rearward damming fluid, only air may be utilized, or only an inert gas may be utilized, or both air and an inert gas may be utilized. Further, as the inert gas, only one kind of inert gas (for example, argon gas only, or nitrogen gas only) may be utilized, or a plurality of inert gases may be mixed and utilized. In the case of utilizing a liquid as the rearward damming fluid, the liquid is, for example, water or oil and preferably is water.

A method for producing a seamless metal pipe according to a configuration of (16) is a method for producing a seamless metal pipe using the piercing machine according to the configuration of any one of (1) to (15), comprising:

a rolling process of subjecting the material to piercing-rolling or elongation rolling using the piercing machine to form a hollow shell; and a cooling process of, during the piercing-rolling or the elongation rolling, with respect to an outer surface of the hollow shell advancing through a cooling zone which has a specific length in an axial direction of the mandrel bar and is located rearward of the plug, as seen from an advancing direction of the hollow shell, ejecting a cooling fluid toward an upper part of the outer surface, a lower part of the outer surface, a left part of the outer surface and a right part of the outer surface to cool the hollow shell inside the cooling zone.

In the method fix producing a seamless metal pipe according to the configuration of (16), using the aforementioned piercing machine, at a position that is rearward of the plug, the upper part of the outer surface, the lower part of the outer surface, the left part of the outer surface and the right part of the outer surface of the hollow shell subjected to piercing-rolling or elongation rolling are cooled within the cooling zone of the specific length. In this case, after a cooling fluid used for cooling is ejected toward the upper part of the outer surface, the lower part of the outer surface, the left part of the outer surface and the right part of the outer surface of the hollow shell inside the cooling zone to cool the hollow shell, the cooling fluid flows down to below the hollow shell and does not stay on the hollow shell. Therefore, the hollow shell is cooled by the cooling fluid inside the cooling zone, and it is difficult for the hollow shell to be subjected to cooling by the cooling fluid in a zone other than the cooling zone. Consequently, the time periods of cooling by the cooling fluid at respective locations in the axial direction of the hollow shell are uniform to a certain extent. Thus, the occurrence of a situation in which a temperature difference between the fore end portion and the rear end portion of the hollow shell is large due to the cooling fluid accumulating at the inner surface of the hollow shell, which occurs when using the conventional technology, can be suppressed, and a temperature variation in the axial direction of the hollow shell can be reduced.

Hereunder, the piercing machine as well as a method for producing a seamless metal pipe using the piercing machine according to the present embodiment are described in detail with reference to the accompanying drawings. The same or equivalent portions in the drawings are denoted by the same reference characters, and a description of such portions is not repeated.

In the following description, for the purpose of explanation, multiple specific details are set forth in order to provide an understanding of the piercing machine according to the present embodiment. It will be evident, however, to one skilled in the art that the piercing machine according to the present embodiment can be realized without these specific details. The present disclosure is to be considered as an exemplification, and is not intended to limit the piercing machine according to the present embodiment to the specific embodiments illustrated by the drawings or description below.

First Embodiment

[Overall Configuration of Piercing Machine]

FIG. 1 is a side view of a piercing machine according to a first embodiment. As mentioned above, in the present description the term "piercing machine" means a rolling mill that includes a plug and a plurality of skewed rolls. The piercing machine is, for example, a piercing mill that subjects a round billet to piercing-rolling, or is an elongator that subjects a hollow shell to elongation rolling. In the present description, in a case where the piercing machine is a piercing mill, the material is a round billet. In a case where the piercing machine is an elongator, the material is a hollow shell.

In the present description, a material advances along a pass line from the frontward side to the rearward side of the piercing machine. Therefore, with respect to the piercing Machine, the entrance side of the piercing machine corresponds to "frontward", and the delivery side of the piercing machine corresponds to "rearward".

Referring to FIG. 1, a piercing machine 10 includes a plurality of skewed rolls 1, a plug 2 and a mandrel bar 3. In the present description, as illustrated in FIG. 1, the entrance side of the piercing machine 10 is defined as "frontward (F in FIG. 1), and the delivery side of the piercing machine 10 is defined as "rearward (B in FIG. 1)".

Figure 2:
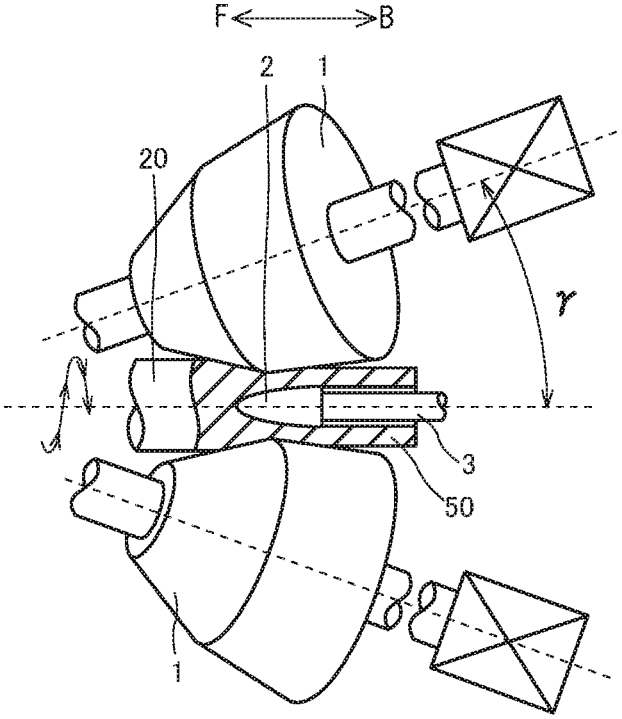
FIG. 2 is an enlarged view of a portion in the vicinity of skewed rolls in FIG. 1.

The plurality of skewed roils 1 are disposed around a pass line PL. In FIG. 1, the pass line PL is disposed between one pair of the skewed rolls 1. Here, the term "pass line PL" means an imaginary line segment along which the central axis of a material (a round billet in a case where the piercing machine is a piercing mill, and a hollow shell in a case where the piercing machine is an elongator) 20 passes during piercing-rolling or elongation rolling. In FIG. 1, the skewed rolls 1 are cone-shaped skewed rolls. However, the skewed rolls 1 are not limited to the cone-shaped skewed rolls. The skewed rolls 1 may be barrel-type skewed rolls, or may be skewed rolls of another type. Further, although in FIG. 1 two of the skewed rolls 1 are disposed around the pass line PL, three or more of the skewed rolls 1 may be disposed around the pass line PL. Preferably, the plurality of skewed rolls 1 are disposed at regular intervals around the pass line PL, as seen from an advancing direction of the material. For example, in a case where two of the skewed rolls 1 are disposed around the pass line PL, as seen from the advancing direction of the material, the skewed rolls 1 are disposed at intervals of 180° around the pass line PL. In a case where three of the skewed rolls 1 are disposed around the pass line PL, as seen from the advancing direction of the material, the skewed rolls 1 are disposed at intervals of 120° around the pass line PL. Furthermore, referring to FIG. 2 and FIG. 3, each of the skewed rolls 1 has a toe angle $\gamma$ (see FIG. 2) and a feed angle $\beta$ (see FIG. 3) with respect to the pass line PL.

The plug 2 is disposed on the pass line PL, between the plurality of skewed rolls 1. In the present description, the phrase "the plug 2 is disposed on the pass line PL" means that, when seen from the advancing direction of the material, that is, when the piercing machine 10 is seen in the direction from the frontward F side to the rearward B side, the plug 2 overlaps with the pass line PL. More preferably, the central axis of the plug 2 coincides with the pass line PL.

The plug 2 has, for example, a bullet shape. That is, the external diameter of the front part of the plug 2 is smaller than the external diameter of the rear part of the plug 2. Here, the phrase "front part of the plug 2" means a portion that is more frontward than the center position in the longitudinal direction (axial direction) of the plug 2. The phrase "rear part of the plug 2" means a portion that is more rearward than the center position in the front-rear direction of the plug 2. The front part of the plug 2 is disposed on the frontward side (entrance side) of the piercing machine 10, and the rear part of the plug 2 is disposed on the rearward side (delivery side) of the piercing machine 10.

The mandrel bar 3 is disposed on the pass line PL on the rearward side of the piercing machine 10, and extends along the pass line PL. Here, the phrase "the mandrel bar 3 is disposed on the pass line PL" means that, when seen from the advancing direction of the material, the mandrel bar 3 overlaps with the pass line PL. More preferably, the central axis of the mandrel bar 3 coincides with the pass line PL.

The fore end of the mandrel bar 3 is connected to a central part of the rear end face of the plug 2. The connection method is not particularly limited. For example, a screw thread is formed at the central part of the rear end face of the plug 2 and at the fore end of the mandrel bar 3, and the mandrel bar 3 is connected to the plug 2 by these screw threads. The mandrel bar 3 may be connected to the central part of the rear end face of the plug 2 by a method other than a method that uses screw threads. In other words, the method for connecting the mandrel bar 3 and the plug 2 is not particularly limited.

The piercing machine 10 may further include a pusher 4. The pusher 4 is disposed at the frontward side of the piercing machine 10, and is disposed on the pass line PL. The pusher 4 contacts the end face of the material 20, and pushes the material 20 forward toward the plug 2.

The configuration of the pusher 4 is not particularly limited as long as the pusher 4 can push the material 20 forward toward the plug 2. For example, as illustrated in FIG. 1, the pusher 4 includes a cylinder body 41, a cylinder shaft 42, a connection member 43 and a rod 44. The rod 44 is connected to the cylinder shaft 42 by the connection member 43 so as to be rotatable in the circumferential direction. The connection member 43, for example, includes a bearing for making the rod 44 rotatable in the circumferential direction.

The cylinder body 41 is of a hydraulic type or an electric motor-driven type, and causes the cylinder shaft 42 to advance and retreat. The pusher 4 causes the end face of the rod 44 to butt against the end face of the material (round billet or hollow shell) 20, and causes the cylinder shaft 42 and the rod 44 to advance by means of the cylinder body 41. By this means, the pusher 4 pushes the material 20 forward toward the plug 2.

The pusher 4 pushes the material 20 forward along the pass line PL to push the material 20 between the plurality of skewed rolls 1. When the material 20 contacts the plurality of skewed rolls 1, the plurality of skewed rolls 1 press the material 20 against the plug 2 while causing the material 20 to rotate in the circumferential direction. In a case where the piercing machine 10 is a piercing mill, the plurality of skewed rolls 1 press a round billet that is the material 20 against the plug 2 while causing the round billet to rotate in the circumferential direction to thereby perform piercing-rolling to produce a hollow shell. In a case where the piercing machine 10 is an elongator, the plurality of skewed rolls 1 insert the plug 2 into the hollow shell that is the material 20 and perform elongation rolling (expansion rolling) to elongate the hollow shell. Note that the piercing machine 10 need not include the pusher 4.

Figure 3:
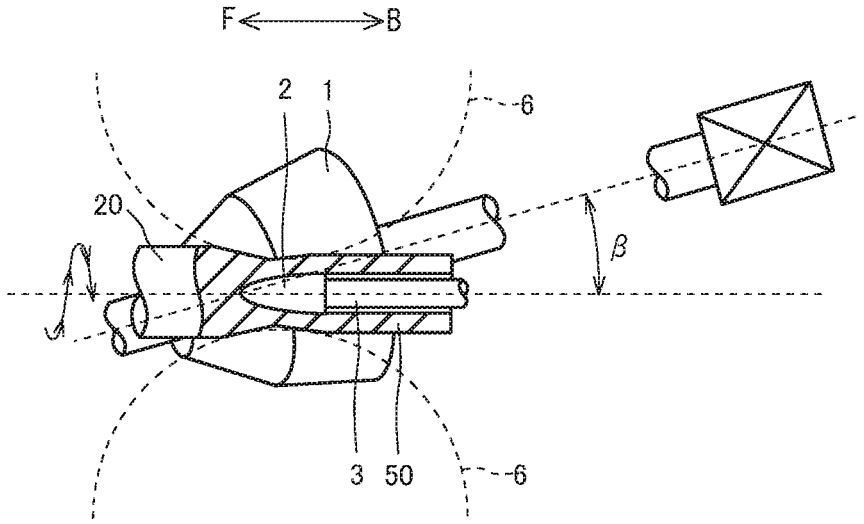
FIG. 3 is an enlarged view of the portion in the vicinity of the skewed rolls in FIG. 1 when seen from a different direction from FIG. 2.

The piercing machine 10 may further include an entry trough 5. The material (round billet or hollow shell) 20 is placed in the entry trough 5 prior to undergoing piercing-rolling. As illustrated in FIG. 3, the piercing machine 10 may also include a plurality of guide rolls 6 around the pass line PL. The plug 2 is disposed between the plurality of guide rolls 6. The guide rolls 6 are disposed between the plurality of skewed rolls 1, around the pass line PL. The guide rolls 6 are, for example, disk rolls. Note that the piercing machine 10 need not include the entry trough 5, and need not include the guide rolls 6.

[Configuration of Outer Surface Cooling Mechanism]

Figure 4:
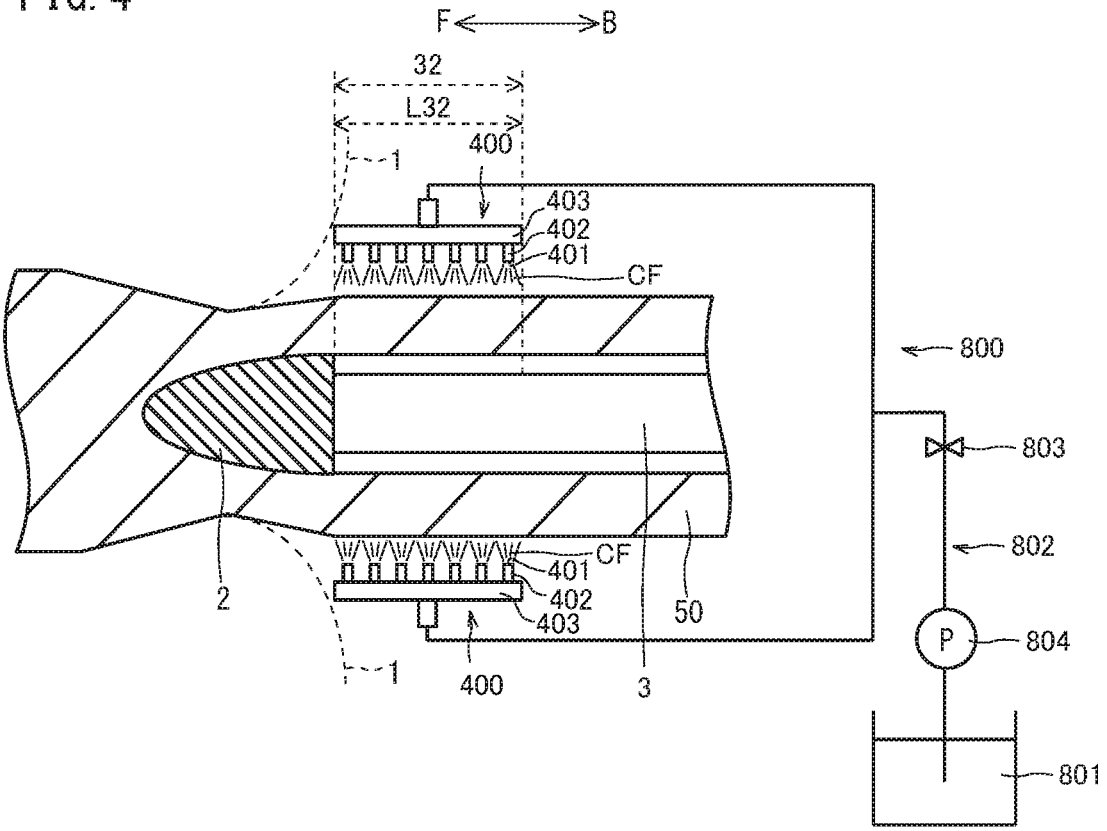
FIG. 4 is an enlarged view of a, vicinity of the delivery side of the skewed rolls of the piercing machine illustrated in FIG. 1.

Referring to FIG. 4, the piercing machine 10 further includes an outer surface cooling mechanism 400. The outer surface cooling mechanism 400 is disposed around the mandrel bar 3, at a position that is rearward of the plug 2.

Referring to FIG. 4, when the piercing machine 10 is viewed from the side, that is, when the piercing machine 10 is viewed from a direction perpendicular to the advancing direction of a hollow shell 50, a zone which has a specific length L32 in the axial direction (longitudinal direction) of the mandrel bar 3 and which is disposed rearward of the plug 2 is defined as a "cooling zone 32". During piercing-rolling or elongation rolling, the outer surface cooling mechanism 400 ejects cooling fluid toward the outer surface portion of the hollow shell 50 that is advancing within the cooling zone 32 and thereby cools the hollow shell 50 that is within the cooling zone 32.

Figure 5:
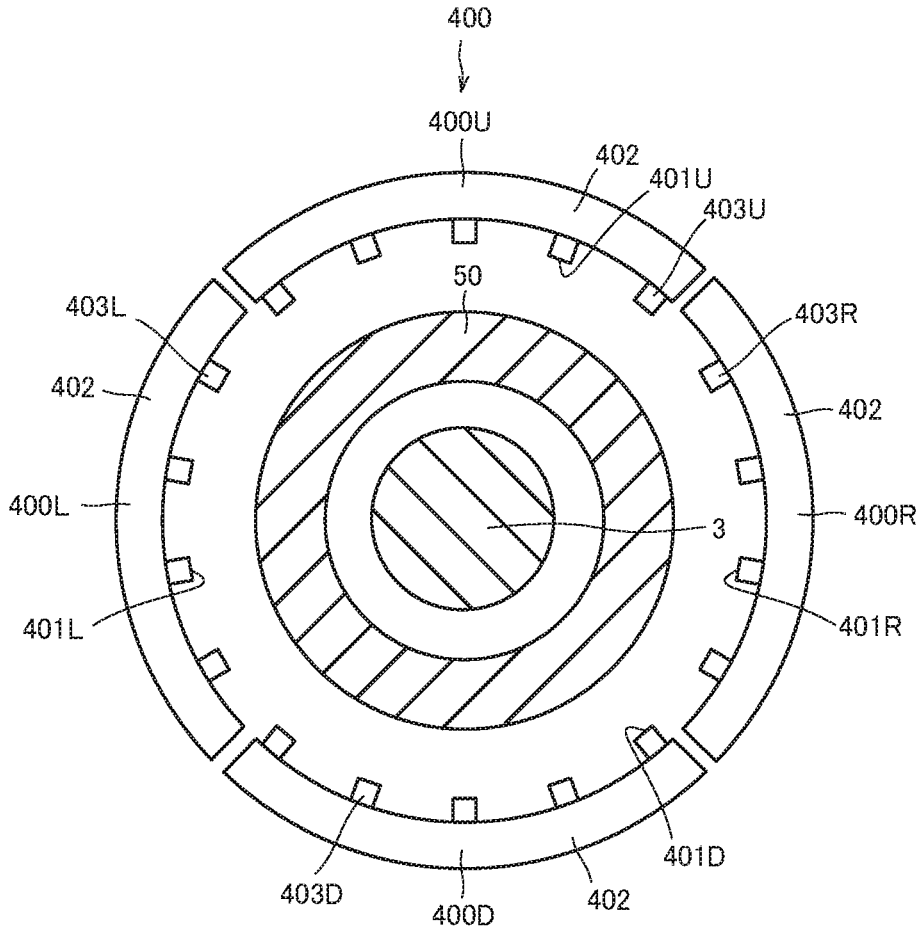
FIG. 5 is a front view of an outer surface cooling mechanism illustrated in FIG. 4, as seen from an advancing direction of a hollow shell.

FIG. 5 is a view that illustrates the outer surface cooling mechanism 400 when seen from the advancing direction of the hollow shell 50 (that is, a front view of the outer surface cooling mechanism 400). Referring to FIG. 4 and FIG. 5, the outer surface cooling mechanism 400 includes an outer surface cooling upper member 400U, an outer surface cooling lower member 400D, an outer surface cooling left member 400L and an outer surface cooling right member 400R.

[Configuration of Outer Surface Cooling Upper Member 400U]

The outer surface cooling upper member 400U is disposed above the mandrel bar 3. The outer surface cooling upper member 400U includes a main body 402 and a plurality of cooling fluid upper-part ejection holes 401U. The main body 402 is a tube-shaped or plate-shaped casing that is curved in the circumferential direction of the mandrel bar 3, and includes therein one or more cooling fluid paths which allow a cooling fluid. CF (see FIG. 4) to pass therethrough. In the present example, the plurality of cooling fluid upper-part ejection holes 401U are formed in a front end of a plurality of cooling fluid upper-part ejection nozzles 403U. However, the cooling fluid upper-part ejection holes 401U may be formed directly in the main body 402. In the present example, the plurality of cooling fluid upper-part ejection nozzles 403U that are arrayed around the mandrel bar 3 are connected to the main body 402.

The plurality of cooling fluid upper-part ejection holes 401U face the mandrel bar 3. When the hollow shell 50 subjected to piercing-rolling or elongation rolling passes through the inside of the outer surface cooling mechanism 400, the plurality of cooling fluid upper-part ejection holes 401U face the outer surface of the hollow shell 50. The plurality of cooling fluid upper-part ejection holes 401U are arrayed around the mandrel bar 3, in the circumferential direction of the mandrel bar 3. Preferably, the plurality of cooling fluid upper-part ejection holes 401U are disposed at regular intervals around the mandrel bar 3. Referring to FIG. 4, preferably the plurality of cooling fluid upper-part ejection holes 401U are also arrayed in plurality in the axial direction of the mandrel bar 3.

[Configuration of outer surface cooling lower member 400D]

Referring to FIG. 5, the outer surface cooling lower member 400D is disposed below the mandrel bar 3. The outer surface cooling lower member 400D includes a main body 402 and a plurality of cooling fluid lower-part ejection holes 401D. The main body 402 is a tube-shaped or plate-shaped casing that is curved in the circumferential direction of the mandrel bar 3, and includes therein one or more cooling fluid paths which allow the cooling fluid CF to pass therethrough. In the present example, the plurality of cooling fluid lower-part ejection holes 401D are formed in a front end of a plurality of cooling fluid lower-part ejection nozzles 403D. However, the cooling fluid lower-part ejection holes 401D may be formed directly in the main body 402. In the present example, the plurality of cooling fluid lower-part ejection nozzles 403D that are arrayed around the mandrel bar 3 are connected to the main body 402.

The plurality of cooling fluid lower-part ejection holes 401D face the mandrel bar 3. When the hollow shell 50 subjected to piercing-rolling or elongation rolling passes through the inside of the outer surface cooling mechanism 400, the plurality of cooling fluid lower-part ejection holes 401D face the outer surface of the hollow shell 50. The plurality of cooling fluid lower-part ejection holes 401D are arrayed around the mandrel bar 3, in the circumferential direction of the mandrel bar 3. Preferably, the plurality of cooling fluid lower-part ejection holes 401D are disposed at regular intervals around the mandrel bar 3. Referring to FIG. 4, preferably the plurality of cooling fluid lower-part ejection holes 401D are also arrayed in plurality in the axial direction of the mandrel bar 3.

[Configuration of Outer Surface Cooling Left Member 400L]

Referring to FIG. 5, the outer surface cooling left member 400L is disposed leftward of the mandrel bar 3. The outer surface cooling left member 4001 includes a main body 402 and a plurality of cooling fluid left-part ejection holes 401L. The main body 402 is a tube-shaped or plate-shaped casing that is curved in the circumferential direction of the mandrel bar 3, and includes therein one or more cooling fluid paths which allow the cooling fluid CF to pass therethrough. In the present example, a plurality of cooling fluid left-part ejection nozzles 403L that are arrayed around the mandrel bar 3 are connected to the main body 402, and the plurality of cooling fluid left-part ejection holes 401L are formed in a front end of the plurality of cooling fluid left-part ejection nozzles 403L. However, the cooling fluid left-part ejection holes 401L may be formed directly in the main body 402.

The plurality of cooling fluid left-part ejection holes 401L face the mandrel bar 3. When the hollow shell 50 subjected to piercing-rolling or elongation rolling passes through the inside of the outer surface cooling mechanism 400, the plurality of cooling fluid left-part ejection holes 401L face the outer surface of the hollow shell 50. The plurality of cooling fluid left-part ejection holes 401L are arrayed around the mandrel bar 3, in the circumferential direction of the mandrel bar 3. Preferably, the plurality of cooling fluid left-part ejection holes 401L are disposed at regular intervals around the mandrel bar 3. Preferably, the plurality of cooling fluid left-part ejection holes 401L are also arrayed in plurality in the axial direction of the mandrel bar 3.

[Configuration of Outer Surface Cooling Right Member 400R]

Referring to FIG. 5, the outer surface cooling right member 400R is disposed rightward of the mandrel bar 3. The outer surface cooling right member 400R includes a main body 402 and a plurality of cooling fluid right-part ejection holes 401R. The main body 402 is a tube-Shaped or plate-shaped casing that is curved in the circumferential direction of the mandrel bar 3, and includes therein one or more cooling fluid paths which allow the cooling, fluid CF to pass therethrough. In the present example, a plurality of cooling fluid right-part ejection nozzles 403R that are arrayed around the mandrel bar 3 are connected to the main body 402, and the plurality of cooling fluid right-part ejection holes 401R are formed in a front end of the plurality of cooling fluid right-part ejection nozzles 403R. However, the cooling fluid right-part ejection holes 401R may be formed directly in the main body 402.

The plurality of cooling fluid right-part ejection holes 401R face the mandrel bar 3. When the hollow shell 50 subjected to piercing-rolling or elongation rolling passes through the inside of the outer surface cooling mechanism 400, the plurality of cooling fluid right-part ejection holes 401R face the outer surface of the hollow shell 50. The plurality of cooling fluid right-part ejection holes 401R are arrayed around the mandrel bar 3, in the circumferential direction of the mandrel bar 3. Preferably, the plurality of cooling fluid right-part ejection holes 401R are disposed at regular intervals around the mandrel bar 3. Preferably, the plurality of cooling fluid right-part ejection holes 401R are also arrayed in plurality in the axial direction of the mandrel bar 3.

Figure 6:
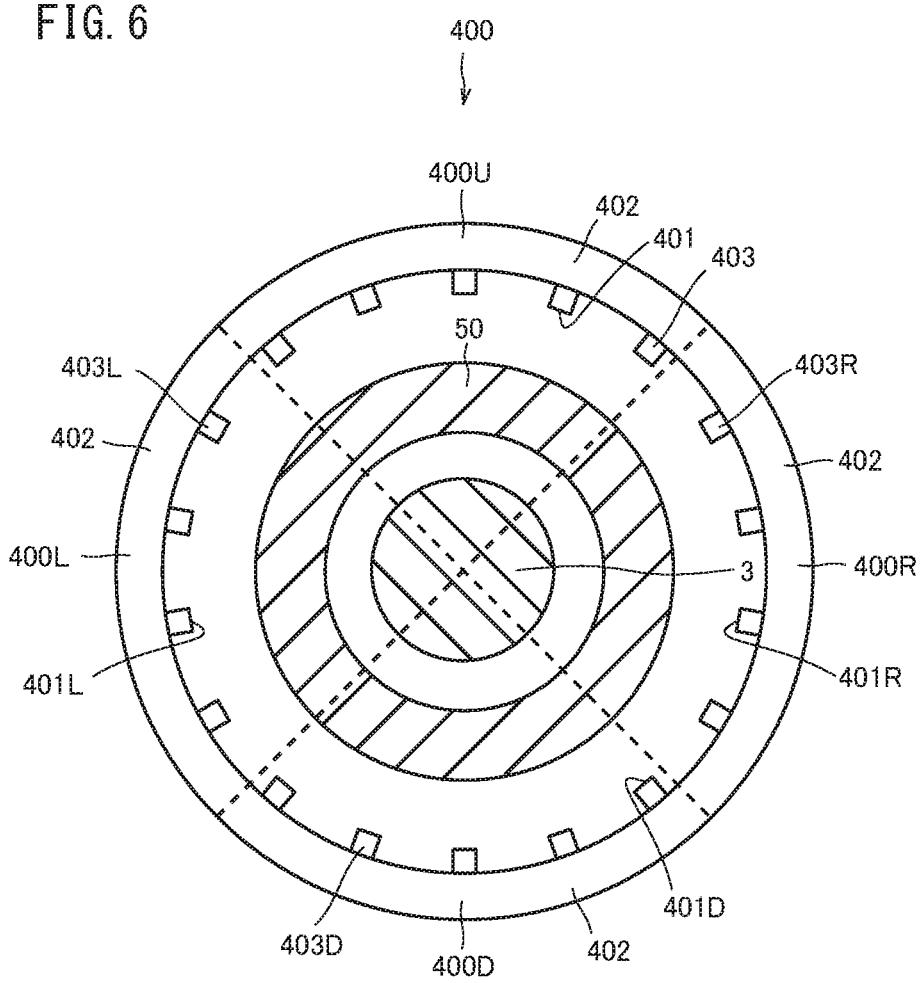
FIG. 6 is a front view of an outer surface cooling mechanism of a different form from the outer surface cooling mechanism illustrated in FIG. 5.

Note that, in FIG. 5 the outer surface cooling upper member 400U, the outer surface cooling lower member 400D, the outer surface cooling left member 400L and the outer surface cooling right member 400R are separate members that are independent from each other. However, as illustrated in FIG. 6, the outer surface cooling upper member 400U, the outer surface cooling lower member 400D, the outer surface cooling left member 400L and the outer surface cooling right member 400R may be connected.

Figure 7:
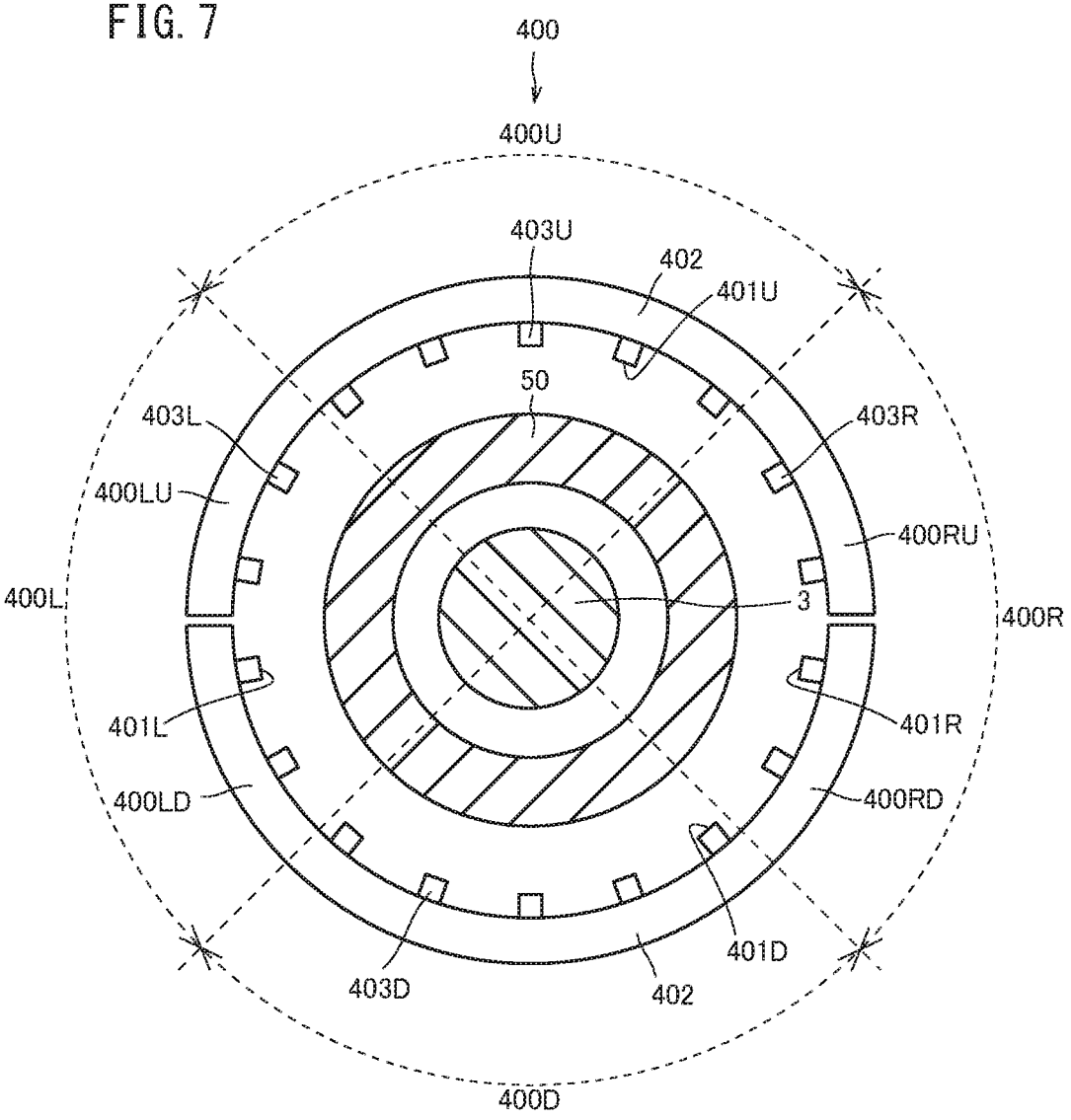
FIG. 7 is a front view of an outer surface cooling mechanism of a different form from the outer surface cooling mechanisms illustrated in FIG. 5 and FIG. 6.

Further, any of the outer surface cooling upper member 400U, the outer surface cooling lower member 400D, the outer surface cooling left member 4001 and the outer surface cooling right member 400R may be constituted by a plurality of members, and parts of adjacent outer surface cooling members may be connected. In FIG. 7, the outer surface cooling left member 400L is constituted by two members (400LU, 400LD). Further, an upper member 400LU of the outer surface cooling left member 400L is connected to the outer surface cooling upper member 400U, and a lower member 400LD of the outer surface cooling left member 400L is connected to the outer surface cooling lower member 400D. Furthermore, the outer surface cooling right member 400R is constituted by two members (400RU, 400RD). An upper member 400RU of the outer surface cooling right member 400R is connected to the outer surface cooling upper member 400U, and a lower member 400RD of the outer surface cooling right member 400R is connected to the outer surface cooling lower member 400D.

In short, each of the outer surface cooling members (the outer surface cooling upper member 400U, the outer surface cooling lower member 400D, the outer surface cooling left member 400L and the outer surface cooling right member 400R) may include a plurality of members, and a part or all of each of the outer surface cooling members may be formed integrally with another outer surface cooling member. As long as the outer surface cooling upper member 400U ejects the cooling fluid CF toward the upper part of the outer surface of the hollow shell 50, the outer surface cooling lower member 400D ejects the cooling fluid CF toward the lower part of the outer surface of the hollow shell 50, the outer surface cooling left member 400L ejects the cooling fluid CF toward the left part of the outer surface of the hollow shell 50, and the outer surface cooling right member 400R ejects the cooling fluid CF toward the right part of the outer surface of the hollow shell 50, the configuration of each of the outer surface cooling members (the outer surface cooling upper member 400U, the outer surface cooling lower member 400D, the outer surface cooling left member 400L and the outer surface cooling right member 400R) is not particularly limited.

[Operations of Outer Surface Cooling Mechanism 400]

Of the entire hollow shell 50 subjected to piercing-rolling or elongation rolling by the piercing machine 10 and passed through the skewed rolls 1, the outer surface cooling mechanism 400 having the configuration described above ejects the cooling fluid CF toward the upper part, the lower part, the left part and the right part of the outer surface of the hollow shell 50 that is passing through the cooling zone 32 and thereby cools the hollow shell 50 within the cooling zone 32 of the specific length L32. More specifically, when seen from the advancing direction of the hollow shell 50, the outer surface cooling upper member 400U ejects the cooling fluid CF toward the upper part of the outer surface of the hollow shell 50 within the cooling zone 32, the outer surface cooling lower member 400D ejects the cooling fluid CF toward the lower part of the outer surface of the hollow shell 50 within the cooling zone 32, the outer surface cooling left member 400L ejects the cooling fluid CF toward the left part of the outer surface of the hollow shell 50 within the cooling zone 32, and the outer surface cooling right member 400R ejects the cooling fluid CF toward the right part of the outer surface of the hollow shell 50 within the cooling zone 32, to thereby cool the entire outer surface (upper part, lower part, left part and right part of the outer surface) of the hollow shell 50 within the cooling zone 32. By this means, the outer surface cooling mechanism 400 suppresses a temperature difference between the fore end portion and rear end portion of the hollow shell 50 from becoming large, and suppresses the occurrence of temperature variations in the axial direction of the hollow shell 50. Hereunder, the operations of the outer surface cooling mechanism 400 when the piercing machine 10 performs piercing-rolling or elongation rolling are described.

The piercing machine 10 subjects the material 20 to piercing-rolling or elongation rolling to produce the hollow shell 50. In a case where the piercing machine 10 is a piercing mill, the piercing machine 10 subjects a round billet that is the material 20 to piercing-rolling to form the hollow shell 50. In a case where the piercing machine 10 is an elongator, the piercing machine 10 subjects a hollow shell that is the material 20 to elongation rolling to form the hollow shell 50.

Referring to FIG. 4, when the piercing machine 10 performs piercing-rolling or elongation rolling, the outer surface cooling mechanism 400 receives a supply of the cooling fluid CF from a fluid supply source 800. Here, as described above, the cooling fluid CF is a gas and/or a liquid. The cooling fluid CF may be a gas only, or may be a liquid only. The cooling fluid CF may be a mixed fluid of a gas and a liquid.

The fluid supply source 800 includes a storage tank 801 for storing the cooling fluid CF, and a supply mechanism 802 that supplies the cooling fluid CF. In a case where the cooling fluid CF is a gas, the supply mechanism 802, for example, includes a valve 803 for starting and stopping the supply of the cooling fluid CF, and a fluid driving source (gas pressure control unit) 804 for supplying, the fluid (gas). In a case where the cooling fluid CF is a liquid, the supply mechanism 802, for example, includes a valve 803 for starting and stopping the supply of the cooling fluid CF, and a fluid driving source (pump) 804 for supplying the fluid (liquid). In a case where the cooling fluid CF is a gas and a liquid, the supply mechanism 802 includes a mechanism for supplying gas and a mechanism for supplying liquid. The fluid supply source 800 is not limited to the configuration described above. The configuration of the fluid supply source 800 is not limited as long as the fluid supply source 800 is capable of supplying cooling fluid to the outer surface cooling mechanism 400, and the configuration of the fluid supply source 800 may be a well-known configuration.

The cooling fluid CF that is supplied to the outer surface cooling mechanism 400 from the fluid supply source 800 passes through the cooling fluid path inside the main body 402 of the outer surface cooling upper member 400U of the outer surface cooling mechanism 400, and reaches each cooling fluid upper-part ejection hole 401U. The cooling fluid CF also passes through the cooling fluid path inside the main body 402 of the outer surface cooling lower member 400D, and reaches each cooling fluid lower-part ejection hole 401D. Further, the cooling fluid CF passes through the cooling fluid path inside the main body 402 of the outer surface cooling left member 400L, and reaches each cooling fluid left-part ejection hole 401L. The cooling fluid CF also passes through the cooling fluid path inside the main body 402 of outer surface cooling right member 400R, and reaches each cooling fluid right-part ejection hole 401R. The outer surface cooling mechanism 400 then ejects the cooling fluid CF toward the upper part, the lower part, the left part and the right part of the outer surface of the hollow shell 50 subjected to piercing-rolling or elongation rolling and passed by the rear end of the plug 2 and entered the cooling zone 32, and thereby cools the hollow shell 50.

At this time, as illustrated in FIG. 4, within the area of the cooling zone 32 that has a specific length in the axial direction of the mandrel bar 3, the outer surface cooling mechanism 400 ejects the cooling fluid CF toward the upper part, the lower part, the left part and the right part of the outer surface of the hollow shell 50 to thereby cool the hollow shell 50. The term "cooling zone 32" means the area within which the cooling fluid CF is ejected by the outer surface cooling mechanism 400. The cooling zone 32 is an area that surrounds the entire circumference of the mandrel bar 3 when seen in the advancing direction of the hollow shell 50 (when seen from the frontward side of the piercing machine 10 toward the rearward side thereof). That is, the cooling zone 32 is a circular cylindrical area that extends in the axial direction of the mandrel bar 3.

Changing of the area of the cooling zone 32 is not scheduled while one material 20 is being subjected to piercing-rolling or elongation rolling. That is, the cooling zone 32 is substantially fixed during piercing-rolling or elongation rolling of one material 20. In a case where the outer surface cooling mechanism 400 includes a plurality of cooling fluid ejection holes 401 (cooling fluid upper-part ejection holes 401U, cooling fluid lower-part ejection holes 401D, cooling fluid left-part ejection holes 401L and cooling fluid right-part ejection holes 401R), the range of the cooling zone 32 is substantially determined by the positions at which the plurality of cooling fluid ejection holes 401 (cooling fluid upper-part ejection holes 401U, cooling fluid lower-part ejection holes 401D, cooling fluid left-part ejection holes 401L, and cooling fluid right-part ejection holes 401R) are disposed.

As illustrated in FIG. 4, the cooling zone 32 is disposed rearward of the plug 2. During piercing-rolling or elongation rolling, plastic deformation of the material 20 is continued until the rear end of the plug 2. Accordingly, the cooling zone 32 is set so that, after plastic deformation of the material 20 by piercing-rolling or elongation rolling is completed (that is, after formation of the hollow shell 50 is completed), the outer surface cooling mechanism 400 cools the entire outer surface (the upper part, the lower part, the left part and the right part of the outer surface) of the hollow shell 50. Preferably, the fore end of the cooing zone 32 is disposed immediately after the rear end of the plug 2. In a direction of the pass line PL, a distance between the rear end of the plug 2 and the fore end of the cooling zone 32 is, for example, 1000 mm or less, more preferably is 500 mm or less, further preferably is 200 mm or less, and further preferably is 50 mm or less.

Although the specific length L32 of the cooling zone 32 is not particularly limited, for example, the specific length L32 is within the range of 500 to 6000 mm.

As described above, in the present embodiment, in the piercing machine 10, using the outer surface cooling mechanism 400 that is disposed around the mandrel bar 3 rearward of the plug 2, inside the cooling zone 32 having the specific length. L32 that is disposed rearward of the plug 2, when seen in the advancing direction of the hollow shell 50, the outer surface cooling mechanism 400 ejects the Cooling fluid CF toward the upper part, the lower part, the left part and the right port of the outer surface of the hollow shell 50 to cool the hollow shell 50 within the cooling zone 32. At such time, the outer surface portion (upper part, lower part, left part and right part) of the hollow shell 50 that is advancing through the cooling zone 32 contacts the cooling fluid CF, and the hollow shell 50 is thereby cooled. On the other hand, outside the area of the cooling zone 32 (frontward of the cooling zone 32 and rearward of the cooling zone 32), it is difficult for the outer surface portion of the hollow shell 50 to contact the cooling fluid CF. The reason is that after contacting the outer surface portion of the hollow shell 50 in the cooling zone 32, most of the cooling fluid CF ejected from the outer surface cooling mechanism 400 runs down naturally to below the hollow shell 50 under the force of gravity. That is, in comparison to a case of ejecting the cooling fluid at the inner surface of the hollow shell 50, it is difficult for the cooling fluid ejected toward the outer surface of the hollow shell 50 from the outer surface cooling mechanism 400 to accumulate on the hollow shell 50. Therefore, temperature differences in the axial direction of the hollow shell 50 after cooling can be suppressed, and in particular, a temperature difference between the fore end portion and the rear end portion of the hollow shell 50 can be reduced.

[Method for Producing Seamless Metal Pipe]

A method for producing a seamless metal pipe using the piercing machine 10 described above is as follows. The method for producing a seamless metal pipe of the present embodiment includes a rolling process in which piercing-rolling or elongation rolling is performed to form a hollow shell 50, and a cooling process of cooling the outer surface of the hollow shell 50 obtained by performing the piercing-rolling or elongation rolling. Note that, the seamless metal pipe is, for example, a seamless steel pipe.

[Rolling Process]

In the rolling process, piercing-rolling or elongation rolling is performed on a heated material 20 using the piercing machine 10. The material 20 is heated in a well-known heating furnace. The heating temperature is not particularly limited.

In a case where the piercing machine 10 is a piercing drill, the material 20 is a round billet. In such a case, the heated material 20 (round billet) is subjected to piercing-rolling using the piercing machine 10 (piercing mill) to form the hollow shell 50. On the other hand, in a case where the piercing machine 10 is an elongator, the material 20 is a hollow shell. In such a case, the heated material 20 (hollow Shell) is subjected to elongation rolling using the piercing machine 10 (elongator) to form the hollow shell 50.

[Cooling Process]

In the cooling process, during the rolling process (piercing-rolling or elongation rolling), with respect to the outer surface of the hollow shell 50 advancing through the cooling zone 32 that is disposed rearward of the plug 2 and has the specific length L32 in the axial direction of the mandrel bar 3, as seen in the advancing direction of the hollow shell 50, the cooling fluid CF is ejected toward the upper part of the outer surface, the lower part of the outer surface, the left part of the outer surface and the right part of the outer surface of the hollow shell to thereby cool the hollow shell 50 inside the cooling zone 32. Thus, as described above, temperature variations in the axial direction of the hollow shell 50 after cooling can be reduced, and a temperature difference between the fore end portion and the rear end portion of the hollow shell 50 can be reduced.

Note that, although in the configurations illustrated in FIG. 4 to FIG. 7, the outer surface cooling mechanism 400 cools the outer surface portion of the hollow shell 50 in the cooling zone 32 by ejecting the cooling fluid CF from the plurality of cooling fluid ejection holes 401 (cooling fluid upper-part ejection holes 401U, cooling thud lower-part ejection holes 401D, cooling fluid left-part ejection holes 401L and cooling fluid right-part ejection holes 401R), the shape of the cooling fluid ejection holes 401 (cooling fluid upper-part ejection holes 401U, cooling fluid lower-part ejection holes 401D, cooling fluid left-part ejection holes 401L and cooling fluid right-part ejection holes 401R) is not particularly limited. The cooling fluid ejection holes 401 (cooling fluid upper-part ejection holes 401U, cooling fluid lower-part ejection holes 401D, cooling fluid left-part ejection holes 401L and cooling fluid right-part ejection holes 401R) may be a circular shape, may be an oval shape or may be a rectangular shape. For example, the cooling fluid ejection holes 401 (cooling fluid upper-part ejection holes 401U, cooling fluid lower-part ejection holes 401D, cooling fluid left-part ejection holes 401L and cooling fluid right-part ejection holes 401R) may be an oval shape or rectangular shape that extends in the axial direction of the mandrel bar 3, or may be an oval shape or rectangular shape that extends in the circumferential direction of the mandrel bar 3. As long as the plurality of cooling fluid ejection holes 401 (cooling fluid upper-part ejection holes 401U, cooling fluid lower-part ejection holes 401D, cooling fluid left-part ejection holes 401L and cooling fluid right-part ejection holes 401R) can eject the cooling fluid CF and cool the outer surface portion of the hollow shell 50 within the area of the cooling zone 32, the shape of the plurality of cooling fluid ejection holes 401 (cooling fluid upper-part ejection holes 401U, cooling fluid lower-part ejection holes 401D, cooling fluid left-part ejection holes 401L and cooling fluid right-part ejection holes 401R) is not particularly limited.

Although in FIG. 4 the plurality of the cooling fluid ejection holes 401 (cooling fluid upper-part ejection holes 401U, cooling fluid lower-part ejection holes 401D, cooling fluid left-part ejection holes 401L and cooling fluid right-part ejection holes 401R) are arrayed in the axial direction of the mandrel bar 3, the plurality of the cooling fluid ejection holes 401 (cooling fluid upper-part ejection holes 401U, cooling fluid lower-part ejection holes 401D, cooling fluid left-part ejection holes 401L and cooling fluid right-part ejection holes 401R) need not be arrayed in the axial direction of the mandrel bar 3. Further, although in FIG. 5 to FIG. 7 the cooling fluid ejection holes 401 (cooling fluid upper-part ejection holes 401U, cooling fluid lower-part ejection holes 401D, cooling fluid left-part ejection holes 401L and cooling fluid right-part ejection holes 401R) are arrayed at regular intervals around the mandrel bar 3, arraying of the cooling fluid ejection holes 401 (cooling fluid upper-part ejection holes 401U, cooling fluid lower-part ejection holes 401D, cooling fluid left-part ejection holes 401L and cooling fluid right-part ejection holes 401R) around the mandrel bar 3 need not be in a manner in which the cooling fluid ejection holes 401 are arrayed at regular intervals.

Second Embodiment

Figure 8:
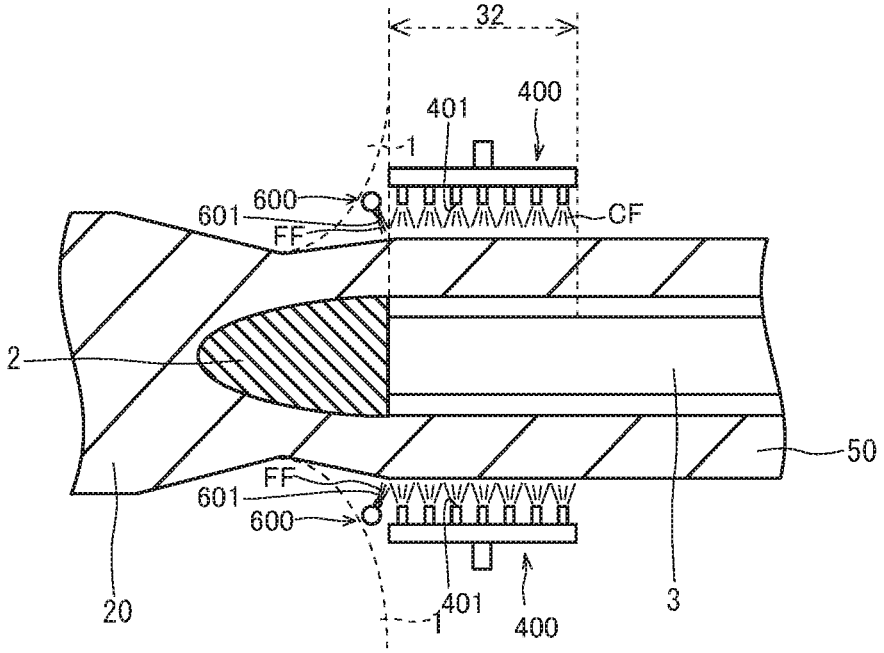
FIG. 8 is an enlarged view of the vicinity of the delivery side of skewed rolls of a piercing machine according to a second embodiment.

FIG. 8 is a view illustrating a configuration on the delivery side of the skewed rolls 1 of a piercing machine 10 according to a second embodiment. Referring to FIG. 8, in comparison to the piercing machine 10 according to the first embodiment, the piercing machine 10 according to the second embodiment newly includes a frontward damming mechanism 600. The remaining configuration of the piercing machine 10 according to the second embodiment is the same as the configuration of the piercing machine 10 according to the first embodiment.

[Frontward Damming Mechanism 600]

The frontward damming mechanism 600 is disposed around the mandrel bar 3 at a position that is rearward of the plug 2 and is frontward of the outer surface cooling mechanism 400. The frontward damming mechanism 600 is equipped with a mechanism that, when the outer surface cooling mechanism 400 is cooling the hollow shell in the cooling zone 32 by ejecting the cooling fluid CF toward the upper part of the outer surface, the lower part of the outer surface, the left part of the outer surface and the right part of the outer surface of the hollow shell 50 in the cooling zone 32, dams the cooling fluid from flowing to the upper part of the outer surface, the lower part of the outer surface, the left part of the outer surface and the right part of the outer surface of the hollow shell 50 before the aforementioned parts of the outer surface of the hollow shell 50 enter the cooling zone 32.

Figure 9:
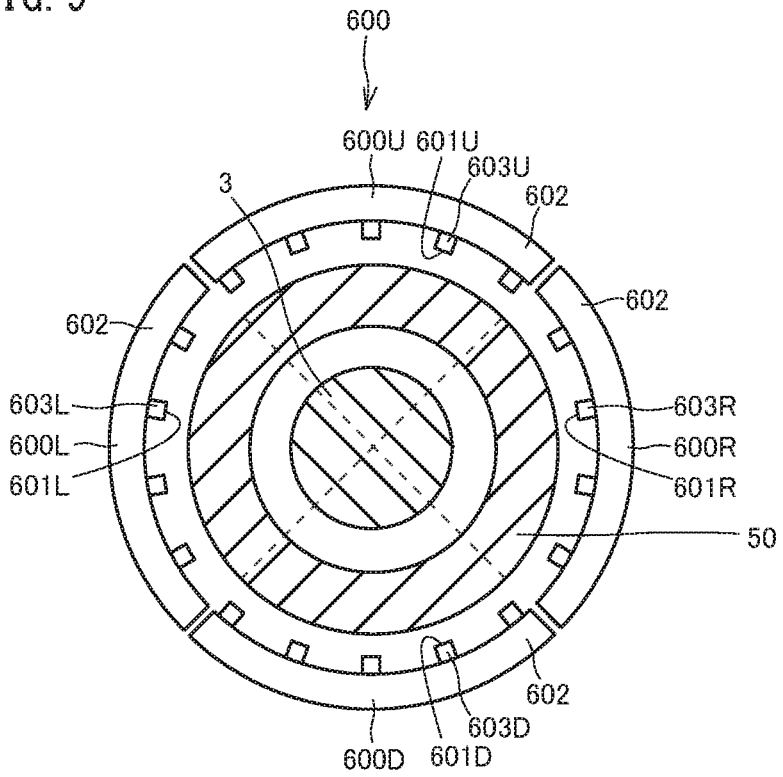
FIG. 9 is a front view of a frontward damming mechanism illustrated in FIG. 8, as seen from the advancing direction of a hollow shell.

FIG. 9 is a view illustrating the frontward damming mechanism 600 as seen in the advancing direction of the hollow shell 50 (view of the frontward damming mechanism 600 when seen from the entrance side toward the delivery side of the skewed rolls 1). Referring to FIG. 8 and FIG. 9, when seen in the advancing direction of the hollow shell 50, the frontward damming mechanism 600 is disposed around the mandrel bar 3. Further, during piercing-rolling or elongation rolling, as illustrated in FIG. 9, the frontward damming mechanism 600 is disposed around the hollow shell 50 subjected to piercing-rolling or elongation rolling.

Referring to FIG. 9, when seen in the advancing direction of the hollow shell 50, the frontward damming mechanism 600 includes a frontward damming upper member 600U, a frontward damming lower member 600D, a frontward damming left member 600L and a frontward damming right member 600R.

[Configuration of Frontward Damming Upper Member 600U]

The frontward damming upper member 600U is disposed above the mandrel bar 3. The frontward damming upper member 600U includes a main body 602 and a plurality of frontward damming fluid upper-part ejection holes 601U. The main body 602 is a tube-shaped or plate-shaped casing that is curved in the circumferential direction of the mandrel bar 3, and includes therein one or more fluid paths which allow a frontward damming fluid FF (see FIG. 8) to pass therethrough. In the present example, the plurality of frontward damming fluid upper-part ejection holes 601U are formed in a front end of a plurality of frontward damming fluid upper-part ejection nozzles 603U. However, the frontward damming fluid upper-part ejection holes 601U may be formed directly in the main body 602. In the present example, the plurality of frontward damming fluid upper-part ejection nozzles 603U that are arrayed around the mandrel bar 3 are connected to the main body 602.

When the hollow shell 50 subjected to piercing-rolling or elongation rolling passes through the inside of the outer surface cooling mechanism 400, the plurality of frontward damming fluid upper-part ejection holes 601U of the frontward damming upper member 600U face the upper part of the outer surface of the hollow shell 50 that is positioned in the vicinity of the entrance side of the cooling zone 32. When seen in the advancing direction of the hollow shell 50, the plurality of frontward damming fluid upper-part ejection holes 601U are arrayed around the mandrel bar 3, in the circumferential direction of the mandrel bar 3. Preferably, the plurality of frontward damming fluid upper-part ejection holes 601U are arrayed at regular intervals around the mandrel bar. The plurality of frontward damming fluid upper-part ejection holes 601U may also be arrayed side-by-side in the axial direction of the mandrel bar 3.

During piercing-rolling or elongation rolling, when the outer surface cooling mechanism 400 is cooling the hollow shell 50 in the cooling zone 32, the frontward damming upper member 600U ejects the frontward damming fluid FF toward an upper part of the outer surface of the hollow shell 50 that is positioned in the vicinity of the entrance side of the cooling zone 32 from the plurality of frontward damming fluid upper-part ejection holes 601U to thereby dam the cooling fluid CF from flowing to the upper part of the outer surface of the hollow shell 50 before the upper part of the outer surface of the hollow shell 50 enters the cooling zone 32.

[Configuration of Frontward Damming Lower Member GOOD]

The frontward damming lower member GOOD is disposed below the mandrel bar 3. The frontward damming lower member 600D includes a main body 602 and a plurality of frontward damming fluid lower-part ejection holes 601D. The main body 602 is a tube-shaped or plate-shaped casing that is curved in the circumferential direction of the mandrel bar 3, and includes therein one or more fluid paths which allow the frontward damming fluid FF to pass therethrough. In the present example, the plurality of frontward damming fluid lower-part ejection holes 601D are formed in a front end of a plurality of frontward damming fluid lower-part ejection nozzles 603D. However, the frontward damming fluid lower-part ejection holes 601D may be formed directly in the main body 602. In the present example, the plurality of frontward damming fluid lower-part ejection nozzles 603D that are arrayed around the mandrel bar 3 are connected to the main body 602.

When the hollow shell 50 subjected to piercing-rolling or elongation rolling passes through the inside of the outer surface cooling mechanism 400, the plurality of frontward damming fluid lower-part ejection holes 601D of the frontward damming lower member 600D face the lower part of the outer surface of the hollow shell 50 that is positioned in the vicinity of the entrance side of the cooling zone 32. When seen in the advancing direction of the hollow shell 50, the plurality of frontward damming fluid lover-part ejection holes 601D are arrayed around the mandrel bar 3, in the circumferential direction of the mandrel bar 3. Preferably, the plurality of frontward damming fluid lower-part ejection holes 601D are arrayed at regular intervals around the mandrel bar. The plurality of frontward damming fluid lower-part ejection holes 601D may also be arrayed side-by-side in the axial direction of the mandrel bar 3.

During piercing-rolling or elongation rolling, when the outer surface cooling mechanism 400 is cooling the hollow shell 50 in the cooling zone 32, the frontward damming lower member 600D ejects the frontward damming fluid FF toward a lower part of the outer surface of the hollow shell 50 that is positioned in the vicinity of the entrance side of the cooling zone 32 from the plurality of frontward damming fluid lower-part ejection holes 601D to thereby dam the cooling fluid CF from flowing to the lower part of the outer surface of the hollow shell 50 before the lower part of the outer surface of the hollow shell 50 enters the cooling zone 32.

[Configuration of Frontward Damming Left Member 600L]

The frontward damming left member 600L is disposed leftward of the mandrel bar 3 when seen in the advancing direction of the hollow shell 50. The frontward damming left member 600L includes a main body 602 and a plurality of frontward damming fluid left-part ejection holes 601L. The main body 602 is a tube-shaped or plate-shaped casing that is curved in the circumferential direction of the mandrel bar 3, and includes therein one or more fluid paths which allow the frontward damming fluid FF to pass therethrough. In the present example, the plurality of frontward damming fluid left-part ejection holes 601L are formed in a front end of a plurality of frontward damming fluid left-part ejection nozzles 603L. However, the frontward damming fluid left-part ejection holes 601L may be formed directly in the main body 602. In the present example, the plurality of frontward damming fluid left-part ejection nozzles 603L that are arrayed around the mandrel bar 3 are connected to the main body 602.

When the hollow shell 50 subjected to piercing-rolling or elongation rolling passes through the inside of the outer surface cooling mechanism 400, the plurality of frontward damming fluid left-part ejection holes 601L of the frontward damming left member 600L face the left part of the outer surface of the hollow shell 50 that is positioned in the vicinity of the entrance side of the cooling zone 32. When seen in the advancing direction of the hollow shell 50, the plurality of frontward damming fluid left-part ejection holes 601L are arrayed around the mandrel bar 3, in the circumferential direction of the mandrel bar 3. Preferably, the plurality of frontward damming fluid left-part ejection holes 601L are arrayed at regular intervals around the mandrel bar. The plurality of frontward damming fluid left-part ejection holes 601L may also be arrayed side-by-side in the axial direction of the mandrel bar 3.

During piercing-rolling or elongation rolling, when the outer surface cooling mechanism 400 is cooling the hollow shell 50 in the cooling zone 32, the frontward damming left member 600L ejects the frontward damming fluid FF toward a left part of the outer surface of the hollow shell 50 that is positioned in the vicinity of the entrance side of the cooling zone 32 from the plurality of frontward damming fluid left-part ejection holes 601L to thereby dam the cooling fluid CF from flowing to the left part of the outer surface of the hollow shell 50 before the left part of the outer surface of the hollow shell 50 enters the cooling zone 32.

[Configuration of Frontward Damming Right Member 600R]

The frontward damming right member 600R is disposed rightward of the mandrel bar 3 when seen in the advancing direction of the hollow shell 50. The frontward damming right member 600R includes a main body 602 and a plurality of frontward damming fluid right-part ejection holes 601R. The main body 602 is a tube-shaped or plate-shaped casing that is curved in the circumferential direction of the mandrel bar 3, and includes therein one or more fluid paths which allow the frontward damming fluid FF to pass therethrough. In the present example, the plurality of frontward damming fluid right-part ejection holes 601R are formed in a front end of a plurality of frontward damming fluid right-part ejection nozzles 603R. However, the frontward damming fluid right-part ejection holes 601R may be formed directly in the main body 402. In the present example, the plurality of frontward damming fluid right-part ejection nozzles 603R that are arrayed around the mandrel bar 3 are connected to the main body 602.

When the hollow shell 50 subjected to piercing-rolling or elongation rolling passes through the inside of the outer surface cooling mechanism 400, the plurality of frontward damming fluid right-part ejection holes 601R of the frontward damming right member 600R face the right part of the outer surface of the hollow shell 50 that is positioned in the vicinity of the entrance side of the cooling zone 32. When seen in the advancing direction of the hollow shell 50, the plurality of frontward damming fluid right-part ejection holes 601R are arrayed around the mandrel bar 3, in the circumferential direction of the mandrel bar 3. Preferably, the plurality of frontward damming fluid right-part ejection holes 601R are arrayed at regular intervals around the mandrel bar. The plurality of frontward damming fluid right-part ejection holes 601R may also be arrayed side-by-side in the axial direction of the mandrel bar 3.

During piercing-rolling or elongation rolling, when the outer surface cooling mechanism 400 is cooling the hollow shell 50 in the cooling zone 32, the frontward damming right member 600R ejects the frontward damming fluid FF toward a right part of the outer surface of the hollow shell 50 that is positioned in the vicinity of the entrance side of the cooling zone 32 from the plurality of frontward damming fluid right-part ejection holes 601R to thereby dam the cooling fluid CF from flowing to the right part of the outer surface of the hollow shell 50 before the right part of the outer surface of the hollow shell 50 enters the cooling zone 32.

[Operations of Frontward Damming Mechanism 600]

During piercing-rolling or elongation rolling, of the entire outer surface of the hollow shell 50 subjected to piercing-rolling or elongation rolling, the outer surface cooling mechanism 400 ejects the cooling fluid CF at the outer surface portion of the hollow shell 50 that is inside the cooling zone 32 to thereby cool the hollow shell 50. At this time, after the cooling fluid CF ejected at the outer surface portion of the hollow shell 50 inside the cooling zone 32 contacts the outer surface portion of the hollow shell 50, a situation can arise in which the cooling fluid CF flows to frontward of the outer surface portion and contacts the outer surface portion of the hollow shell 50 that is frontward of the cooling zone 32. If the frequency at which contact of the cooling fluid CF with an outer surface portion of the hollow shell 50 in a zone other than the cooling zone 32 occurs is high, variations can arise in the temperature distribution in the axial direction of the hollow shell 50.

Therefore, in the present embodiment, during piercing-rolling or elongation rolling, the frontward damming mechanism 600 suppresses the cooling fluid CF that flows over the outer surface after contacting the outer surface portion of the hollow shell 50 inside the cooling zone 32 from contacting the outer surface portion of the hollow shell 50 that is frontward of the cooling zone 32.

The frontward damming mechanism 600 is equipped with a mechanism that, when the outer surface cooling mechanism 400 is cooling the hollow shell inside the cooling zone 32 by ejecting the cooling fluid CF toward the upper part of the outer surface, the lower part of the outer surface, the left part of the outer surface and the right part of the outer surface of the hollow shell 50 inside the cooling zone 32, dams the cooling fluid from flowing to the upper part, the lower part, the left part and the right part of the outer surface of the hollow shell 50 before the aforementioned parts of the outer surface of the hollow shell 50 enter the cooling zone 32. Specifically, when seen in the advancing direction of the hollow shell 50, the frontward damming upper member 600U ejects the frontward damming fluid FF toward the upper part of the outer surface of the hollow shell 50 that is positioned in the vicinity of the entrance side of the cooling zone 32 to thereby form a dam (protective wall) composed of the frontward damming fluid FF at the upper part of the outer surface of the hollow shell 50 before the upper part of the outer surface of the hollow shell 50 enters the cooling zone 32. Similarly, the frontward damming lower member 600D ejects the frontward damming fluid FF toward the lower part of the outer surface of the hollow shell 50 that is positioned in the vicinity of the entrance side of the cooling zone 32 to thereby form a dam (protective wall) composed of the frontward damming fluid FF at the lower part of the outer surface of the hollow shell 50 before the lower part of the outer surface of the hollow shell 50 enters the cooling zone 32. Similarly, the frontward damming left member 600L ejects the frontward damming fluid FF toward the left part of the outer surface of the hollow shell 50 that is positioned in the vicinity of the entrance side of the cooling zone 32 to thereby form a dam (protective wall) composed of the frontward damming fluid FF at the left part of the outer surface of the hollow shell 50 before the left part of the outer surface of the hollow shell 50 enters the cooling zone 32. Similarly, the frontward damming right member 600R ejects the frontward damming fluid FF toward the right part of the outer surface of the hollow shell 50 that is positioned in the vicinity of the entrance side of the cooling zone 32 to thereby form a dam (protective wall) composed of the frontward damming fluid FF at the right part of the outer surface of the hollow shell 50 before the right part of the outer surface of the hollow shell 50 enters the cooling zone 32. These dams that are composed of the frontward damming fluid FF dam the cooling fluid CF that contacts the outer surface portion of the hollow shell 50 within the cooling zone 32 and rebounds therefrom and attempts to flow to the zone frontward of the cooling zone. Therefore, contact of the cooling fluid CF with the outer surface portion of the hollow shell 50 that is frontward of the cooling zone 32 can be suppressed, and temperature variations in the axial direction of the hollow shell 50 can be further reduced.

Figure 10:
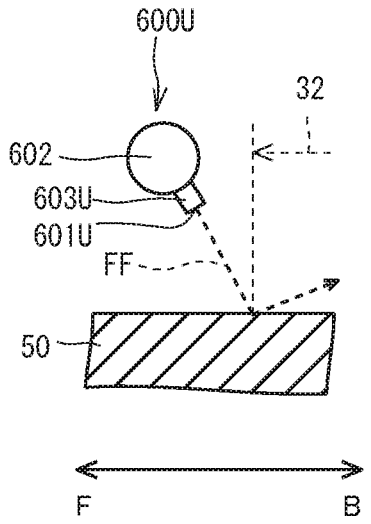
FIG. 10 is a sectional drawing of a frontward damming upper member illustrated in FIG. 9, as seen from a direction parallel to the advancing direction of the hollow shell.
Figure 11:
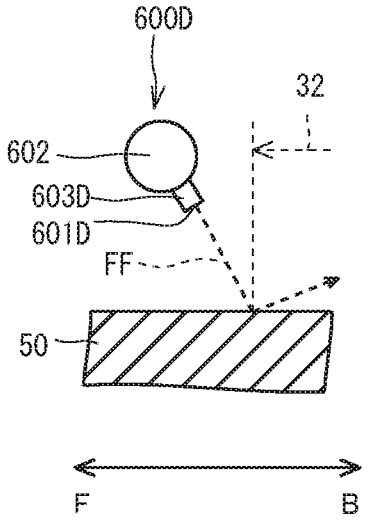
FIG. 11 is a sectional drawing of a frontward damming lower member illustrated in FIG. 9, as seen from the direction parallel to the advancing direction of the hollow shell.
Figure 12:
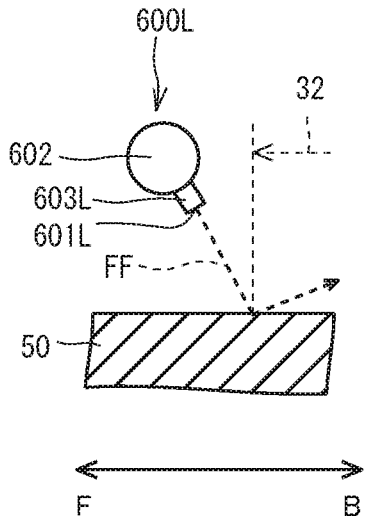
FIG. 12 is a sectional drawing of a frontward damming left member illustrated in FIG. 9, as seen from the direction parallel to the advancing direction of the hollow shell.
Figure 13:
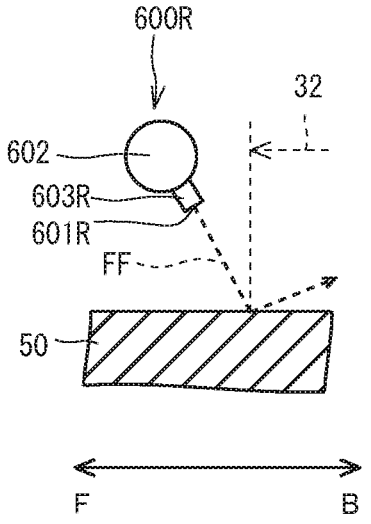
FIG. 13 is a sectional drawing of a frontward damming right member illustrated in FIG. 9, as seen from the direction parallel to the advancing direction of the hollow shell.

FIG. 10 is a sectional drawing of the frontward damming upper member 600U, when seen from a direction parallel to the advancing direction of the hollow shell 50. FIG. 11 is a sectional drawing of the frontward damming lower member 600D, when seen from a direction parallel to the advancing direction of the hollow shell 50. FIG. 12 is a sectional drawing of the frontward damming left member 600L, when seen from a direction parallel to the advancing direction of the hollow shell 50. FIG. 13 is a sectional drawing of the frontward damming right member 600R, when seen from a direction parallel to the advancing direction of the hollow shell 50.

Referring to FIG. 10, preferably the frontward damming upper member 600U ejects the frontward damming fluid FF diagonally rearward towards the upper part of the outer surface of the hollow shell 50 that is positioned in the vicinity of the entrance side of the cooling zone 32 from the frontward damming fluid upper-part ejection holes 601U. Referring to FIG. 11, preferably the frontward damming lower member 600D ejects the frontward damming fluid FF diagonally rearward towards the lower part of the outer surface of the hollow shell 50 that is positioned in the vicinity of the entrance side of the cooling zone 32 from the frontward damming fluid lower-part ejection holes 601D. Referring to FIG. 12, preferably the frontward damming left member 600L ejects the frontward damming fluid FF diagonally rearward towards the left part of the outer surface of the hollow shell 50 that is positioned in the vicinity of the entrance side of the cooling zone 32 from the frontward damming fluid left-part ejection holes 601L. Referring to FIG. 13, preferably the frontward damming right member 600R ejects the frontward damming fluid FF diagonally rearward towards the left part of the outer surface of the hollow shell 50 that is positioned in the vicinity of the entrance side of the cooling, zone 32 from the frontward damming fluid right-part ejection holes 601R.

In FIG. 10 to FIG. 13, the frontward damming upper member 600U forms a dam (protective wall) composed of the frontward damming fluid FF that extends diagonally rearward toward the upper part of the outer surface of the hollow shell 50 from above the hollow shell 50. Similarly, the frontward damming lower member 600D forms a dam (protective wall) composed of the frontward damming fluid FF that extends diagonally rearward toward the lower part of the outer surface of the hollow shell 50 from below the hollow shell 50. Similarly, the frontward damming left member 600L forms a dam (protective wall) composed of the frontward damming fluid FF that extends diagonally rearward toward the left part of the outer surface of the hollow shell 50 from leftward of the hollow shell 50. Similarly, the frontward damming right member 600R Rams a dam (protective wall) composed of the frontward damming fluid FF that extends diagonally rearward toward the right part of the outer surface of the hollow shell 50 from rightward of the hollow shell 50. These dams dam the cooling fluid CF that contacts the outer surface portion of the hollow shell 50 within the cooling zone 32 and rebounds therefrom and attempts to fly out to the zone that is frontward of the cooling zone 32. In addition, after the frontward damming fluid FF constituting the dams contacts the outer surface portion of the hollow shell 50 in the vicinity of the entrance side of the cooling zone 32, as illustrated in FIG. 10 to FIG. 13, it is easy for the frontward damming fluid FF to rebound into the inside of the cooling zone 32, and the frontward damming fluid FF easily flows inside the cooling zone 32. Therefore, the frontward damming fluid FF constituting the dams can suppress contact of the frontward damming fluid FE with an outer surface portion of the hollow shell 50 that is further frontward than the cooling zone 32.

Note that, the respective frontward damming members (frontward damming upper member 600U, frontward damming lower member 600D, frontward damming left member 600L and frontward damming right member 600R) need not eject the frontward damming fluid FF diagonally rearward toward the upper part, the lower part, the left part and the right part of the outer surface of the hollow shell 50 positioned in the vicinity of the entrance side of the cooling zone 32 from the respective frontward damming fluid ejection holes (601U, 601D, 601L, 601R). For example, the frontward damming upper member 600U may eject the frontward damming fluid FF in the radial direction of the mandrel bar 3 from the frontward damming fluid upper-part ejection holes 601U. The frontward damming lower member 600D may eject the frontward damming fluid FF in the radial direction of the mandrel bar 3 from the frontward damming fluid lower-part ejection holes 601D. The frontward damming left member 600L may eject the frontward damming fluid FF in the radial direction of the mandrel bar 3 from the frontward damming fluid left-part ejection holes 601L. The frontward damming right member 600R may eject the frontward damming fluid FE in the radial direction of the mandrel bar 3 from the frontward damming fluid right-part ejection holes 601R.

Preferably, when ejecting the frontward damming fluid FF diagonally rearward from the frontward damming upper member 600U, of the momentum of the frontward damming fluid FF ejected from the frontward damming upper member 600U, the momentum in the axial direction of the hollow shell 50 on the outer surface of the hollow shell 50 (hereunder, the momentum in the axial direction of the hollow shell 50 is referred to as "axial direction momentum") is water than the axial direction momentum on the outer surface of the hollow shell 50 of the momentum of the cooling fluid CF ejected from the outer surface cooling upper member 400U. In this case, the cooling fluid CF can be suppressed from flowing out to the outer surface of the hollow shell 50 located further frontward than the cooling zone 32. Similarly, preferably, when ejecting the frontward damming fluid FF diagonally rearward from the frontward damming lower member 600D, of the momentum of the frontward damming fluid FF ejected from the frontward damming lower member 600D, the axial direction momentum on the outer surface of the hollow shell 50 is greater than the axial direction momentum on the outer surface of the hollow shell 50 of the momentum of the cooling fluid CF ejected from the outer surface cooling lower member 400D. Similarly, preferably, when ejecting the frontward damming fluid FF diagonally rearward from the frontward damming left member 600L, of the momentum of the frontward damming fluid FF ejected from the frontward damming left member 600L, the axial direction momentum on the outer surface of the hollow shell 50 is greater than the axial direction momentum on the outer surface of the hollow shell 50 of the momentum of the cooling fluid CF ejected from the outer surface cooling left member 400L. Similarly, preferably, when ejecting the frontward damming fluid FF diagonally rearward from the frontward damming right member 600R, of the momentum of the frontward damming fluid FF ejected from the frontward damming right member 600R, the axial direction momentum on the outer surface of the hollow shell 50 is greater than the axial direction momentum on the outer surface of the hollow shell 50 of the momentum of the cooling fluid CF ejected from the outer surface cooling right member 400R.

The frontward damming fluid FF is a gas and/or a liquid. That is, as the frontward damming fluid FF, a gas may be used, a liquid may be used, or both a gas and a liquid may be used. Here, the gas is, for example, air or an inert gas. The inert gas is, for example, argon gas or nitrogen gas. In the case of utilizing a gas as the frontward damming fluid FF, only air may be utilized, or only an inert gas may be utilized, or both air and an inert gas may be utilized. Further, as the inert gas, only one kind of inert gas (for example, argon gas only, or nitrogen gas only) may be utilized, or a plurality of inert gases may be mixed and utilized. In the case of utilizing a liquid as the frontward damming fluid FF, the liquid is, for example, water or oil, and preferably is water.

The frontward damming fluid FF may be the same fluid as the cooling fluid. CF, or may be a different fluid from the cooling fluid CF. The frontward damming mechanism 600 receives a supply of the frontward damming fluid FF from an unshown fluid supply source. A configuration of the fluid supply source is the same as the configuration of the fluid supply source 800 of the first embodiment. The frontward damming fluid FE supplied from the fluid supply source passes through the fluid path inside each main body 602 of the frontward damming mechanism 600, and is ejected from the frontward damming fluid ejection holes (frontward damming fluid upper-part ejection holes 601U, frontward damming fluid lower-part ejection holes 601D, frontward damming fluid left-part ejection holes 601L and frontward damming fluid right-part ejection holes 601R).

Figure 14:
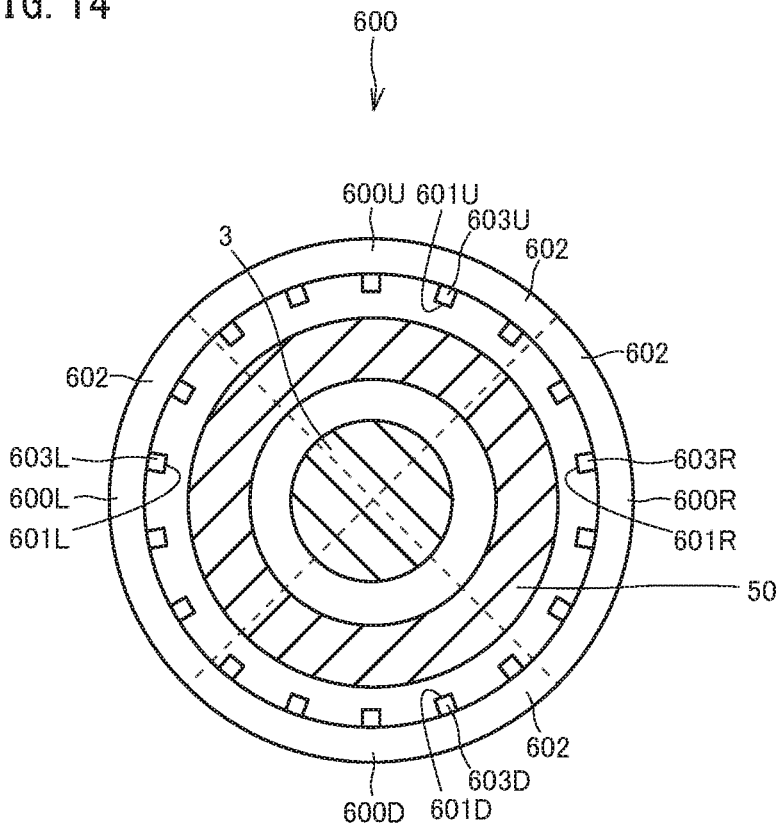
FIG. 14 is a front view of a frontward damming mechanism of a different form from the frontward damming mechanism illustrated in FIG. 9.

Note that, the configuration of the frontward damming mechanism 600 is not limited to the configuration illustrated in FIG. 8 to FIG. 13. For example, in FIG. 9 the frontward damming upper member 600U, the frontward damming lower member 600D, the frontward damming left member 600L and the frontward damming right member 600R are separate members which are independent from each other. However, as illustrated in FIG. 14, the frontward damming upper member 600U, the frontward damming lower member 600D, the frontward damming left member 600L and the frontward damming right member 600R may be integrally connected.

Figure 15:
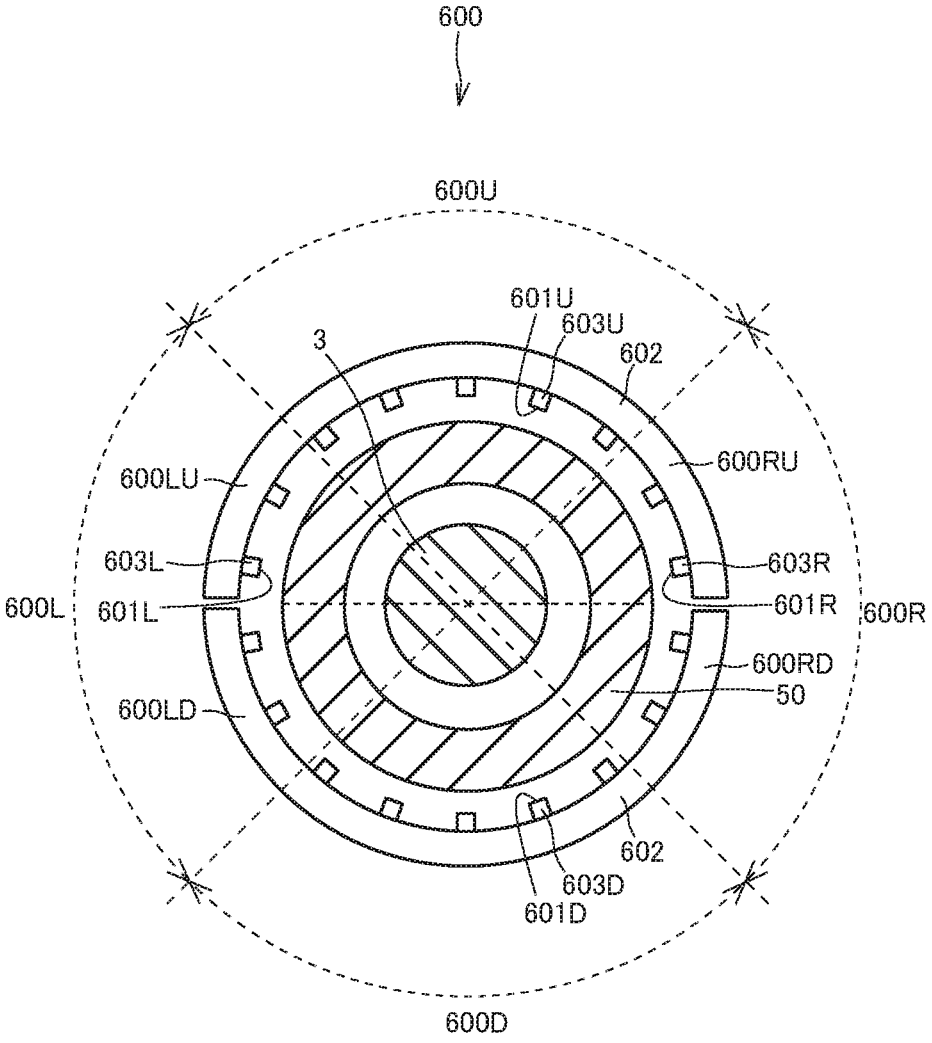
FIG. 15 is a front view of a frontward damming mechanism of a different form from the frontward damming mechanisms illustrated in FIG. 9 and FIG. 14.

Further, any of the frontward damming upper member 600U, the frontward damming lower member 600D, the frontward damming left member 600L and the frontward damming right member 600R may be constituted by a plurality of members, and parts of adjacent frontward damming members may be connected. In FIG. 15, the frontward damming left member 600L is constituted by two members (6001U, 600LD). Further, an upper member 600LU of the frontward damming left member 600L is connected to the frontward damming upper member 600U, and a lower member 600LD of the frontward damming left member 600L is connected to the frontward damming lower member 600D. Furthermore, the frontward damming right member 600R is constituted by two members (600RU, 600RD). An upper member 604RU of the frontward damming right member 600R is connected to the frontward damming upper member 600U, and a lower member 600RD of the frontward damming light member 600R is connected to the frontward &mining lower member 600D.

In other words, each of the frontward damming members (the frontward damming upper member 600U, the frontward damming lower member 600D, the frontward damming left member 600L and the frontward damming right member 600R) may include a plurality of members, and a part or all of each of the frontward damming members may be formed integrally with another frontward damming member. As long as the frontward damming upper member 600U ejects the frontward damming fluid FF toward the upper part of the outer surface of the hollow shell 50 that is positioned in the vicinity of the entrance side of the cooling zone 32, the frontward damming lower member 600D ejects the frontward damming fluid FF toward the lower part of the outer surface of the hollow shell 50 that is positioned in the vicinity of the entrance side of the cooling zone 32, the frontward damming left member 600L ejects the frontward damming fluid FF toward the left part of the outer surface of the hollow shell 50 that is positioned in the vicinity of the entrance side of the cooling zone 32, and the frontward damming right member 600R ejects the frontward damming fluid FF toward the right part of the outer surface of the hollow shell 50 that is positioned in the vicinity of the entrance side of the cooling zone 32 and thereby the aforementioned members suppress the cooling fluid CF from flowing to the outer surface of the hollow shell 50 before the aforementioned parts of the outer surface of the hollow shell 50 enter the cooling zone 32, the configuration of each frontward damming member (the frontward damming upper member 600U, the frontward damming lower member 600D, the frontward damming left member 600L and the frontward damming right member 600R) is not particularly limited.

Figure 16:
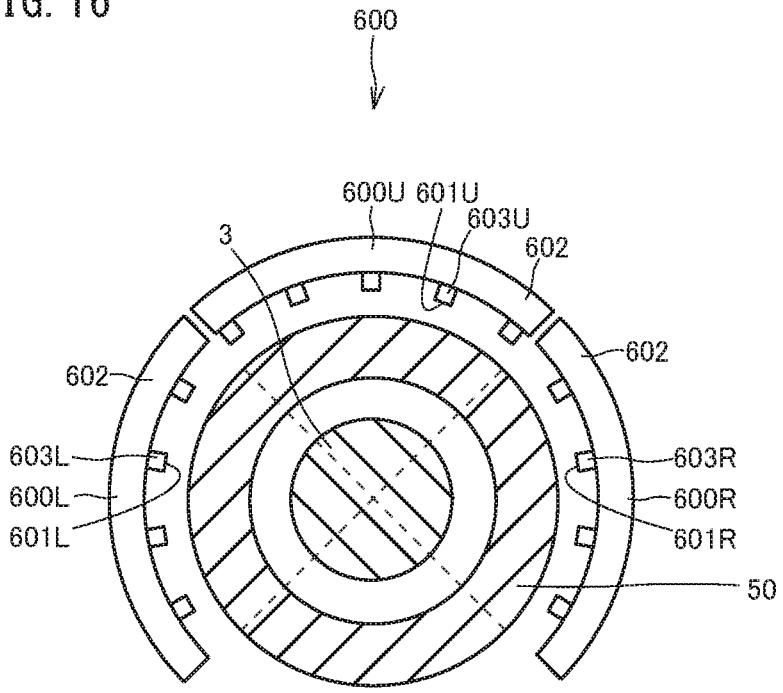
FIG. 16 is a front view of a frontward damming mechanism of a different form from the frontward damming mechanisms illustrated in FIG. 9, FIG. 14 and FIG. 15.
Figure 17:
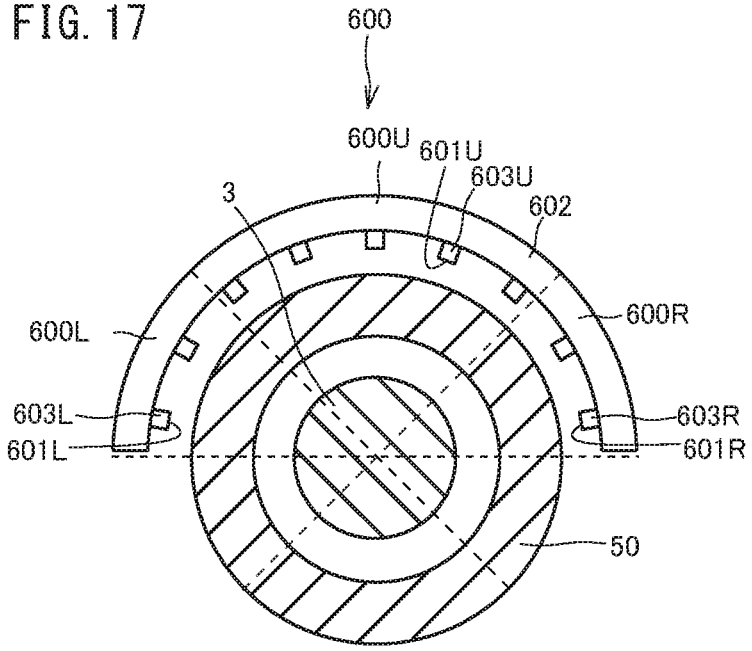
FIG. 17 is a front view of a frontward damming mechanism of a different form from the frontward damming mechanisms illustrated in FIG. 9 and FIG. 14 to FIG. 16.

Further, as illustrated in FIG. 16, the frontward damming mechanism 600 may include the frontward damming upper member 600U, the frontward damming left member 600L and the frontward damming right member 600R, and need not include the frontward damming, lower member 600D. After the cooling fluid CF ejected toward the lower part of the outer surface of the hollow shell 50 inside the cooling zone 32 from the outer surface cooling mechanism 400 contacts the lower part of the outer surface of the hollow shell 50, the cooling fluid CF easily drops down naturally under the force of gravity to below the hollow shell 50. Therefore, it is difficult for the cooling fluid CF ejected toward the lower part of the outer surface of the hollow shell 50 within the cooling zone 32 from the outer surface cooling mechanism 400 to flow to the lower part of the outer surface of the hollow shell that is frontward of the cooling zone 32. Accordingly, the frontward damming mechanism 600 need not include the frontward damming lower member 600D. Further, as illustrated in FIG. 17, the frontward damming mechanism 600 may include the frontward damming upper member 600U, the frontward damming left member 600L and the frontward damming right member 600R, and need not include the frontward damming lower member 600D, and the frontward damming left member 600L may be disposed further upward than the central axis of the mandrel bar 3, and the frontward damming right member 600R may be disposed further upward than the central axis of the mandrel bar 3. The cooling fluid CF that contacts the outer surface portion of the outer surface of the hollow shell 50 which is located further downward than the central axis of the mandrel bar 3 easily drops down naturally under the force of gravity to below the hollow shell 50. Therefore, it suffices that the frontward damming left member 600L is disposed at least further upward than the central axis of the mandrel bar 3, and it suffices that the frontward damming right member 600R is disposed at least further upward than the central axis of the mandrel bar 3.

Figure 18:
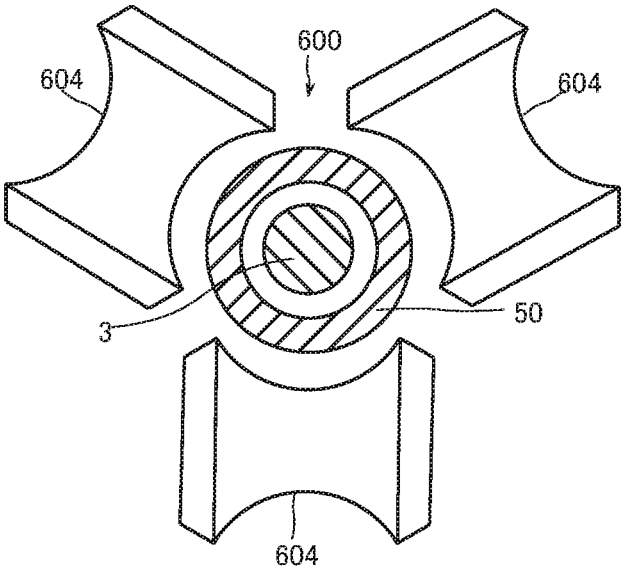
FIG. 18 is a front view of a frontward damming mechanism of a different form from the frontward damming mechanisms illustrated in FIG. 9 and FIG. 14 to FIG. 17.
Figure 19:
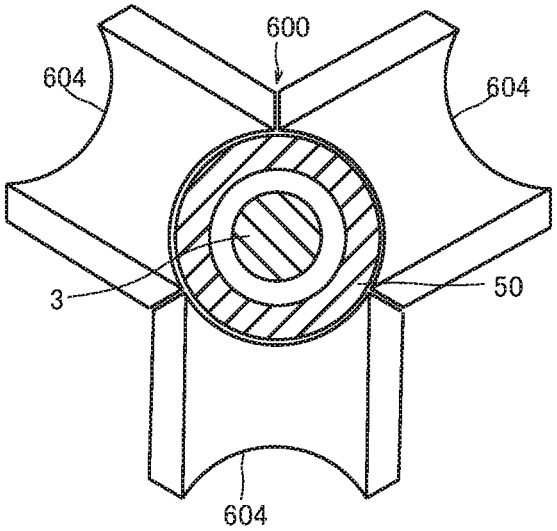
FIG. 19 is a front view of a frontward damming mechanism that illustrates a state in which a plurality of damming members illustrated in FIG. 18 have been brought close to an outer surface Of the hollow Shell during piercing-rolling or elongation rolling.

In addition, the frontward damming mechanism 600 may have a configuration that is different from the configurations illustrated in FIG. 8 to FIG. 17. For example, as illustrated in FIG. 18 and FIG. 19, the frontward damming mechanism 600 may be a mechanism that uses a plurality of damming members 604. In this case, as illustrated in FIG. 18, when seen in the advancing direction of the hollow shell 50, the frontward damming mechanism 600 includes a plurality of damming members 604 which are disposed around the mandrel bar 3. As illustrated in FIG. 18, the plurality of damming members 604 are, for example, rolls. In a case where the damming members 604 are rolls, as illustrated in FIG. 18 and FIG. 19, preferably a roll surface of each damming member 604 is curved so that the roll surface of each damming member 604 contacts the outer surface of the hollow shell 50. The damming members 604 are movable in the radial direction of the mandrel bar 3 by means of an unshown moving mechanism. The moving mechanism is, for example, a cylinder. The cylinder may be a hydraulic cylinder, may be a pneumatic cylinder, or may be an electric motor-driven cylinder.

During piercing-rolling or elongation rolling, when the hollow shell 50 passes the frontward damming mechanism 600, the plurality of damming members 604 move in the radial direction toward the outer surface of the hollow shell 50. The inner surface of each of the plurality of damming members 604 is then disposed in the vicinity of the outer surface of the hollow shell 50 (FIG. 19). Thus, when the outer surface cooling mechanism 400 is ejecting the cooling fluid CF toward the upper part of the outer surface, the lower part of the outer surface, the left part of the outer surface and the right part of the outer surface of the hollow shell 50 that is inside the cooling zone 32, the plurality of damming members 604 form a dam (protective wall). Therefore, the frontward damming mechanism 600 dams cooling fluid from flowing to the upper part of the outer surface, the lower part of the outer surface, the left part of the outer surface and the right part of the outer surface of the hollow shell 50 before the aforementioned parts of the outer surface of the hollow shell 50 enter the cooling zone 32.

Thus, the frontward damming mechanism 600 may have a configuration that does not use the frontward damming fluid FF. The configuration of the frontward damming mechanism 600 is not particularly limited as long as the frontward damming mechanism 600 is equipped with a mechanism that, when the outer surface cooling mechanism 400 is cooling the hollow shell 50, dams cooling fluid from flowing to the upper part of the outer surface, the lower part of the outer surface, the left part of the outer surface and the right part of the outer surface of the hollow shell 50 before the aforementioned parts of the outer surface of the hollow shell 50 enter the cooling zone 32.

Third Embodiment

Figure 20:
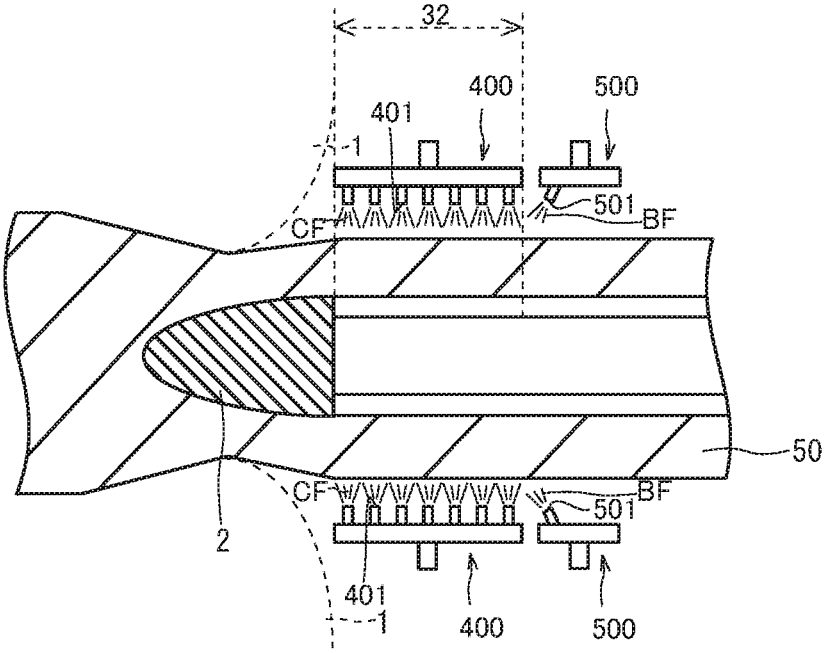
FIG. 20 is an enlarged view of the vicinity of the delivery side of skewed rolls of a piercing machine according to a third embodiment.

FIG. 20 is a view illustrating a configuration on the delivery side of the skewed rolls 1 of a piercing machine 10 according to a third embodiment. Referring to FIG. 20, in comparison to the piercing machine 10 according to the first embodiment, the piercing machine 10 according to the third embodiment newly includes a rearward damming mechanism 500. The remaining configuration of the piercing machine 10 according to the third embodiment is the same as the configuration of the piercing machine 10 according to the first embodiment,

[Rearward Damming Mechanism 500]

The rearward damming mechanism 500 is disposed around the mandrel bar 3 at a position that is rearward of the outer surface cooling mechanism 400. The rearward damming mechanism 500 is equipped with a mechanism that, when the outer surface cooling mechanism 400 is cooling the hollow shell in the cooling zone 32 by ejecting the cooling fluid CF toward the upper part of the outer surface, the lower part of the outer surface, the left part of the outer surface and the right part of the outer surface of the hollow shell 50 in the cooling zone 32, dams the cooling fluid from flowing to the upper part of the outer surface, the left part of the outer surface and the right part of the outer surface of the hollow shell 50 after the aforementioned parts of the outer surface of the hollow shell 50 leave from the cooling zone 32.

Figure 21:
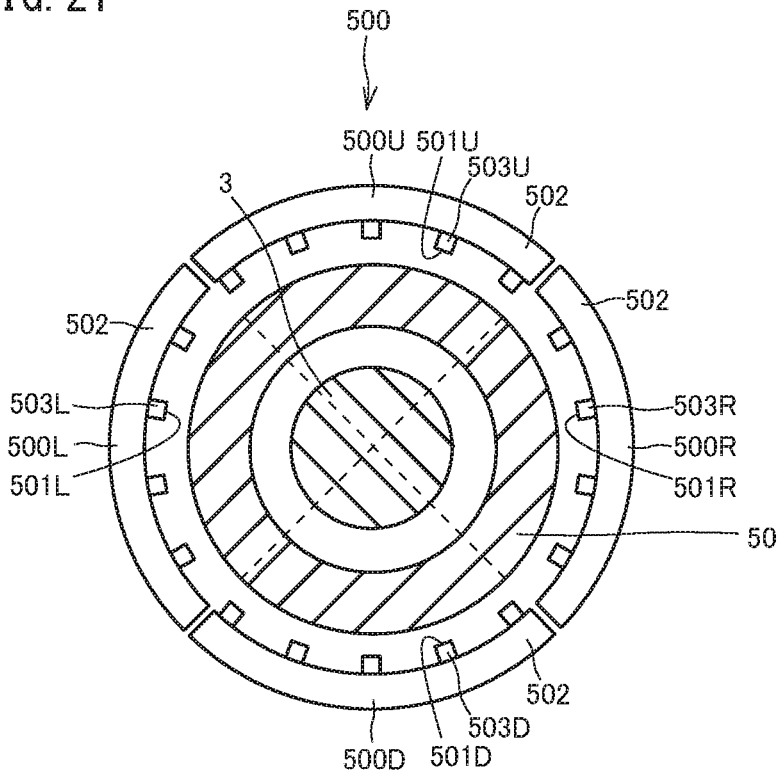
FIG. 21 is a front view of a rearward damming mechanism illustrated in FIG. 20, as seen from the advancing direction of the hollow shell.

FIG. 21 is a view illustrating the rearward damming mechanism 500 as seen in the advancing direction of the hollow shell 50 (view of the rearward damming mechanism 500 when seen from the entrance side toward the delivery side of the skewed rolls 1). Referring to 20 and FIG. 21, when seen in the advancing direction of the hollow shell 50, the rearward damming mechanism 500 is disposed around the mandrel bar 3, at a position that is rearward of the outer surface cooling mechanism 400. Further, during piercing-rolling or elongation rolling, as illustrated in FIG. 21, the rearward damming mechanism 500 is disposed around the hollow shell 50 subjected to piercing-rolling or elongation rolling.

Referring to FIG. 21, when seen in the advancing direction of the hollow shell 50, the rearward damming mechanism 500 includes a rearward damming upper member 500U, a rearward damming lower member 500D, a rearward damming left member 500L and a rearward damming right member 500R.

[Configuration of Rearward Damming Upper Member 500U]

The rearward damming upper member 500U is disposed above the mandrel bar 3. The rearward damming upper member 500U includes a main body 502 and a plurality of rearward damming fluid upper-part ejection holes 501U. The main body 502 is a tube-shaped or plate-shaped casing that is curved in the circumferential direction of the mandrel bar 3, and includes therein one or more fluid paths which allow a rearward damming fluid BF (see FIG. 20) to pass therethrough. In the present example, the plurality of rearward damming fluid upper-part ejection holes 501U are formed in a front end of a plurality of rearward damming fluid upper-part ejection nozzles 503U. However, the rearward damming fluid upper-part ejection holes 501U may be formed directly in the main body 502. In the present example, the plurality of rearward damming fluid upper-part ejection nozzles 503U that are arrayed around the mandrel bar 3 are connected to the main body 502.

When the hollow shell 50 subjected to piercing-rolling or elongation rolling passes through the inside of the rearward damming mechanism 500, the plurality of rearward damming fluid upper-part ejection holes 501U of the rearward damming upper member 500U face the upper part of the outer surface of the hollow shell 50 that is positioned in the vicinity of the delivery side of the cooling zone 32. When seen in the advancing direction of the hollow shell 50, the plurality of rearward damming fluid upper-part ejection holes 501U are arrayed around the mandrel bar 3, in the circumferential direction of the mandrel bar 3. Preferably, the plurality of rearward damming fluid upper-part ejection holes 501U are arrayed at regular intervals around the mandrel bar 3. The plurality of rearward damming fluid upper-part ejection holes 501U may also be arrayed side-by-side in the axial direction of the mandrel bar 3.

During piercing-rolling or elongation rolling, when the outer surface cooling mechanism 400 is cooling the hollow shell 50 in the cooling zone 32, the rearward damming upper member 500U ejects the rearward damming fluid BF toward the upper part of the outer surface of the hollow shell 50 that is positioned in the vicinity of the delivery side of the cooling zone 32 from the plurality of rearward damming fluid upper-part ejection holes 501U to thereby dam the cooling fluid CF from flowing to the upper part of the outer surface of the hollow shell 50 after the upper part of the outer surface of the hollow shell 50 leaves from the cooling zone 32.

[Configuration of Rearward Damming Lower Member 500D]

The rearward damming lower member 500D is disposed below the mandrel bar 3. The rearward damming lower member 500D includes a main body 502 and a plurality of rearward damming fluid lower-part ejection holes 501D. The main body 502 is a tube-shaped or plate-shaped casing that is curved in the circumferential direction of the mandrel bar 3, and includes therein one or more fluid paths which allow the rearward damming fluid BF to pass therethrough. In the present example, the plurality of rearward damming fluid lower-part ejection holes 501D are formed in a front end of a plurality of rearward damming fluid lower-part ejection nozzles 503D. However, the rearward damming fluid lower-part ejection holes 501D may be formed directly in the main body 502. In the present example, the plurality of rearward damming fluid lower-part ejection nozzles 503D that are arrayed around the mandrel bar 3 are connected to the main body 502.

When the hollow shell 50 subjected to piercing-rolling or elongation rolling passes through the inside of the rearward damming mechanism 500, the plurality of rearward damming fluid lower-part ejection holes 501D Of the rearward damming lower member 500D face the lower part of the outer surface of the hollow shell 50 that is positioned in the vicinity of the delivery Side of the cooling zone 32. When seen in the advancing direction of the hollow shell 50, the plurality of rearward damming fluid lower-part ejection holes 501D are arrayed around the mandrel bar 3, in the circumferential direction of the mandrel bar 3. Preferably, the plurality of rearward damming fluid lower-part ejection holes 501D are arrayed at regular intervals around the mandrel bar 3. The plurality of rearward damming fluid lower-part ejection holes 501D may also be arrayed side-by-side in the axial direction of the mandrel bar 3.

During piercing-rolling or elongation rolling, when the outer surface cooling mechanism 400 is cooling the hollow shell 50 in the cooling zone 32, the rearward damming, lower member 500D ejects the rearward damming fluid BF toward the lower part of the outer surface of the hollow shell 50 that is positioned in the vicinity of the delivery side of the cooling zone 32 from the plurality of rearward damming fluid lower-part ejection holes 501D to thereby dam the cooling fluid CF from flowing to the lower part of the outer surface of the hollow shell 50 after the lower part of the outer surface of the hollow shell 50 leaves from the cooling zone 32.

[Configuration of Rearward Damming Left Member 500L]

The rearward damming left member 500L is disposed leftward of the mandrel bar 3 when seen in the advancing direction of the hollow shell 50. The rearward damming left member 500L includes a main body 502 and a plurality of rearward damming fluid left-part ejection holes 501L. The main body 502 is a tube-shaped or plate-shaped casing that is curved in the circumferential direction of the mandrel bar 3, and includes therein one or more fluid paths which allow the rearward damming fluid BF to pass therethrough. In the present example, the plurality of rearward damming fluid left-part ejection holes 501L are formed in a front end of a plurality of rearward damming fluid left-part ejection nozzles 503L. However, the rearward damming fluid left-part ejection holes 501L may be formed directly in the main body 502. In the present example, the plurality of rearward damming fluid left-part ejection nozzles 503L that are arrayed around the mandrel bar 3 are connected to the main body 502.

When the hollow shell 50 subjected to piercing-rolling or elongation rolling passes through the inside of the rearward damming mechanism 500, the plurality of rearward damming fluid left-part ejection holes 501L of the rearward damming left member 500L face the left part of the outer surface of the hollow shell 50 that is positioned in the vicinity of the delivery side of the cooling zone 32. When seen in the advancing direction of the hollow shell 50, the plurality of rearward damming fluid left-part ejection holes 501L are arrayed around the mandrel bar 3, in the circumferential direction of the mandrel bar 3. Preferably, the plurality of rearward damming fluid left-part ejection holes 501L are arrayed at regular intervals around the mandrel bar 3. The plurality of rearward damming fluid left-part ejection holes 501L may also be arrayed side-by-side in the axial direction of the mandrel bar 3.

During piercing-rolling or elongation rolling, when the outer surface cooling mechanism 400 is cooling the hollow shell 50 in the cooling zone 32, the rearward damming left member 500L ejects the rearward damming fluid BF toward the left part of the outer surface of the hollow shell 50 that is positioned in the vicinity of the delivery side of the cooling zone 32 from the plurality of rearward damming fluid left-part ejection holes 501L to thereby dam the cooling fluid CF from flowing to the left part of the outer surface of the hollow shell 50 after the left part of the outer surface of the hollow shell 50 leaves from the cooling zone 32.

[Configuration of Rearward Damming Right Member 500R]

The rearward damming right member 500R is disposed rightward of the mandrel bar 3 when seen in the advancing direction of the hollow shell 50. The rearward damming right member 500R includes a main body 502 and a plurality of rearward damming fluid right-part ejection holes 501R. The main body 502 is a tube-shaped or plate-shaped casing that is curved in the circumferential direction of the mandrel bar 3, and includes therein one or more fluid paths which allow the rearward damming fluid BF to pass therethrough. In the present example, the plurality of rearward damming fluid right-part ejection holes 501R are formed in a front end of a plurality of rearward damming fluid right-part ejection nozzles 503R. However, the rearward damming fluid right-part ejection holes 501R may be formed directly in the main body 502. In the present example, the plurality of rearward damming fluid right-part ejection nozzles 503R that are arrayed around the mandrel bar 3 are connected to the main body 502.

When the hollow shell 50 subjected to piercing-rolling or elongation rolling passes through the inside of the outer surface cooling mechanism 400, the plurality of rearward damming fluid right-part ejection holes 501R of the rearward damming right member 500R face the right part of the outer surface of the hollow shell 50 that is positioned in the vicinity of the delivery side of the cooling zone 32. When seen in the advancing direction of the hollow shell 50, the plurality of rearward damming fluid right-part ejection holes 501R are arrayed around the mandrel bar 3, in the circumferential direction of the mandrel bar 3. Preferably, the plurality of rearward damming fluid right-part ejection holes 501R are arrayed at regular intervals around the mandrel bar 3. The plurality of rearward damming fluid right-part ejection holes 501R may also be arrayed side-by-side in the axial direction of the mandrel bar 3.

During piercing-rolling or elongation rolling, when the outer surface cooling mechanism 400 is cooling the hollow shell 50 in the cooling zone 32, the rearward damming right member 500R ejects the rearward damming fluid BF toward the right part of the outer surface of the hollow shell 50 that is positioned in the vicinity of the delivery side of the cooling zone 32 from the plurality of rearward damming fluid right-part ejection holes 501R to thereby dam the cooling fluid CF from flowing to the right part of the outer surface of the hollow shell 50 after the right part of the outer surface of the hollow shell 50 leaves from the cooling zone 32.

[Operations of Rearward Damming Mechanism 500]

During piercing-rolling or elongation rolling, of the entire outer surface of the hollow shell 50 subjected to piercing-rolling or elongation rolling, the outer surface cooling mechanism 400 ejects the cooling fluid CF toward the outer surface portion of the hollow shell 50 that is inside the cooling zone 32 to thereby cool the hollow shell 50. At this time, after the cooling fluid CF ejected toward the outer surface portion of the hollow shell 50 inside the cooling zone 32 contacts the outer surface portion of the hollow shell 50, a situation can arise in which the cooling fluid CF flows to rearward of the outer surface portion and contacts the outer surface portion of the hollow shell 50 that is rearward of the cooling zone 32. If the frequency at which contact of the cooling fluid CF with an outer surface portion of the hollow shell 50 in a zone other than the cooling zone 32 occurs is high, variations can arise in the temperature distribution in the aerial direction of the hollow shell 50.

Therefore, in the present embodiment, during piercing-rolling or elongation rolling, the rearward damming mechanism 500 suppresses the cooling fluid CF that flows over the outer surface after contacting the outer surface portion of the hollow shell 50 inside the cooling zone 32 from contacting the outer surface portion of the hollow shell 50 that is rearward of the cooling zone 32.

The rearward damming mechanism 500 is equipped with a mechanism that, when the outer surface cooling mechanism 400 is cooling the hollow shell inside the cooling zone 32 by ejecting the cooling, fluid CF toward the upper part of the outer surface, the lower part of the outer surface, the left part of the outer surface and the right part of the outer surface of the hollow shell 50 inside the cooling zone 32, dams the cooling fluid CF from flowing to the upper part, the lower part, the left part and the right part of the outer surface of the hollow shell 50 after the aforementioned parts of the outer surface of the hollow shell 50 leave from the cooling zone 32. Specifically, when seen in the advancing direction of the hollow shell 50, the rearward damming upper member 500U ejects the rearward damming fluid BF toward the upper part of the outer surface of the hollow shell 50 that is positioned in the vicinity of the delivery side of the cooling zone 32 to thereby limn a dam (Protective wall) composed of the rearward damming fluid BF at the upper part of the outer surface of the hollow shell 50 after the upper part of the outer surface of the hollow shell 50 leaves from the cooling zone 32. Similarly, the rearward damming lower member 500D ejects the rearward damming fluid BF toward the lower part of the outer surface of the hollow shell 50 that is positioned in the vicinity of the delivery side of the coding zone 32 to thereby form a dam (protective wall) composed of the rearward damming fluid BF at the lower part of the outer surface of the hollow shell 50 after the lower part of the outer surface of the hollow shell 50 leaves from the cooling zone 32. Similarly, the rearward damming left member 500L ejects the rearward damming fluid BF toward the left part of the outer surface of the hollow shell 50 that is positioned in the vicinity of the delivery side of the cooling zone 32 to thereby form a dam (protective wall) composed of the rearward damming fluid BF at the left part of the outer surface of the hollow shell 50 after the left part of the outer surface of the hollow shell 50 leaves from the cooling zone 32, Similarly, the rearward damming right member 500R ejects the rearward damming fluid BF toward the light part of the outer surface of the hollow shell 50 that is positioned in the vicinity of the delivery side of the cooling zone 32 to thereby form a dam (protective wall) composed of the rearward damming fluid BF at the right part of the outer surface of the hollow shell 50 after the right part of the outer surface of the hollow shell 50 leaves from the cooling zone 32. These dams that are composed of the rearward damming fluid BF dam the cooling fluid CF that contacts the outer surface portion of the hollow shell 50 within the cooling zone 32 and rebounds therefrom and attempts to flow to the zone rearward of the cooling zone 32. Therefore, contact of the cooling fluid CF with the outer surface portion of the hollow shell 50 that is rearward of the cooling zone 32 can be suppressed, and temperature variations in the axial direction of the hollow shell 50 can be further reduced.

Figure 22:
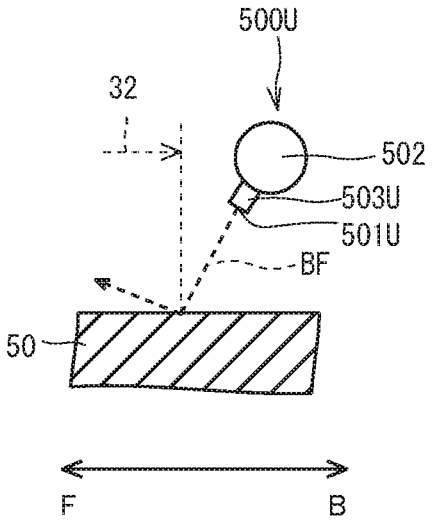
FIG. 22 is a sectional drawing of a rearward damming upper member illustrated in FIG. 21, as seen from the direction parallel to the advancing direction f the hollow shell.
Figure 23:
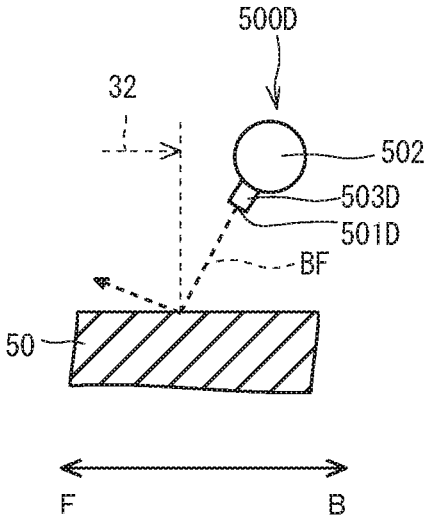
FIG. 23 is a sectional thawing of a rearward damming lower member illustrated in FIG. 21, as seen from the direction parallel to the advancing direction f the hollow shell.
Figure 24:
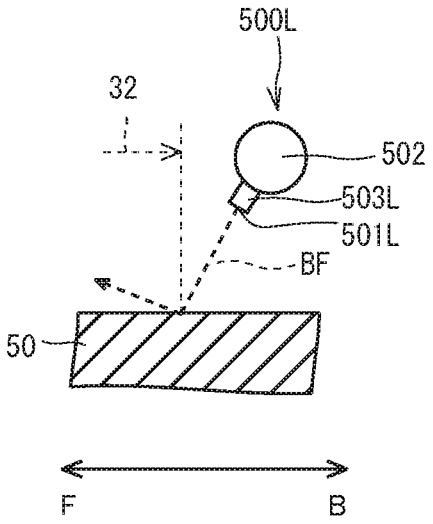
FIG. 24 is a sectional thawing of a rearward damming left member illustrated in FIG. 21, as seen from the direction parallel to the advancing direction of the hollow shell.
Figure 25:
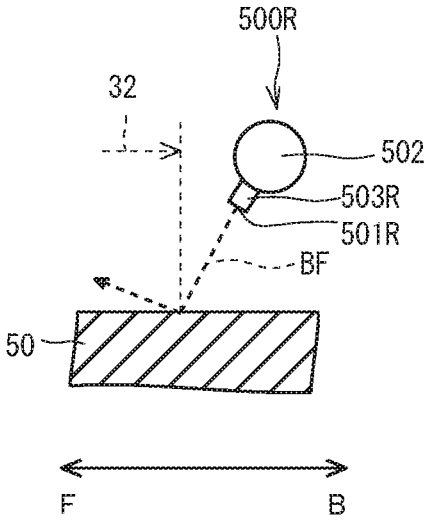
FIG. 25 is a sectional drawing of a rearward damming right member illustrated in FIG. 21, as seen from the direction parallel to the advancing direction of the hollow shell.

FIG. 22 is a sectional drawing of the rearward damming upper member 500U, when seen from a direction parallel to the advancing direction of the hollow shell 50. FIG. 23 is a sectional drawing of the rearward damming lower member 500D, when seen from the direction parallel to the advancing direction of the hollow shell 50. FIG. 24 is a sectional drawing of the rearward damming left member 500L, when seen from the direction parallel to the advancing direction of the hollow shell 50. FIG. 25 is a sectional drawing of the rearward damming right member 500R, when seen from the direction parallel to the advancing direction of the hollow shell 50.

Referring to FIG. 22, preferably the rearward damming upper member 500U ejects the rearward damming fluid BF diagonally frontward towards the upper part of the outer surface of the hollow shell 50 that is positioned in the vicinity of the delivery side of the cooling zone 32 from the rearward damming fluid upper-part ejection holes 501U. Referring to FIG. 23, preferably the rearward damming lower member 500D ejects the rearward damming fluid BF diagonally frontward towards the lower part of the outer surface of the hollow shell 50 that is positioned in the vicinity of the delivery side of the cooling zone 32 from the rearward damming fluid lower-part ejection holes 501D.

Referring to FIG. 24, preferably the rearward damming left member 500L ejects the rearward damming fluid BF diagonally frontward towards the left part of the outer surface of the hollow shell 50 that is positioned in the vicinity of the delivery side of the cooling zone 32 from the rearward damming fluid left-part ejection holes 501L. Referring to FIG. 25, preferably the rearward damming right member 500R ejects the rearward damming fluid BF diagonally frontward towards the left part of the outer surf-ice of the hollow shell 50 that is positioned in the vicinity of the delivery side of the cooling zone 32 from the rearward damming fluid right-part ejection holes 501R.

In FIG. 22 to FIG. 25, the rearward damming upper member 500U forms a dam (protective wall) composed of the rearward damming fluid BF that extends diagonally frontward toward the upper part of the outer surface of the hollow shell 50 from above the hollow shell 50. Similarly, the rearward damming lower member 500D forms a dam (protective wall) composed of the rearward damming fluid BF that extends diagonally frontward toward the lower part of the outer surface of the hollow shell 50 from below the hollow shell 50. Similarly, the rearward damming left member 500L forms a dam (protective wall) composed of the rearward damming fluid BF that extends diagonally frontward toward the left part of the outer surface of the hollow shell 50 from leftward of the hollow shell 50. Similarly, the rearward damming right member 500R forms a dam (protective wall) composed of the rearward damming fluid BF that extends diagonally frontward toward the right part of the outer surface of the hollow shell 50 from rightward of the hollow shell 50. These dams dam the cooling fluid CF that contacts the outer surface portion of the hollow shell 50 within the cooling zone 32 and rebounds therefrom and attempts to fly out to the zone that is rearward of the cooling zone 32. In addition, after the rearward damming fluid BF constituting the dams contacts the outer surface portion of the hollow shell 50 in the vicinity of the delivery side of the cooling zone 32, as illustrated in FIG. 22 to FIG. 25, it is easy for the rearward damming fluid BF to rebound into the inside of the cooling zone 32, and the rearward damming fluid BF easily flows inside the cooling zone 32. Therefore, contact of the rearward damming fluid BF constituting the dams with an outer surface portion of the hollow shell 50 that is further rearward than the cooling zone 32 can be suppressed.

Note that, the respective rearward damming members (rearward damming upper member 500U, rearward damming lower member 500D, rearward damming left member 500L and rearward damming right member 500R) need not eject the rearward damming fluid BF diagonally frontward toward the upper part, the lower part, the left part and the right part of the outer surface of the hollow shell 50 positioned in the vicinity of the delivery side of the cooling zone 32 from the respective rearward damming fluid ejection holes (rearward damming fluid upper-part ejection holes 501U, rearward damming fluid lower-part ejection holes 501D, rearward damming fluid left-part ejection holes 501L, and rearward damming fluid right-part ejection holes 501R). For example, the rearward damming upper member 500U may eject the rearward damming fluid BF in the radial direction of the mandrel bar 3 from the rearward damming fluid upper-part ejection holes 501U. The rearward damming lower member 500D may eject the rearward damming fluid BF in the radial direction of the mandrel bar 3 from the rearward damming fluid lower-part ejection holes 501D. The rearward damming left member 500L may eject the rearward damming fluid BF in the radial direction of the mandrel bar 3 from the rearward damming fluid left-part ejection holes 501L. The rearward damming right member 500R may eject the rearward damming fluid BF in the radial direction of the mandrel bar 3 from the rearward damming fluid right-part ejection holes 501R.

Preferably, when ejecting the rearward damming fluid BF diagonally frontward from the rearward damming upper member 500U, of the momentum of the rearward damning fluid BF ejected from the rearward damming upper member 500U, the momentum in the axial direction of the hollow shell 50 on the outer surface of the hollow shell 50 (hereunder, the momentum in the axial direction of the hollow shell 50 is referred to as "axial direction momentum") is greater than the axial direction momentum on the outer surface of the hollow shell 50 of the momentum of the cooling fluid CF ejected from the outer surface cooling upper member 400U. In this case, the cooling fluid CF can be suppressed from flowing out to the outer surface of the hollow shell 50 located further rearward than the cooling zone 32. Similarly, preferably, when ejecting the rearward damming fluid BF diagonally frontward from the rearward damming lower member 500D, of the momentum of the rearward damming fluid BF ejected from the rearward damming lower member 500D, the axial direction momentum on the outer surface of the hollow shell 50 is greater than the axial direction momentum on the outer surface of the hollow shell 50 of the momentum of the cooling fluid CF ejected from the outer surface cooling lower member 400D. Similarly, preferably, when ejecting the rearward damming fluid BF diagonally frontward from the rearward damming left member 500L, of the momentum of the rearward damming fluid BF ejected from the rearward damming left member 500L, the axial direction momentum on the outer surface of the hollow shell 50 is greater than the axial direction momentum on the outer surface of the hollow shell 50 of the momentum of the cooling fluid CF ejected from the outer surface cooling left member 400L. Similarly, preferably, when ejecting the rearward damming fluid BF diagonally frontward from the rearward damming right member 500R, of the momentum of the rearward damming fluid BF ejected from the rearward damming right member 500R the axial direction momentum on the outer surface of the hollow shell 50 is greater than the axial direction momentum on the outer surface of the hollow shell 50 of the momentum of the cooling fluid CF ejected from the outer surface cooling right member 400R.

The rearward damming fluid BF is a gas and/or a liquid. That is, as the rearward damming fluid BF, a gas may be used, a liquid may be used, or both a gas and a liquid may be used. Here, the gas is, for example, air or an inert gas. The inert gas is, for example, argon gas or nitrogen gas. In the case of utilizing a gas as the rearward damming fluid BF, only air may be utilized, or only an inert gas may be utilized, or both air and an inert gas may be utilized. Further, as the inert gas, only one kind of inert gas (for example, argon gas only, or nitrogen gas only) may be utilized, or a plurality of inert gases may be mixed and utilized. In the case of utilizing a liquid as the rearward damming fluid BF, the liquid is, for example, water or oil, and preferably is water.

The rearward damming fluid BF may be of the same kind as the kind of the cooling fluid CF and/or the frontward damming fluid FF, or may be of a different kind from the cooling fluid CF and/or the frontward damming fluid FF. The rearward damming mechanism 500 receives a supply of the rearward damming fluid BF from an unshown fluid supply source. A configuration of the fluid supply source is the same as the configuration of the fluid supply source 800 of the first embodiment. The rearward damming fluid BF supplied from the fluid supply source passes through the fluid path inside each main body 502 of the rearward damming mechanism 500, and is ejected from the respective rearward damming fluid ejection holes (rearward damming fluid upper-part ejection holes 501U, rearward damming fluid lower-part ejection holes 501D, rearward damming fluid left-part ejection holes 501L and rearward damming fluid right-part ejection holes 501R).

Figure 26:
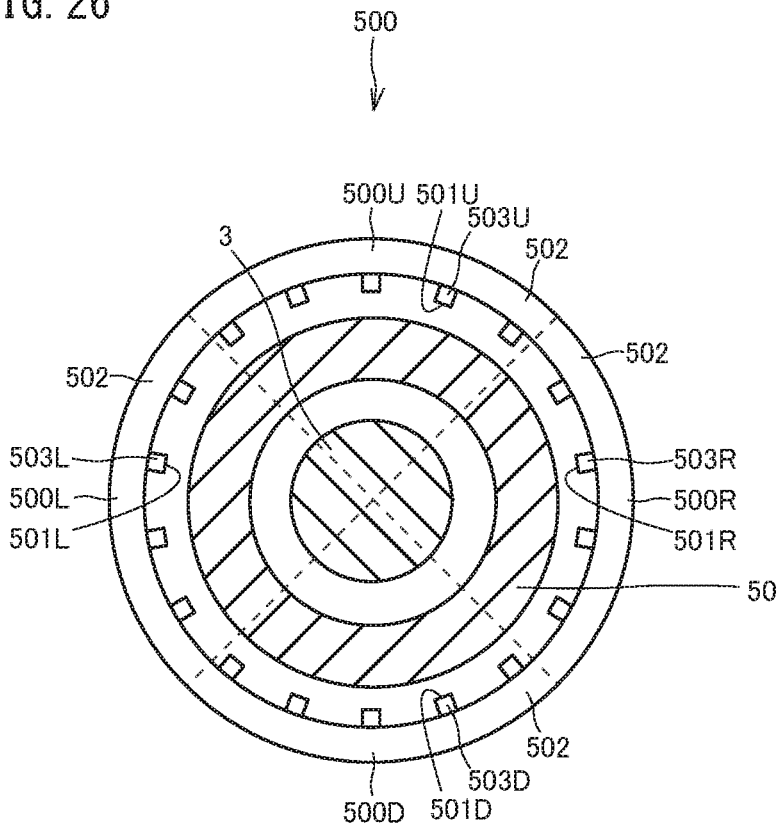
FIG. 26 is a front view of a rearward damming mechanism of a different form from the rearward damming mechanism illustrated in FIG. 21.

Note that, the configuration of the rearward damming mechanism 500 is not limited to the configuration illustrated in FIG. 20 to FIG. 25. For example, in FIG. 21 the rearward damming upper member 500U, the rearward damming lower member 500D, the rearward damming left member 500L and the rearward damming right member 500R are separate members which are independent from each other. However, as illustrated in FIG. 26, the rearward damming upper member 500U, the rearward damming lower member 500D, the rearward damming left member 500L and the rearward damming right member 500R may be integrally connected.

Figure 27:
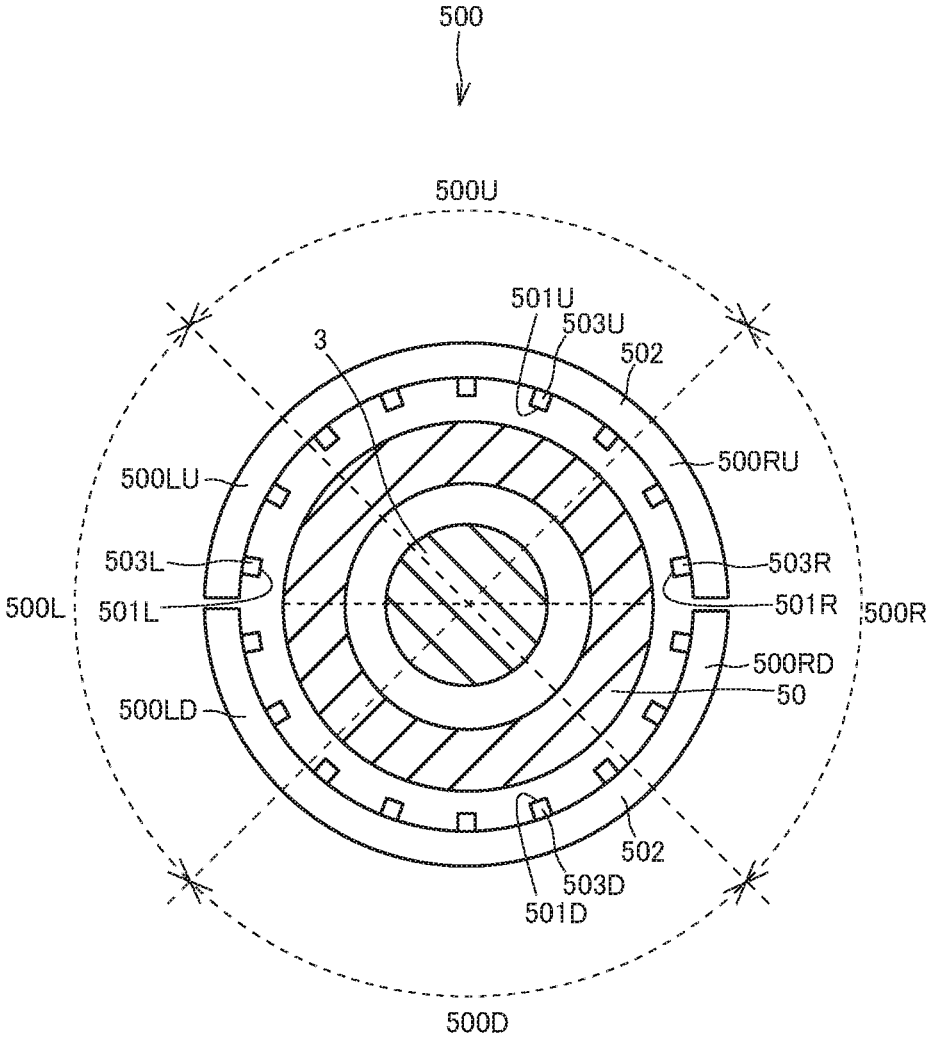
FIG. 27 is a front view of a rearward damming mechanism of a different form from the rearward damming mechanisms illustrated in FIG. 21 and FIG. 26.

Further, any of the rearward damming upper member 500U, the rearward damming lower member 500D, the rearward damming left member 500L and the rearward damming right member 500R May be constituted by a plurality of member, and parts of adjacent rearward damming members may be connected. In FIG. 27, the rearward damming left member 500L is constituted by two members (500LU, 500LD). Further, an upper member 500LU of the rearward damming left member 500L is connected to the rearward damming upper member 500U, and a lower member 500LD of the rearward damming left member 500L is connected to the rearward damming lower member 500D. Furthermore, the rearward damming right member 500R is constituted by two members (500RU, 500RD). An upper member 500RU of the rearward damming right member 500R is connected to the rearward damming upper member 500U, and a lower member 500RD of the rearward damming right member 500R is connected to the rearward damming lower member 500D.

In other words, each of the rearward damming members (the rearward damming upper member 500U, the rearward damming lower member 500D, the rearward damming left member 500L and the rearward damming right member 500R) may include a plurality of members, and a part or all of each of the rearward damming members may be formed integrally with another rearward damming member. As long as the rearward damming upper member 500U ejects the rearward damming fluid BF toward the upper part of the outer surface of the hollow shell 50 that is positioned in the vicinity of the delivery side of the cooling zone 32, the rearward damming lower member 500D ejects the rearward damming fluid BF toward the lower part of the outer surface of the hollow shell 50 that is positioned in the vicinity of the delivery side of the cooling zone 32, the rearward damming left member SOUL ejects the rearward damming fluid BF toward the left part of the outer surface of the hollow shell 50 that is positioned in the vicinity of the delivery side of the cooling zone 32, and the rearward damming right member 500R ejects the rearward damming fluid BF toward the right part of the outer surface of the hollow shell 50 that is positioned in the vicinity of the delivery side of the cooling zone 32 and thereby the aforementioned members suppress the cooling fluid CF from flowing to the outer surface of the hollow shell 50 after the aforementioned parts of the outer surface of the hollow shell 50 leave from the cooling zone 32, the configuration of each rearward damming member (the rearward damming upper member 500U, the rearward damming lower member 500D, the rearward damming left member 500L, and the rearward damming right member 500R) is not particularly limited.

Figure 28:
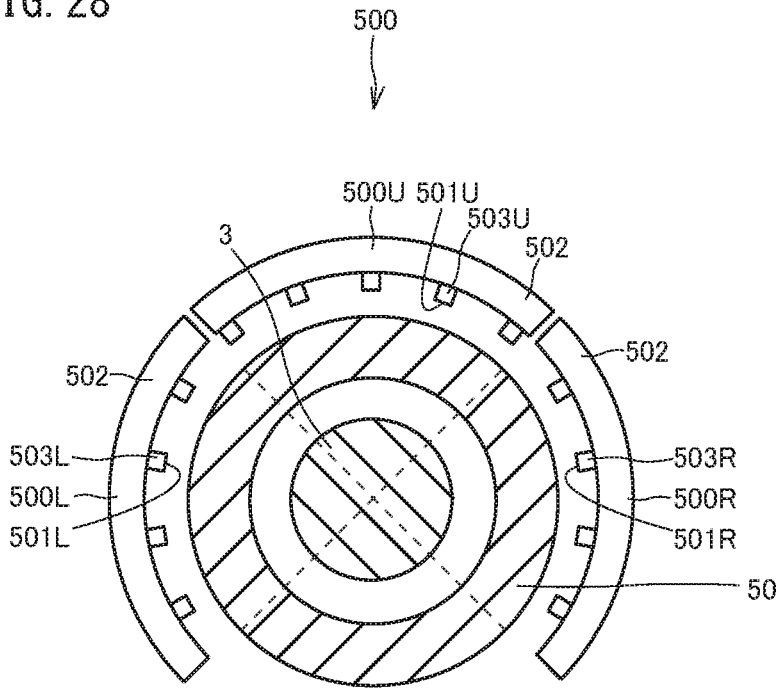
FIG. 28 is a front view of a rearward damming mechanism of a different form from the rearward damming mechanisms illustrated in FIG. 21, FIG. 26 and FIG. 27.
Figure 29:
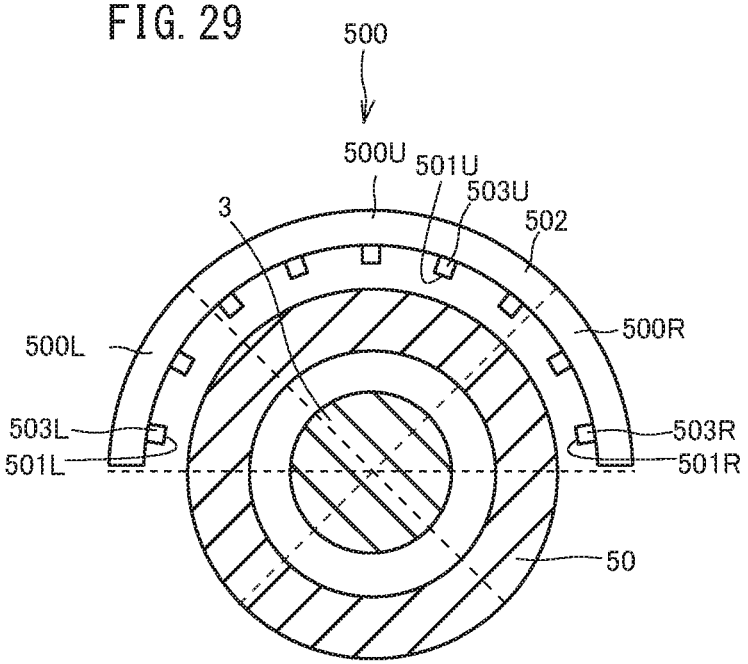
FIG. 29 is a front view of a rearward damming mechanism of a different form from the rearward damming mechanisms illustrated in FIG. 21 and FIG. 26 to FIG. 28.

Further, as illustrated in FIG. 28, the rearward damming mechanism 500 may include the rearward damming upper member 500U, the rearward damming left member 500L and the rearward damming right member 500R, and need not include the rearward damming lower member 500D. After the cooling fluid CF ejected toward the lower part of the outer surface of the hollow shell 50 inside the cooling zone 32 from the outer surface cooling mechanism 400 contacts the lower part of the outer surface of the hollow shell 50, the cooling fluid CF easily drops down naturally under the force of gravity to below the hollow shell 50. Therefore, it is difficult for the cooling fluid CF ejected toward the lower part of the outer surface of the hollow shell 50 within the cooling, zone 32 from the outer surface cooling mechanism 400 to flow to the lower part of the outer surface of the hollow shell that is rearward of the cooling zone 32. Accordingly, the rearward damming mechanism 500 need not include the rearward damming lower member 500D. Further, as illustrated in FIG. 29, the rearward damming mechanism 500 may include the rearward damming upper member 500U, the rearward damming left member 500L and the rearward damming right member 500R, and need not include the rearward damming lower member 500D, and the rearward damming left member 500L may be disposed further upward than the central axis of the mandrel bar 3, and the rearward damming right member 500R may be disposed further upward than the central axis of the mandrel bar 3. The cooling, fluid CF that contacts the outer surface portion of the outer surface of the hollow shell 50 which is located further downward than the central axis of the mandrel bar 3 easily drops down naturally under the force of gravity to below the hollow shell 50. Therefore, it suffices that the rearward damming left member 500L is disposed at least further upward than the central axis of the mandrel bar 3, and it suffices that the rearward damming right member 500R is disposed at least further upward than the central axis of the mandrel bar 3.

Figure 30:
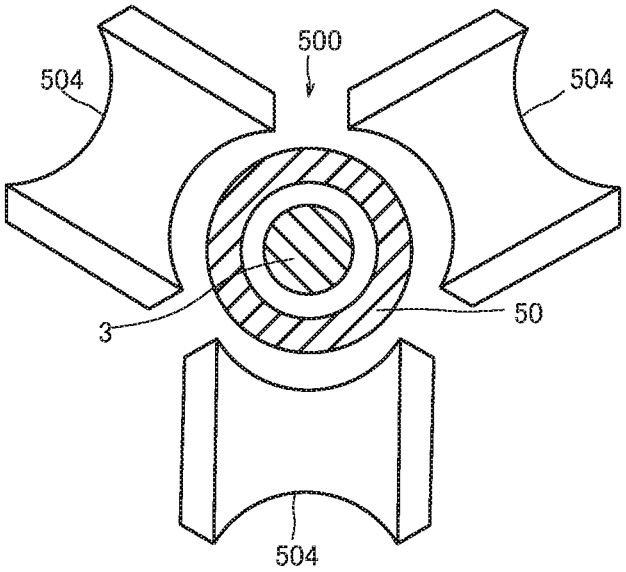
FIG. 30 is a front view of a rearward &Mining mechanism of a different form from the rearward damming mechanisms illustrated in FIG. 21 and FIG. 26 to FIG. 29.
Figure 31:
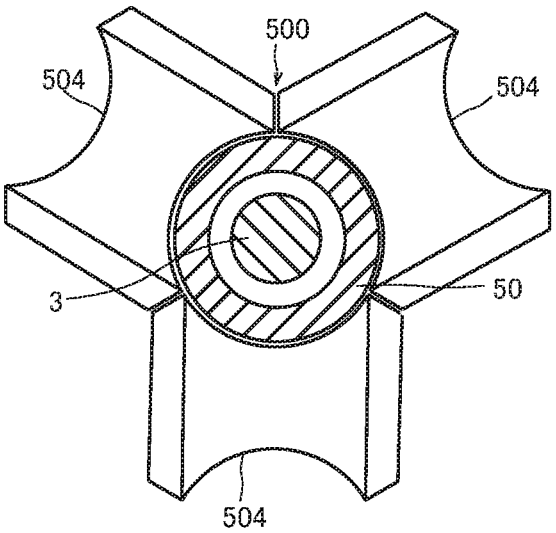
FIG. 31 is a front view of the rearward damming mechanism illustrating a state in which a plurality of damming plate members illustrated in FIG. 30 have been brought close to the outer surface of the hollow shell during piercing-rolling or elongation rolling.

In addition, the rearward damming mechanism 500 tiny have a configuration that is different from the configurations illustrated in FIG. 20 to FIG. 29. For example, as illustrated in FIG. 30 and FIG. 31, the rearward damming mechanism 500 may be a mechanism that uses a plurality of damming members. In this case, as illustrated in FIG. 30, the rearward damming mechanism 500 includes a plurality of damming members 504 which are disposed around the mandrel bar 3. As illustrated in FIG. 30, the plurality of damming members 504 are, for example, rolls. In a case where the damming members 504 are rolls, as illustrated in FIG. 30, preferably a roll surface of each damming member 504 is curved so that the roll surface of each damming member 504 contacts the outer surface of the hollow shell 50. The damming members 504 are movable in the radial direction of the mandrel bar 3 by means of an unshown moving mechanism. The moving mechanism is, for example, a cylinder. The cylinder may be a hydraulic cylinder, may be a pneumatic cylinder, or may be an electric motor-driven cylinder.

During piercing-rolling or elongation rolling, when the hollow shell 50 passes the rearward damming mechanism 500, the plurality of damming members 504 move in the radial direction toward the outer surface of the hollow shell 50. As illustrated in FIG. 31, the inner surface of each of the plurality of damming members 504 is then disposed in the vicinity of the outer surface of the hollow shell 50. Thus, when the outer surface cooling mechanism 400 is ejecting the cooling fluid CF toward the upper part of the outer surface, the lower part of the outer surface, the left part of the outer surface and the right part of the outer surface of the hollow shell 50 that is inside the cooling zone 32, the plurality of damming members 504 form a dam (protective wall). Therefore, the rearward damming mechanism 500 dams cooling fluid from flowing to the upper part of the outer surface, the lower part of the outer surface, the left part of the outer surface and the right part of the outer surface of the hollow shell 50 after the aforementioned parts of the outer surface of the hollow shell 50 leave from the cooling zone 32.

Thus, the rearward damming Mechanism 500 may have a configuration that does not use the rearward damming fluid BF. The configuration of the rearward damming mechanism 500 is not particularly limited as long as the rearward damming mechanism 500 is equipped with a mechanism that, when the outer surface cooling mechanism 400 is cooling the hollow shell 50, dams cooling fluid from flowing to the upper part of the outer surface, the lower part of the outer surface, the left part of the outer surface and the right part of the outer surface of the hollow shell 50 after the aforementioned parts of the outer surface of the hollow shell 50 leave from the cooling zone 32.

Fourth Embodiment

Figure 32:
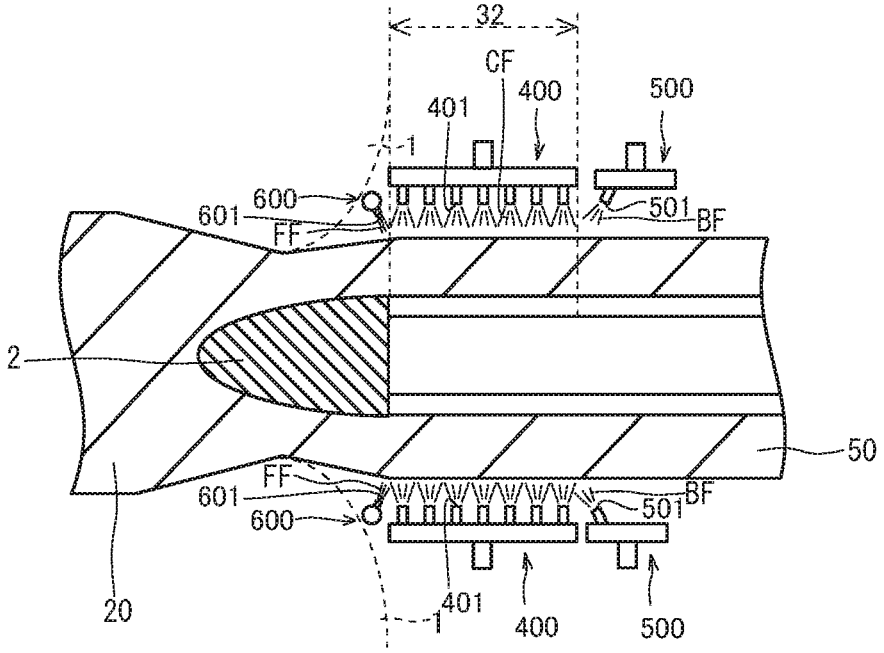
FIG. 32 is an enlarged view of the vicinity of the delivery side of skewed rolls of a piercing machine according to a fourth embodiment.

FIG. 32 is a view illustrating the delivery sides of the skewed rolls 1 of a piercing machine 10 according to a fourth embodiment. Referring to FIG. 32, in comparison to the piercing machine 10 according, to the first embodiment, the piercing machine 10 according to the fourth embodiment newly includes a frontward damming mechanism 600 and a rearward damming mechanism 500. That is, the piercing machine 10 according to the fourth embodiment has a configuration obtained by combining the second embodiment and the third embodiment.

The configuration of the frontward damming mechanism 600 of the present embodiment is the same as the configuration of the frontward damming mechanism 600 in the second embodiment. Further, the configuration of the rearward damming mechanism 500 of the present embodiment is the same as the configuration of the rearward damming mechanism 500 in the third embodiment.

In the piercing machine 10 according to the present embodiment, during piercing-rolling or elongation rolling, the cooling fluid CF that flows over the outer surface portion of the hollow shell 50 after contacting the outer surface portion of the hollow shell 50 in the cooling zone 32 is suppressed from contacting the outer surface portions of the hollow shell 50 that are frontward and rearward of the cooling zone 32 by means of the frontward damming mechanism 600 and the rearward damming mechanism 500.

Specifically, the frontward damming mechanism 600 is equipped with a mechanism that, when the outer surface cooling mechanism 400 is cooling the hollow shell inside the cooling zone 32 by ejecting the cooling fluid CF toward the upper part of the outer surface, the lower part of the outer surface, the left part of the outer surface and the right part of the outer surface of the hollow shell 50 inside the cooling zone 32, dams the cooling fluid from flowing to the upper part, the lower part, the left part and the right part of the outer surface of the hollow shell 50 before the aforementioned parts of the outer surface of the hollow shell 50 enter the cooling zone 32. Specifically, when seen in the advancing direction of the hollow shell 50, the frontward damming upper member 600U ejects the frontward damming fluid FF toward the upper part of the outer surface of the hollow shell 50 that is positioned in the vicinity of the entrance side of the cooling zone 32 to thereby form a dam (protective wall) composed of the frontward damming fluid FF at the upper part of the outer surface of the hollow shell 50 before the upper part of the outer surface of the hollow shell 50 enters the cooling zone 32. Similarly, the frontward damming lower member 600D ejects the frontward damming fluid FF toward the lower part of the outer surface of the hollow Shell 50 that is positioned in the vicinity of the entrance side of the cooling zone 32 to thereby form a dam (protective wall) composed of the frontward damming fluid FF at the lower part of the outer surface of the hollow shell 50 before the lower part of the outer surface of the hollow shell 50 enters the cooling zone 32. Similarly, the frontward damming left member 600L ejects the frontward damming fluid FF toward the left part of the outer surface of the hollow shell 50 that is positioned in the vicinity of the entrance side of the cooling zone 32 to thereby form a dam (protective wall) composed of the frontward damming fluid FF at the left part of the outer surface of the hollow shell 50 before the left part of the outer surface of the hollow shell 50 enters the cooling zone 32. Similarly, the frontward damming right member 600R ejects the frontward damming fluid FF toward the right part of the outer surface of the hollow shell 50 that is positioned in the vicinity of the entrance side of the cooling zone 32 to thereby form a dam (protective wall) composed of the frontward damming fluid FF at the right part of the outer surface of the hollow shell 50 before the right part of the outer surface of the hollow shell 50 enters the cooling zone 32. These dams that are composed of the frontward damming fluid FF dam the cooling fluid CF that contacts the outer surface portion of the hollow shell 50 within the cooling zone 32 and rebounds therefrom and attempts to flow to the zone frontward of the cooling zone 32. Therefore, contact of the cooling fluid CF with the outer surface portion of the hollow shell 50 that is frontward of the cooling zone 32 can be suppressed, and temperature variations in the axial direction of the hollow shell 50 can be further reduced.

In addition, the rearward damming mechanism 500 is equipped with a mechanism that, when the outer surface cooling mechanism 400 is cooling the hollow shell inside the cooling zone 32 by ejecting the cooling fluid CF toward the upper part of the outer surface, the lower part of the outer surface, the left part of the outer surface and the right part of the outer surface of the hollow shell 50 inside the cooling zone 32, dams the cooling fluid CF from flowing to the upper part, the lower part, the left part and the right part of the outer surface of the hollow shell 50 after the aforementioned parts of the outer surface of the hollow shell 50 leave from the cooling zone 32. Specifically, when seen in the advancing direction of the hollow shell 50, the rearward damming upper member 500U ejects the rearward damming fluid BF toward the upper part of the outer surface of the hollow shell 50 that is positioned in the vicinity of the delivery side of the cooling zone 32 to thereby form a dam (protective wall) composed of the rearward damming fluid BF at the upper part of the outer surface of the hollow shell 50 after the upper part of the outer surface of the hollow shell 50 leaves from the cooling zone 32. Similarly, the rearward damming lower member 500D ejects the rearward damming fluid BF toward the lower part of the outer surface of the hollow shell 50 that is positioned in the vicinity of the delivery side of the cooling zone 32 to thereby form a dam (protective wall) composed of the rearward damming fluid BF at the lower part of the outer surface of the hollow shell 50 after the lower part of the outer surface of the hollow shell 50 leaves from the cooling zone 32. Similarly, the rearward damming left member 500L ejects the rearward damming fluid BF toward the left part of the outer surface of the hollow shell 50 that is positioned in the vicinity of the delivery side of the cooling zone 32 to thereby form a dam (protective wall) composed of the rearward damming fluid BF at the left part of the outer surface of the hollow shell 50 after the left part of the outer surface of the hollow shell 50 leaves from the cooling zone 32. Similarly, the rearward damming right member 500R ejects the rearward damming fluid BF toward the right part of the outer surface of the hollow shell 50 that is positioned in the vicinity of the delivery side of the cooling zone 32 to thereby form a dam (protective wall) composed of the rearward damming fluid BF at the right part of the outer surface of the hollow shell 50 after the right part of the outer surface of the hollow shell 50 leaves from the cooling zone 32. These dams that are composed of the rearward damming fluid BF dam the cooling fluid CF that contacts the outer surface portion of the hollow shell 50 within the cooling zone 32 and rebounds therefrom and attempts to flow to the zone rearward of the cooling zone 32. Therefore, contact of the cooling fluid CF with the outer surface portion of the hollow shell 50 that is rearward of the cooling zone 32 can be suppressed, and temperature variations in the axial direction of the hollow shell 50 can be further reduced.

According to the configuration described above, in the piercing machine 10 of the present embodiment, the cooling fluid CF can be suppressed from contacting the outer surface portions of the hollow shell 50 that are frontward and rearward of the cooling zone 32, and temperature variations in the axial direction of the hollow shell 50 can be further reduced.

Note that, in the piercing machine 10 of the fourth embodiment, the frontward damming mechanism 600 may have the configuration illustrated in FIG. 18 and FIG. 19, and the rearward damming mechanism 500 may have the configuration illustrated in FIG. 30 and FIG. 31.

EXAMPLE

A test that simulated cooling of the hollow shell after piercing-rolling (hereunder, referred to as a "simulated test"), was performed using the outer surface cooling mechanism, the frontward damming mechanism and the rearward damming mechanism that are described in the fourth embodiment, and an effect of suppression contact of the cooling fluid with the outer surface of the hollow shell in zones other than the cooling zone obtained by the frontward damming mechanism and the rearward damming mechanism was verified.

[Simulated Test Method]

A hollow shell having an external diameter of 406 min, a wall thickness of 30 mm and a length of 2 m was prepared. A thermocouple was embedded at the center position in the longitudinal direction of the hollow shell, which was a wall thickness center position in a wall thickness direction of the hollow shell and was a position at a depth of 2 mm from the outer surface.

The hollow shell in which the thermocouple was embedded was heated for two hours at 950° C. in a heating furnace. The heated hollow shell was subjected to the simulated test using the outer surface cooling mechanism 400 having the configuration illustrated in FIG. 4. Specifically, the heated hollow shell was conveyed at a conveying speed of 6 m/min and caused to pass through the inside of the outer surface cooling mechanism 400. At such time, the time required for the position at which the thermocouple was embedded in the hollow shell to pass through the cooling zone 32 of the outer surface cooling mechanism 400 was 12 seconds. While the hollow shell was being conveyed, cooling water was ejected at the cooling zone 32 by the outer surface cooling mechanism 400.

After the aforementioned piercing-rolling, the outer surface cooling simulated test was performed, and a heat transfer coefficient at the position at which the thermocouple was embedded during the test was measured.

[Test Results]

Figure 33:
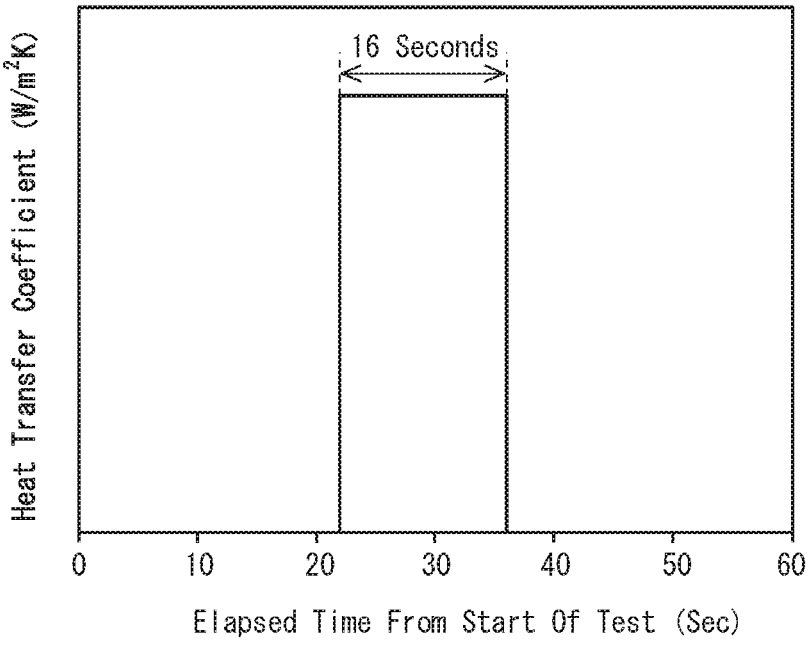
FIG. 33 is a view illustrating the relation between the elapsed time from the start of test and a heat transfer coefficient, which was obtained in a simulated test carded out in an example.

The results of measuring the heat transfer coefficient are shown in FIG. 33. The abscissa in FIG. 33 represents elapsed time (conveying time) (sec) from the start of the test. The ordinate represents the heat transfer coefficient ($W/m^2K$).

Referring to FIG. 33, a time period in which the heat transfer coefficient rises indicates that the position at which the thermocouple was embedded was being cooled by the coolant in the time period in question. As described above, the time required for the position at which the thermocouple was embedded to pass through the cooling zone 32 was 12 seconds. In this regard, referring to FIG. 13, the time period for which the position at which the thermocouple was embedded was cooled by the coolant was 16 seconds, which was approximately the same as the time required for the position at which the thermocouple was embedded to pass through the cooling zone 32. Thus, the frontward damming mechanism 600 and the rearward damming mechanism 500 could sufficiently suppress contact of the coolant with the outer surface of the hollow shell in the zones that were further frontward and further rearward than the cooling zone 32.

Embodiments of the present invention have been described above. However, the foregoing embodiments are merely examples for implementing the present invention. Accordingly, the present invention is not limited to the above embodiments, and the above embodiments can be appropriately modified within a range which does not deviate from the gist of the present invention.

REFERENCE SIGNS LIST

1 Skewed roll, 2 Plug, 3 Mandrel bar, 10 Piercing machine, 400 Outer surface cooling mechanism, 500 Rearward damming mechanism, 600 Frontward damming mechanism

The invention claimed is:

1. A piercing machine that performs piercing-rolling or elongating rolling of a material to produce a hollow shell, the machine comprising:

a plurality of skewed rolls disposed around a pass line along which the material passes;

a plug disposed on the pass line between the plurality of skewed rolls;

a mandrel bar extending rearward of the plug along the pass line from a rear end of the plug;

an outer surface cooling mechanism disposed around the mandrel bar, at a position that is rearward of the plug; and a frontward damming mechanism that is disposed around the mandrel bar at a position that is rearward of the plug and is frontward of the outer surface cooling mechanism, wherein an outer surface of the hollow shell advances through a cooling zone which has a specific length in an axial direction of the mandrel bar and is located rearward of the plug, as seen from an advancing direction of the hollow shell, the outer surface cooling mechanism ejects a cooling fluid toward an upper part of the outer surface, a lower part of the outer surface, a left part of the outer surface and a right part of the outer surface to cool the hollow shell inside the cooling zone, wherein the frontward damming mechanism comprises a mechanism that, when the outer surface cooling mechanism is cooling the hollow shell in the cooling zone, by ejecting the cooling fluid toward the upper part of the outer surface, the lower part of the outer surface, the left part of the outer surface and the right part of the outer surface of the hollow shell, and dam the cooling fluid from flowing to the upper part of the outer surface, the lower part of the outer surface, the left part of the outer surface and the right part of the outer surface of the hollow shell before the hollow shell enters the cooling zone, and wherein the outer surface cooling mechanism includes:

an outer surface cooling upper member disposed above the mandrel bar as seen from an advancing direction of the hollow shell, the outer surface cooling upper member including a plurality of cooling fluid upper-part ejection holes which eject the cooling fluid toward the upper part of the outer surface of the hollow shell in the cooling zone;

an outer surface cooling lower member disposed below the mandrel bar as seen from the advancing direction of the hollow shell, the outer surface cooling lower member including a plurality of cooling fluid lower-part ejection holes which eject the cooling fluid toward the lower part of the outer surface of the hollow shell in the cooling zone;

an outer surface cooling left member disposed leftward of the mandrel bar as seen from the advancing direction of the hollow shell, the outer surface cooling left member including a plurality of cooling fluid left-part ejection holes which eject the cooling fluid toward the left part of the outer surface of the hollow shell in the cooling zone; and an outer surface cooling right member disposed rightward of the mandrel bar as seen from the advancing direction of the hollow shell, the outer surface cooling right member including a plurality of cooling fluid right-part ejection holes which eject the cooling fluid toward the right part of the outer surface of the hollow shell in the cooling zone, wherein the frontward damming mechanism includes:

a frontward damming upper member including a plurality of frontward damming fluid upper-part ejection holes that is disposed above the mandrel bar as seen from the advancing direction of the hollow shell, and that ejects a frontward damming fluid toward the upper part of the outer surface of the hollow shell that is positioned in a vicinity of an entrance side of the cooling zone and dams the cooling fluid from flowing to the upper part of the outer surface of the hollow shell before the hollow shell enters the cooling zone;

a frontward damming left member including a plurality of frontward damming fluid left-part ejection holes that is disposed leftward of the mandrel bar as seen from the advancing direction of the hollow shell, and that ejects the frontward damming fluid toward the left part of the outer surface of the hollow shell that is positioned in a vicinity of the entrance side of the cooling zone and dams the cooling fluid from flowing to the left part of the outer surface of the hollow shell before the hollow shell enters the cooling zone; and a frontward damming right member including a plurality of frontward damming fluid right-part ejection holes that is disposed rightward of the mandrel bar as seen from the advancing direction of the hollow shell, and that ejects the frontward damming fluid toward the right part of the outer surface of the hollow shell that is positioned in a vicinity of the entrance side of the cooling zone and dams the cooling fluid from flowing to the right part of the outer surface of the hollow shell before the hollow shell enters the cooling zone, wherein the frontward damming upper member ejects the frontward damming fluid diagonally rearward toward the upper part of the outer surface of the hollow shell that is positioned in a vicinity of the entrance side of the cooling zone from the plurality of frontward damming fluid upper-part ejection holes;

the frontward damming left member ejects the frontward damming fluid diagonally rearward toward the left part of the outer surface of the hollow shell that is positioned in a vicinity of the entrance side of the cooling zone from the plurality of frontward damming fluid left-part ejection holes; and the frontward damming right member ejects the frontward damming fluid diagonally rearward toward the right part of the outer surface of the hollow shell that is positioned in a vicinity of the entrance side of the cooling zone from the plurality of frontward damming fluid right-part ejection holes.

2. The piercing machine according to claim 1, wherein the cooling fluid is a gas and/or a liquid.

3. The piercing machine according to claim 1, wherein:

the frontward damming mechanism further includes:

a frontward damming lower member including a plurality of frontward damming fluid lower-part ejection holes that is disposed below the mandrel bar as seen from the advancing direction of the hollow shell, and that ejects the frontward damming fluid toward the lower part of the outer surface of the hollow shell that is positioned in a vicinity of the entrance side of the cooling zone and dams the cooling fluid from flowing to the lower part of the outer surface of the hollow shell before the hollow shell enters the cooling zone.

4. The piercing machine according to claim 3, wherein:

the frontward damming lower member ejects the frontward damming fluid diagonally rearward toward the lower part of the outer surface of the hollow shell that is positioned in a vicinity of the entrance side of the cooling zone from the plurality of frontward damming fluid lower-part ejection holes.

5. The piercing machine according to claim 1, wherein:

the frontward damming fluid is a gas and/or a liquid.

6. The piercing machine according to claim 1, further comprising:

a rearward damming mechanism that is disposed around the mandrel bar at a position that is rearward of the outer surface cooling mechanism, wherein:

the rearward damming mechanism comprises a mechanism that, when the outer surface cooling mechanism is cooling the hollow shell by ejecting the cooling fluid toward the upper part of the outer surface, the lower part of the outer surface, the left part of the outer surface and the right part of the outer surface of the hollow shell, dams the cooling fluid from flowing to the upper part of the outer surface, the lower part of the outer surface, the left part of the outer surface and the right part of the outer surface of the hollow shell after the hollow shell leaves from the cooling zone.

7. The piercing machine according to claim 6, wherein:

the rearward damming mechanism includes:

a rearward damming upper member including a plurality of rearward damming fluid upper-part ejection holes that is disposed above the mandrel bar as seen from the advancing direction of the hollow shell, and that ejects a rearward damming fluid toward the upper part of the outer surface of the hollow shell that is positioned in a vicinity of a delivery side of the cooling zone and dams the cooling fluid from flowing to the upper part of the outer surface of the hollow shell after the hollow shell leaves from the cooling zone;

a rearward damming left member including a plurality of rearward damming fluid left-part ejection holes that is disposed leftward of the mandrel bar as seen from the advancing direction of the hollow shell, and that ejects the rearward damming fluid toward the left part of the outer surface of the hollow shell that is positioned in a vicinity of the delivery side of the cooling zone and dams the cooling fluid from flowing to the left part of the outer surface of the hollow shell after the hollow shell leaves from the cooling zone; and a rearward damming right member including a plurality of rearward damming fluid right-part ejection holes that is disposed rightward of the mandrel bar as seen from the advancing direction of the hollow shell, and that ejects the rearward damming fluid toward the right part of the outer surface of the hollow shell that is positioned in a vicinity of the delivery side of the cooling zone and dams the cooling fluid from flowing to the right part of the outer surface of the hollow shell after the hollow shell leaves from the cooling zone.

8. The piercing machine according to claim 7, wherein:

the rearward damming upper member ejects the rearward damming fluid diagonally frontward toward the upper part of the outer surface of the hollow shell that is positioned in a vicinity of the delivery side of the cooling zone from the plurality of rearward damming fluid upper-part ejection holes;

the rearward damming left member ejects the rearward damming fluid diagonally frontward toward the left part of the outer surface of the hollow shell that is positioned in a vicinity of the delivery side of the cooling zone from the plurality of rearward damming fluid left-part ejection holes; and the rearward damming right member ejects the rearward damming fluid diagonally frontward toward the right part of the outer surface of the hollow shell that is positioned in a vicinity of the delivery side of the cooling zone from the plurality of rearward damming fluid right-part ejection holes.

9. The piercing machine according to claim 7, wherein:

the rearward damming mechanism further includes:

a rearward damming lower member including a plurality of the rearward damming fluid lower-part ejection holes that is disposed below the mandrel bar as seen from the advancing direction of the hollow shell, and that ejects the rearward damming fluid toward the lower part of the outer surface of the hollow shell that is positioned in a vicinity of the delivery side of the cooling zone and dams the cooling fluid from flowing to the lower part of the outer surface of the hollow shell after the hollow shell leaves from the cooling zone.

10. The piercing machine according to claim 9, wherein:

the rearward damming lower member ejects the rearward damming fluid diagonally frontward toward the lower part of the outer surface of the hollow shell that is positioned in a vicinity of the delivery side of the cooling zone from the plurality of rearward damming fluid lower-part ejection holes.

11. The piercing machine according to claim 7, wherein:

the rearward damming fluid is a gas and/or a liquid.

12. A method for producing a seamless metal pipe using the piercing machine according to claim 1, comprising:

a rolling process of subjecting the material to piercing-rolling or elongating rolling using the piercing machine to form a hollow shell; and a cooling process of, during the piercing-rolling or the elongating rolling, with respect to an outer surface of the hollow shell advancing through a cooling zone which has a specific length in an axial direction of the mandrel bar and is located rearward of the plug, as seen from an advancing direction of the hollow shell, ejecting a cooling fluid toward an upper part of the outer surface, a lower part of the outer surface, a left part of the outer surface and a right part of the outer surface to cool the hollow shell inside the cooling zone.

13. The piercing machine according to claim 1, wherein the plurality of ejection holes are spaced equidistant from each other on the outer surface cooling mechanism.

* * * * *